US010807683B2

(12) United States Patent
Pacini

(10) Patent No.: US 10,807,683 B2
(45) Date of Patent: Oct. 20, 2020

(54) MULTIPLE ACCESSORY STORAGE DEVICE

(71) Applicant: Joseph Gabriel Pacini, Orlando, FL (US)

(72) Inventor: Joseph Gabriel Pacini, Orlando, FL (US)

( * ) Notice: Subject to any disclaimer, the term of this patent is extended or adjusted under 35 U.S.C. 154(b) by 0 days.

(21) Appl. No.: 16/544,360

(22) Filed: Aug. 19, 2019

(65) Prior Publication Data

US 2020/0039614 A1 Feb. 6, 2020

Related U.S. Application Data

(63) Continuation of application No. 15/853,149, filed on Dec. 22, 2017, now Pat. No. 10,384,750.

(60) Provisional application No. 62/574,818, filed on Oct. 20, 2017, provisional application No. 62/438,519, filed on Dec. 23, 2016.

(51) Int. Cl.

| | |
|---|---|
| ***B63B 32/70*** | (2020.01) |
| ***B63C 9/11*** | (2006.01) |
| *B63C 9/08* | (2006.01) |

(52) U.S. Cl.

CPC ..... *B63B 32/70* (2020.02); *B63C 9/11* (2013.01); *B63C 9/08* (2013.01)

(58) Field of Classification Search

CPC ..... B63B 35/85; B63C 9/08

See application file for complete search history.

(56) References Cited

U.S. PATENT DOCUMENTS

| | | | | |
|---|---|---|---|---|
| 2,591,829 | A * | 4/1952 | Katzenmeyer | E04H 15/20 52/2.21 |
| 3,994,102 | A * | 11/1976 | Johnson | E04H 15/20 52/2.21 |
| 4,595,373 | A | 6/1986 | Giroux | |
| 4,935,970 | A * | 6/1990 | Aristone | E04H 4/0025 4/488 |
| 6,659,822 | B1 | 12/2003 | Dombeck | |

(Continued)

OTHER PUBLICATIONS

ISA/US, International Search Report and Written Opinion of the International Searching Authority issued in counterpart International Application No. PCT/US17/68275. dated Mar. 12, 2018.

(Continued)

*Primary Examiner* — S. Joseph Morano
*Assistant Examiner* — Jovon E Hayes

(57) ABSTRACT

A removable storage device adaptable for use in exercise, fishing, paddling, floating, anchoring and other operations pertaining to, but not limited to, recreational operation of watercraft. This storage device has a population of receptacles or storage areas in which a user may rapidly and securely store a variety of objects such as, for example only, paddles, snorkeling gear, valuable items, waterproof pouches and/or containers, lights, personal flotation devices, dog leashes, fishing poles, anchors, food and/or beverage containers, rope, flares and other desired items. This removable storage device may be constructed to allow secure fastening of the storage device to a wide variety of external surfaces such as, for example only paddle craft, docks, boats and other objects and surfaces desired by the operator. The storage device may be an inflatable device, a solid or semi-solid device, and/or a combination inflatable and solid or semi-solid device.

12 Claims, 46 Drawing Sheets

(56) References Cited

U.S. PATENT DOCUMENTS

| | | | | |
|---|---|---|---|---|
| 6,679,811 | B2 * | 1/2004 | Chen | A63B 5/11 482/27 |
| 7,104,864 | B1 * | 9/2006 | Liou | A63H 33/10 446/221 |
| D660,393 | S | 5/2012 | Bradley | |
| 8,992,277 | B2 | 3/2015 | Macias | |
| D731,609 | S | 6/2015 | Hanscom | |
| D732,129 | S | 6/2015 | Hanscom | |
| 9,187,157 | B1 | 11/2015 | Cooper | |
| 9,394,038 | B2 | 7/2016 | Hanscom | |
| 2009/0019638 | A1 * | 1/2009 | Ellis | B60P 3/38 5/119 |
| 2009/0211168 | A1 * | 8/2009 | Bogar | A63G 31/12 52/2.17 |
| 2013/0056509 | A1 | 3/2013 | Fuller | |
| 2013/0340661 | A1 | 12/2013 | Siverts | |
| 2015/0157888 | A1 * | 6/2015 | Gordon | A63G 9/00 446/220 |
| 2015/0360751 | A1 | 12/2015 | Hanscom | |
| 2016/0272286 | A1 | 9/2016 | Caranto | |
| 2017/0043846 | A1 | 2/2017 | Elkinton | |
| 2017/0291667 | A1 | 10/2017 | Campbell | |
| 2017/0355428 | A1 | 12/2017 | Little | |
| 2018/0127068 | A1 | 5/2018 | Rohrer | |
| 2018/0178887 | A1 * | 6/2018 | Pacini | B63B 32/70 |
| 2018/0208279 | A1 | 7/2018 | Soren | |
| 2018/0362124 | A1 | 12/2018 | Norton | |

OTHER PUBLICATIONS

The Paddle Sheath (Mar. 9, 2015), https://www.boteboard.com/blog/post/the-paddle-sheath/.

* cited by examiner

MULTIPLE ACCESSORY STORAGE DEVICE

CROSS-REFERENCE TO RELATED APPLICATIONS

This application is a continuation of U.S. patent application Ser. No. 15/853,149, filed Dec. 22, 2017, which claims the benefit of U.S. Provisional Application No. 62/438,519, filed on Dec. 23, 2016, and 62/574,818, filed on Oct. 20, 2017, which are hereby incorporated by reference as though fully set forth herein.

FIELD OF THE DISCLOSURE

This disclosure relates to a three dimensional housing device that affixes to external structures or objects, including but not limited to paddle craft, and is used for storage of multiple accessories.

BACKGROUND OF THE DISCLOSURE

Operators of watercraft, including but not limited to personal paddle craft, often need multiple accessories and personal belongings while on the water. Some personalized watercraft come equipped with compartments for storage although others, like stand up paddleboards ("SUP"), often do not. This leaves SUP operators limited to what they can have available to them while on the water.

Personal items such as payment methods, I.D. cards, car keys and cell phones must be kept off the board or stored in other devices such as backpacks, bags or other personal containers. Hydration bottles also risk falling overboard while paddling SUPs unless carried on your person, or in said tote type options mentioned above. Even the user's paddle tends to float overboard unless the operator maintains constant grip of it. If the paddle is placed on the board itself, the ease of said paddle to roll/slide off the board and into the water is quite high.

There are times when the user needs to be placed specifically on the water without wind, drift, or current moving operator from desired location. Anchors are typically used to keep watercraft fixed on the water, however, anchors prove to be difficult and dangerous to transport while manning a paddleboard.

There are several solutions to these storage problems on the market. Most solutions address one of these storage needs at a time. There are cup holders for various sized hydration containers. These cup holders affix to certain boards in a specific manner that is applicable to some boards while other board designs are not suitable to the attachment method presented by said cup holder. Existing cup holder solutions are at a disadvantage due to the limited ability to accommodate multiple hydration container options on a variety of watercraft.

Paddle securing solutions are highly limited to location onboard and mounting thereof. These disadvantages continue with the only mounting options available for securing the paddle being attachment to the shaft of the paddle such that the paddle lays horizontally. This limits the securing devices' ability to hold paddles with a broad range of shaft diameters and shapes. If a paddle securing device is fixed to the board, it causes issues in transporting the board. The paddle securing device is a fixed protrusion from the side of the board, exposing it to harmful elements during transit. This fixed protrusion also limits ability to stack multiple boards close together.

SUMMARY OF THE DISCLOSURE

It is an object of the disclosure to provide a removable storage device adaptable for use in exercise, fishing, paddling, floating, anchoring and other operations pertaining to, but not limited to, recreational operation of watercraft. This storage device has a population of receptacles or storage areas, such as, for example only slots, fittings, tunnels and pockets, which allow a user to rapidly and securely store objects as desired by a user such as, for example only, paddles, snorkeling gear, valuable items, waterproof pouches and/or containers, lights, personal flotation devices ("PFD"), dog leashes, fishing poles, anchors, food and/or beverage containers, rope, flares and other items desired by the user. This removable storage device may be constructed to allow secure fastening of the storage device to a wide variety of external surfaces such as, for example only paddle craft (e.g., paddleboards, kayaks, canoes, boats, etc.), docks, boats and other objects and surfaces desired by the operator. The storage device may, in various embodiments, be buoyant such that the storage device may float.

This storage device may be equipped with a securing device (e.g., loop, buckle, clasp or the like) affixed, cut into, embedded or otherwise built into its underside, which connects to the paddleboard or to mounts, hooks, straps and other connection devices that secure the storage device to desired external surfaces. The bottom of the storage device may or may not be concave in geometry. When constructed with a concave bottom, while utilizing certain materials in its construction, it creates increased stability to the connection of the storage device to desired surface and further adds to the storage securing qualities therein.

The storage device has numerous options for storing items, such as but not limited to, a paddle being stored vertically while the storage device securely houses the blade or handle ends of the paddle. The paddle may also be held by the storage device horizontally by wedging the shaft of the paddle between bottom of the storage device and the surface it is affixed to, or in specified slots and crevices on the storage device designed to receive paddles, fishing poles, spear guns, and other objects.

It is yet another feature of the storage device to be constructed of a variety of materials, including but not limited to, inflatable materials. This design feature allows users to deflate, roll up and tuck the storage device away for easy transportability. When the storage device is constructed as an inflatable device it is practically weightless creating little or no additional load for a user to overcome while using said storage device. It is a further advantage of the storage device, when constructed as an inflatable, to be safe due to its soft structure in the event where a user falls onto said storage device. It also has the ability to be used as a personal floatation device.

Briefly therefore, one aspect of the disclosure is directed to a storage device, comprising an inflatable base; a base member affixed to the inflatable base; a first inflatable member affixed to the base member, wherein when the inflatable base and the first inflatable member are inflated, the inflatable base and the first inflatable member cooperate with one another to form a first storage area; and a second inflatable member affixed to the first inflatable member, wherein when the first inflatable member and the second inflatable member are inflated, the first inflatable member and the second inflatable member cooperate with one another to form a second storage area, and wherein when the inflatable base and the second inflatable member are inflated, the inflatable base and the second inflatable member cooperate with one another to form a third storage area.

Another aspect of the disclosure is directed to a storage device, comprising an inflatable base; a base member affixed to the inflatable base; a first inflatable member affixed to the base member, wherein when the inflatable base and the first inflatable member are inflated, the inflatable base and the first inflatable member cooperate with one another to form a first storage area; and a second inflatable member affixed to the base member, wherein when the first inflatable member and the second inflatable member are inflated, the first inflatable member and the second inflatable member cooperate with one another to form a second storage area, and wherein when the inflatable base and the second inflatable member are inflated, the inflatable base and the second inflatable member cooperate with one another to form a third storage area.

Another aspect of the disclosure is directed to a storage device, comprising a body having a concave base and a population of storage areas in the body.

Yet another aspect of the disclosure is directed to a storage device comprising a non-inflatable body having a population of storage areas in the body.

Yet another aspect of the disclosure is directed to a storage device, comprising an inflatable base, a base member affixed to the inflatable base, and a non-inflatable body affixed to the inflatable base and extending upward from the base member, wherein the non-inflatable body comprises a population of storage areas.

Yet another aspect of the disclosure is directed to a storage device which is adapted to be used as a wearable personal flotation device, comprising an inflatable base adapted to be secured to a user's torso, a base member affixed to the inflatable base, and a second inflatable member connected to the base member by a pair of tethers, wherein the second inflatable member is adapted to be switched from a first position proximate the inflatable base and a second position extended away from the inflatable base and placed behind the user's head.

Yet another aspect of the disclosure is directed to a storage device, comprising a first inflatable base, a base member affixed to the first inflatable base, a first inflatable member affixed to and extending upward from the base member, wherein the first inflatable member extends above the first inflatable base, a second inflatable member above the first inflatable base, a curtain having a top end and a bottom end, wherein the top end is affixed to the second inflatable member and the bottom end is affixed to the base member, and a second inflatable base below the first inflatable base, wherein the second inflatable base is connected to the first inflatable base.

Yet another aspect of the disclosure is directed to an inflatable device comprising a base element and a promotional member. The base member comprises a first inflatable base, a base member affixed to the first inflatable base, and a second inflatable base below the first inflatable base, wherein the second inflatable base is connected to the first inflatable base. The promotional member is affixed to and extending upward from the base member, wherein the first inflatable member extends above the first inflatable base.

Yet another aspect of the disclosure is directed to a storage device comprising an inflatable base; a base member affixed to the inflatable base; and a first inflatable member affixed to the base member, wherein when the inflatable base and the first inflatable member are inflated, the inflatable base and the first inflatable member cooperate with one another to form a first storage area.

Yet another aspect of the disclosure is directed to a storage device, comprising a first inflatable base; a base member affixed to the first inflatable base; a first inflatable member affixed to the base member, wherein when the first inflatable base and the first inflatable member are inflated, the inflatable base and the first inflatable member cooperate with one another to form a first storage area; and a second inflatable member above the first inflatable base, wherein when the first inflatable member and the second inflatable member are inflated, the first inflatable member and the second inflatable member cooperate with one another to form a second storage area, and wherein when the first inflatable base and the second inflatable member are inflated, the first inflatable base and the second inflatable member cooperate with one another to form a third storage area.

Yet another aspect of the disclosure is directed to an inflatable device comprising a base element, comprising a first inflatable base; a base member affixed to the first inflatable base; and a second inflatable base below the first inflatable base, wherein the second inflatable base is connected to the first inflatable base.

BRIEF DESCRIPTION OF THE DRAWINGS

These and other aspects, features, details, utilities, and advantages of the disclosure will become more fully apparent from the following detailed description, appended claims, and accompanying drawings, wherein the drawings illustrate features in accordance with exemplary embodiments of the disclosure, and wherein:

Like reference numbers refer to like or equivalent parts in the several views.

DETAILED DESCRIPTION OF EMBODIMENTS

Figure 1:
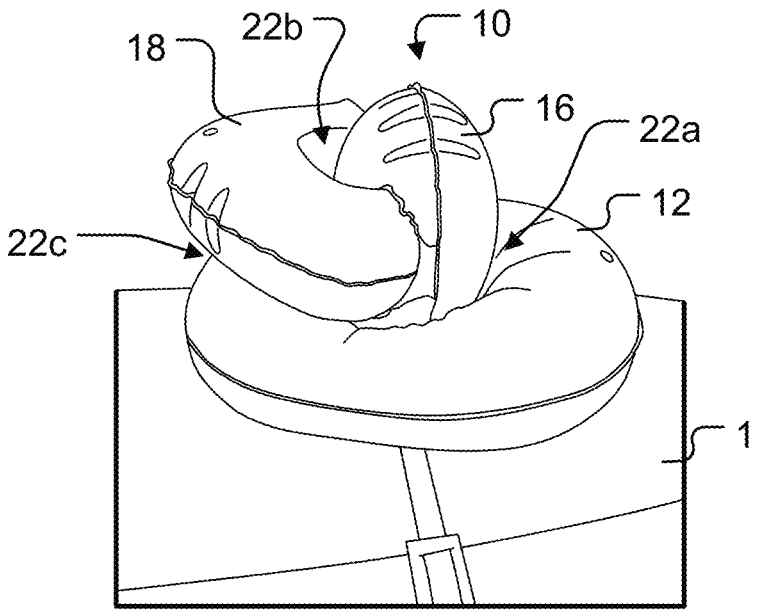
FIG. 1 is an image of the right side of an inflatable storage device according to a first embodiment of the disclosure.

Various embodiments are described herein to various apparatuses. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

It must be noted that, as used in this specification and the appended claims, the singular forms "a," "an" and "the" include plural referents unless the content clearly dictates otherwise.

The terms "first," "second," and the like in the description and in the claims, if any, are used for distinguishing between similar elements and not necessarily for describing a particular sequential or chronological order. It is to be understood that the terms so used are interchangeable under appropriate circumstances such that the embodiments of the disclosure described herein are, for example, capable of operation in sequences other than those illustrated or otherwise described herein. Furthermore, the terms "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "rear," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the disclosure described herein are, for example, capable of operation in other orientations than those illustrated or otherwise described herein.

All numbers expressing measurements and so forth used in the specification and claims are to be understood as being modified in all instances by the term "about."

FIGS. 1 through 12 illustrate an embodiment of a storage device 10 adapted to store a variety of items. Storage device 10 includes an inflatable base 12, a base member 14 (see FIG. 2A), a first inflatable member 16, and a second inflatable member 18 which cooperate, when inflated, to form a population of storage areas. Storage device 10 may be affixed to a personal watercraft, such as for example a standup paddleboard 1 and stored on or within storage device 10 can be, for example and without limitation, a paddle 2, a pair of shoes 3, a pet leash 4, etc. (see FIG. 6).

Inflatable base 12, base member 14, first inflatable member 16, and a second inflatable member 18 may be made from polyurethane, vinyl, polyvinyl chloride (PVC), neoprene, or other synthetic or natural materials known in the art. For example only and without limitation, storage device 10 may be made from about 16 gauge to about 18 gauge polyurethane (e.g., about 16 gauge, about 17 gauge, about 18 gauge). In other embodiments, for example only and without limitation, storage device 10 may be made from polyurethane having a thickness less than 16 gauge. In other embodiments, for example only and without limitation, storage device 10 may be made from polyurethane having a thickness greater than 18 gauge. In other embodiments, for example only and without limitation, storage device 10 may be made from about 0.55 mil polyvinyl chloride (PVC). In other embodiments, for example only and without limitation, storage device 10 may be made from about 0.65 mil polyvinyl chloride (PVC). In other embodiments, for example only and without limitation, storage device 10 may be made from about 1.0 mil polyvinyl chloride (PVC). In yet other embodiments, for example only and without limitation, storage device 10 may be made from about 0.55 mil to about 1.0 mil polyvinyl chloride (PVC) (e.g., about 0.55 mil, about 0.60 mil, about 0.65 mil, about 0.70 mil, about 0.75 mil, about 0.80 mil, about 0.85 mil, about 0.90 mil, about 0.95 mil, about 1.0 mil). In other embodiments, for example only and without limitation, storage device 10 may be made from polyvinyl chloride (PVC) having a thickness less than 0.55 mil. In other embodiments, for example only and without limitation, storage device 10 may be made from polyvinyl chloride (PVC) having a thickness greater than 1.0 mil.

When inflated, storage device 10 may be about 16 in. (about 40.64 cm) wide, about 20 in. (about 50.8 cm) long, and about 15 in. (about 38.1 cm) tall. In other embodiments, storage device may be larger or smaller than these dimensions. For example only and without limitation, storage device 10 may be from about 6 in. (about 15.24 cm) to about 24 in. (about 60.96 cm) wide, from about 6 in. (about 15.24 cm) to about 36 in. (about 91.44 cm) long, and from about 6 in. (about 15.24 cm) to about 30 in. (about 76.2 cm) tall. In some embodiments, for example only and without limitation, storage device 10 may be less than 16 in. (40.64 cm) wide, less than 20 in. (50.8 cm) long, and less than 15 in. (38.1 cm) tall. In yet other embodiments, for example only and without limitation, storage device 10 may be greater than 16 in. (40.64 cm) wide, greater than 20 in. (50.8 cm) long, and greater than 15 in. (38.1 cm) tall.

Inflatable base 12 is an inflatable tube that is inner-tube or donut shaped. Inflatable base 12 may have a substantially constant dimension (e.g. diameter) around its entire perimeter. In other embodiments, for example, inflatable base 12 may have a non-constant dimension. That is inflatable base 12 may have a smaller dimension (e.g., diameter) in the front of storage device 10 and may expand to a larger dimension (e.g. diameter) toward the back of storage device 10.

A base member 14 is affixed to the inside perimeter of inflatable base 12. That is, base member 14 serves to close off the "donut hole" in the center of inflatable base 12. Base member 14 may comprise a single sheet of material that is adhered or fused to inflatable base 12. In other embodiments, for example, base member 14 may be integrally formed with inflatable base 12. In yet other embodiments, base member 14 may comprise two or more separate sheets of material, wherein the separate sheets are fused to one another around the inside perimeter of inflatable base 12 (see, e.g., FIG. 38). In yet other embodiments, for example, base member 14 may comprise multiple sheets of material that are fused together such that the multiple layers act as a single sheet. By fusing multiple sheets to one another, base member 14 may be stronger than a single sheet of material. For example only and without limitation, as described herein, the fusing may be accomplished via radiofrequency (RF) welding. In other embodiments, the fusing may be accomplished via other methods known in the art without departing from the scope of the disclosure.

Affixed to base member 14 and extending upward and outward from base member 14 is first inflatable member 16. First inflatable member 16 is generally egg or light-bulb shaped with its narrow end affixed to base member 14 and its wider end extending upward and above the top of inflatable base 12. First inflatable member 16 is adhered or fused to base member 14. However, it will be understood that in other embodiments, first inflatable member 16 may be releasably affixed to base member 14 in a variety of ways, including but not limited to, buckles, straps, hook-and-loop style fasteners (e.g., Velcro®), any combination thereof, or in any manner known in the art.

Figure 2:
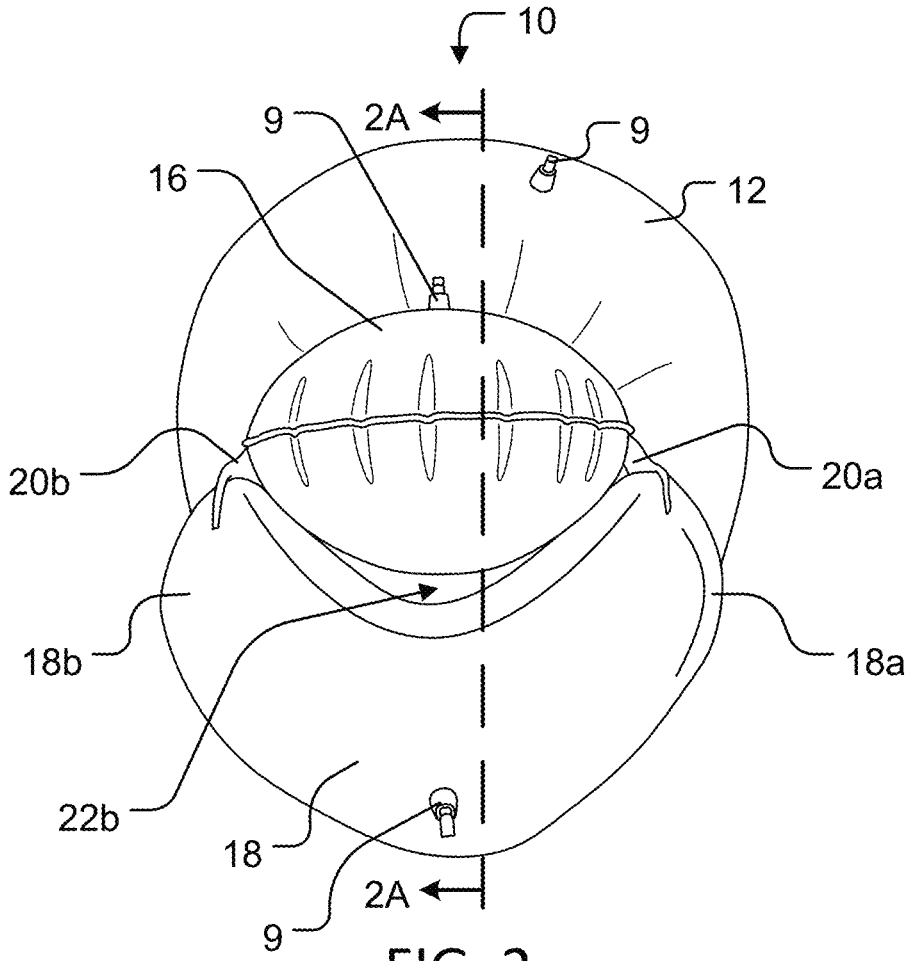
FIG. 2 is a top plan view of an inflatable storage device according to the first embodiment of the disclosure.
Figure 3:
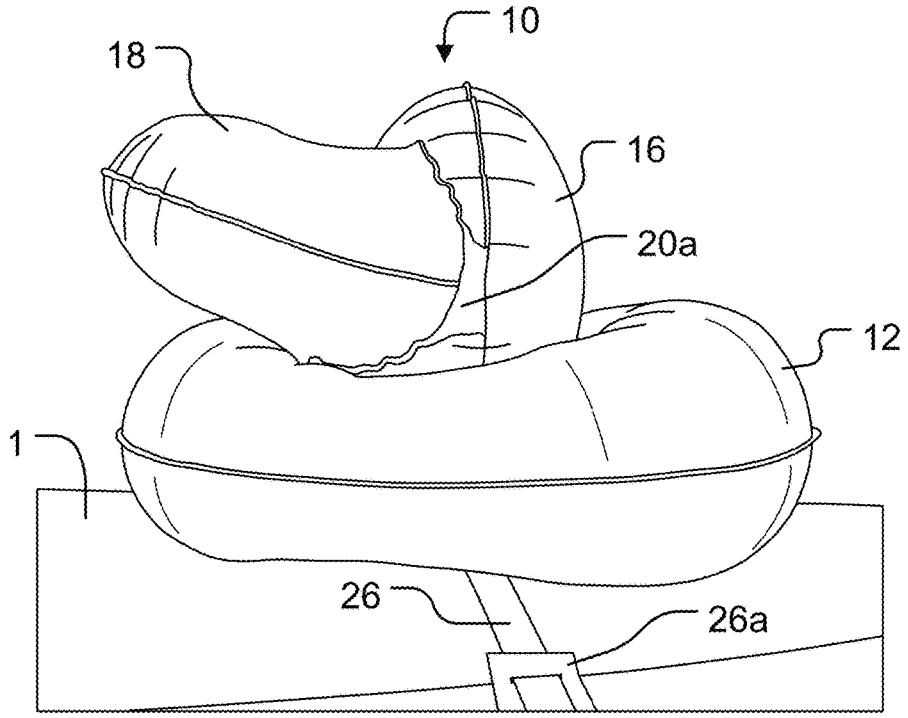
FIG. 3 is a right side view of an inflatable storage device according to the first embodiment of the disclosure.

Affixed to first inflatable member 16 is second inflatable member 18. Second inflatable member 18 is generally crescent moon shaped and is oriented generally parallel to inflatable base 12. Thus second inflatable member 18 is generally horizontal. As shown in FIGS. 2 and 3, the first and second ends 18*a*, 18*b* of second inflatable member 18 are secured to first inflatable member 16 by straps 20*a*, 20*b*. Second inflatable member 18 is adhered or fused to straps 20*a*, 20*b*, and straps 20*a*, 20*b* are adhered or fused to first inflatable member 16. However, it will be understood that in other embodiments, second inflatable member 18 may be releasably affixed to first inflatable member 16 in a variety of ways, including but not limited to, buckles, straps, hook-and-loop style fasteners (e.g., Velcro®), any combination thereof, or in any manner known in the art.

Inflatable base 12, first inflatable member 16 and second inflatable member 18 may each include an inflation valve 9 as known in the art for inflating inflatable objects. Thus inflatable base 12, first inflatable member 16 and second inflatable member 18 are each independently inflatable. Inflatable base 12, first inflatable member 16 and second inflatable member 18 may be inflated in a variety of ways, including but not limited to, manually by a user blowing air through the inflation valves 9, by a pump blowing air through the inflation valves 9, using compressed air to blow air through the inflation valves 9, etc. In various embodiments inflatable base 12, first inflatable member 16 and second inflatable member 18 may be in fluid communication with one another. That is, air may travel freely between inflatable base 12, first inflatable member 16 and second inflatable member 18. In such embodiments, storage device 10 has a single inflation valve 9 and inflatable base 12, first inflatable member 16 and second inflatable member 18 may all be inflated through that single inflation valve 9.

When inflatable base 12 and first inflatable member 16 are inflated, first inflatable member 16 makes contact with and presses up against at least a portion of the inner perimeter of inflatable base 12. Additionally, when inflatable base 12, first inflatable member 16, and second inflatable member 18 are inflated, the inner crescent portion of second inflatable member 18 makes contact with and presses up against at least a portion of first inflatable member 16 and the bottom side of second inflatable member 18 makes contact with and presses up against at least a portion of inflatable base 12.

Figure 6:
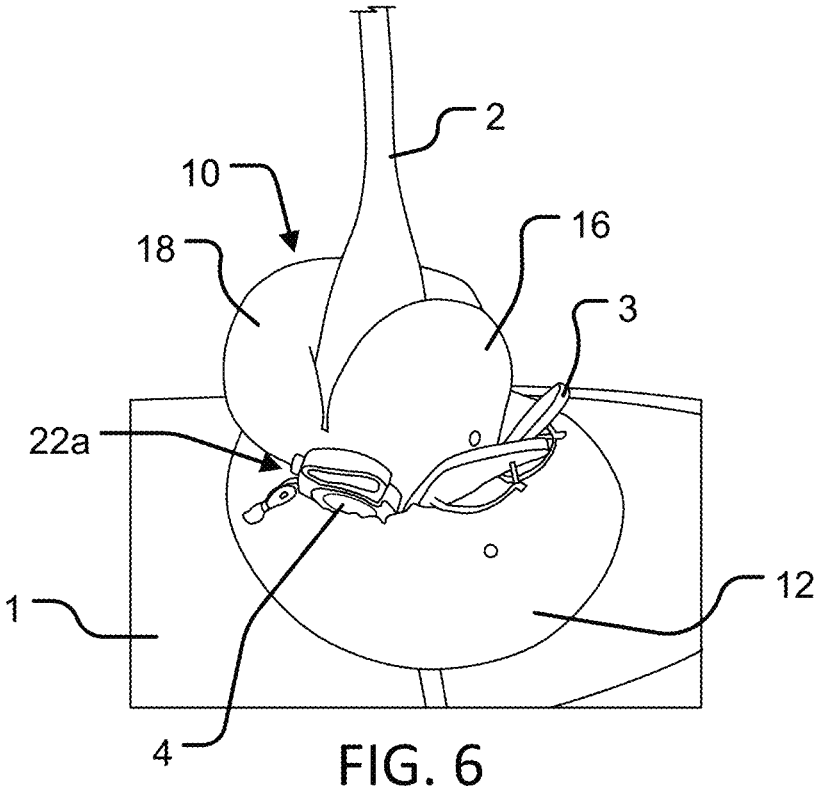
FIG. 6 is an image of the back side angle of an inflatable storage device according to the first embodiment of the disclosure.

In various embodiments, first inflatable member 16 and inflatable base 12 are in contact with each other around the entire inner perimeter of inflatable base 12. The contact between first inflatable member 16 and inflatable base 12 forms a first storage area 22*a* into which objects can be inserted. In various embodiments, first storage area 22*a* extends around the entire inner perimeter of inflatable base 12. Because inflatable base 12 and first inflatable member 16 are inflated and press against one another, any object inserted into first storage area 22*a* between inflatable base 12 and first inflatable member 16 is held in place by the force exerted on the object by inflatable base 12 and first inflatable member 16. That is, the object is sandwiched or wedged between inflatable base 12 and first inflatable member 16. As shown in FIG. 6, objects such as, for example only and without limitation, sandals 3 and dog leashes 4 may be inserted into and stored in first storage area 22*a*.

Figure 4:
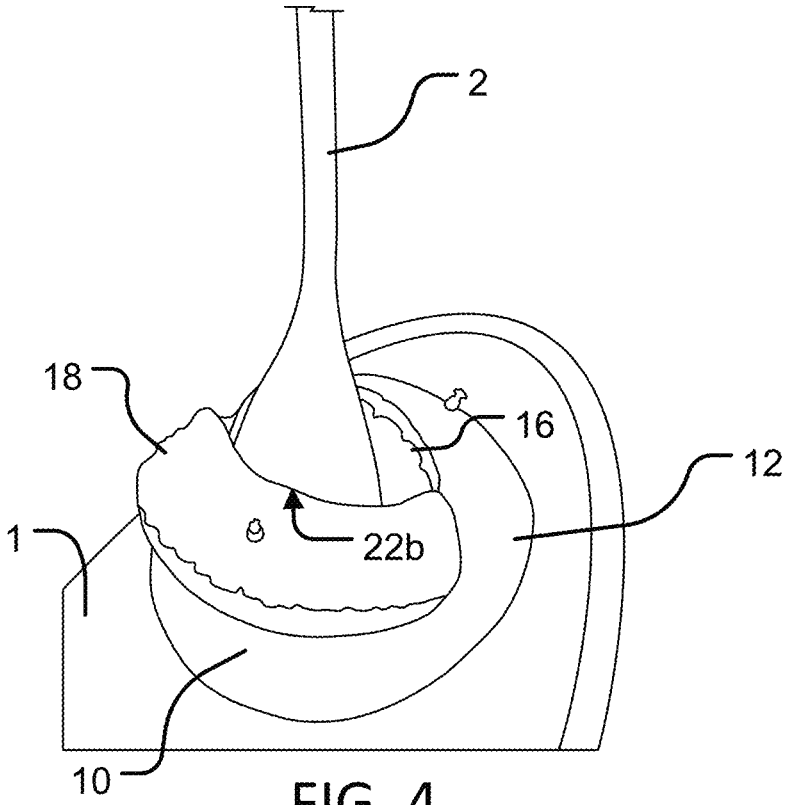
FIG. 4 is an image of the front side angle of an inflatable storage device according to the first embodiment of the disclosure.

Additionally, the contact between first inflatable member 16 and second inflatable member 18 forms a second storage area 22*b* into which objects can be inserted. Because first inflatable member 16 and second inflatable member 18 are inflated and press against one another, any object inserted into second storage area 22*b* between first inflatable member 16 and second inflatable member 18 is held in place by the force exerted on the object by first inflatable member 16 and second inflatable member 18. That is, the object is sandwiched between first inflatable member 16 and second inflatable member 18. As shown in FIG. 4, the tip of a paddle 2 may be inserted into second storage area 22*b* and slid downward until the tip is inserted into or proximate first storage area 22*a* and is proximate to or touches the upper surface of base member 14. At least a portion of the blade of paddle 2 is then held in second storage area 22*b*. That is, the tip of paddle 2 is sandwiched between inflatable base 12 and first inflatable member 16 and at least a portion of the blade of the paddle 2 is sandwiched between first inflatable member 16 and second inflatable member 18. Because of the force exerted on the tip and blade of paddle 2 by the inflated inflatable base, first inflatable member 16 and second inflatable member 18, paddle 2 may be securely retained in a generally vertical orientation in storage device 10.

The simple and rapid storage option provided by second storage area 22*b* provides the user with the ability to engage in a variety of activities on standup paddleboard 1, including but not limited to, functional fitness exercises involving use of both hands and recreational activities such as fishing, diving, sitting, lying down and other actions where secure storage of hand held paddles would be advantageous to the user.

Figure 5:
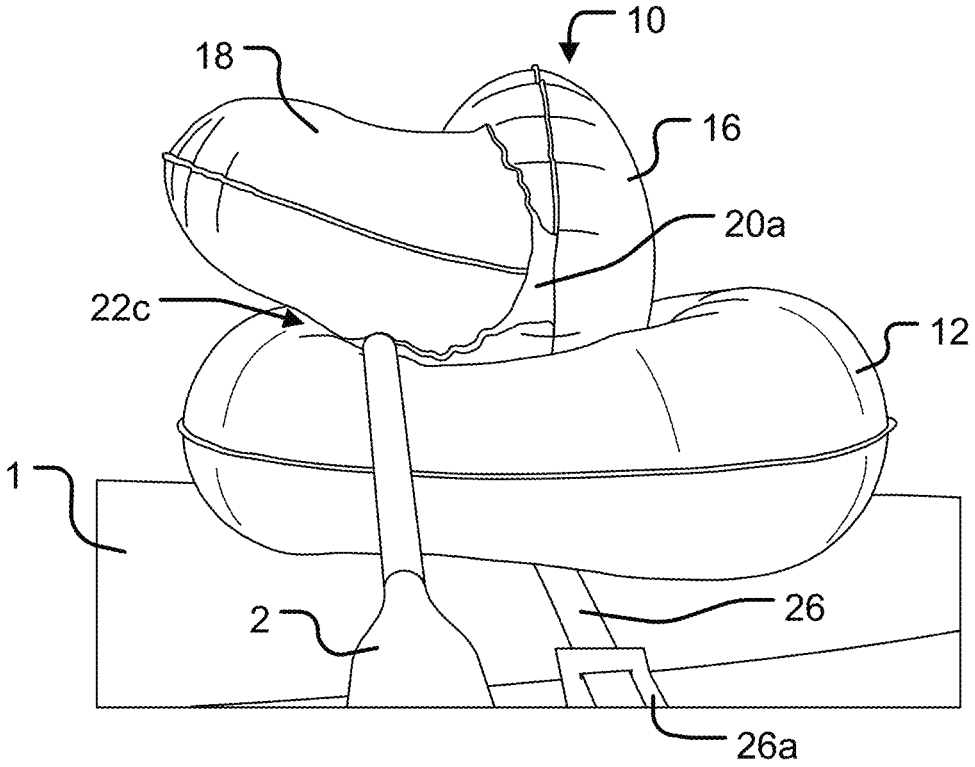
FIG. 5 is a right side view of an inflatable storage device according to the first embodiment of the disclosure.

Furthermore, the contact between second inflatable member 18 and inflatable base 12 forms a third storage area 22*c* into which objects can be inserted. Because second inflatable member 18 and inflatable base 12 are inflated and press against one another, any object inserted into third storage area 22*c* between second inflatable member 18 and inflatable base 12 is held in place by the force exerted on the object by second inflatable member 18 and inflatable base 12. That is, the object is sandwiched between second inflatable member 18 and inflatable base 12. As shown in FIG. 5, the shaft of paddle 2 is shown being held in third storage area 22*c* in storage device 10. The simple and rapid storage option provided by third storage area 22*c* provides the user with the ability to engage in a variety of activities on standup paddleboard 1, including but not limited to, functional fitness exercises involving use of both hands and recreational activities such as fishing, diving, sitting, lying down and other actions where secure storage of hand held paddles would be advantageous to the user.

In some embodiments, for example only, there is no contact between inflatable base 12, first inflatable member 16, and/or second inflatable member 18. Thus inflatable base 12, first inflatable member 16, and second inflatable member 18, by their close proximity to one another, cooperate to form storage areas 22*a*, 22*b*, 22*c*.

Figure 9:
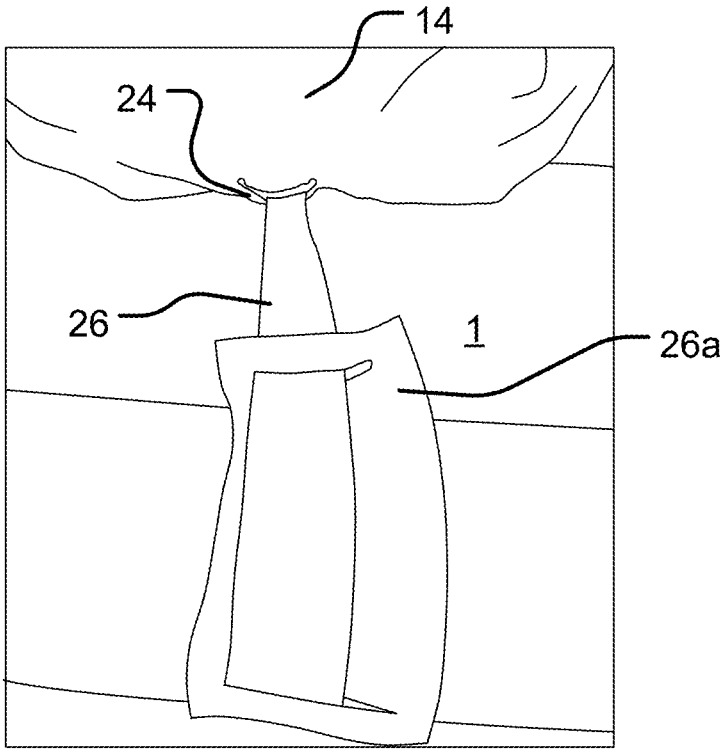
FIG. 9 is an image of the right and bottom side of an inflatable storage device in a deflated state according to the first embodiment of the disclosure.

Now with reference to FIGS. 2A and 7-9, the underside of storage device 10 is shown. Storage device 10 may further include a securing device, such as for example only, securing loop 24 to which straps, hooks, suction cups or the like may engage to retain storage device 10 on paddleboard 1. For example, securing loop 24 is fused, cut into, embedded or otherwise affixed to the underside of base member 14. Securing strap 26 extends through securing loop 24 and around paddleboard 1 to retain storage device 10 to paddleboard 1. As shown in FIGS. 3, 5, and 9, securing strap 26 may include sleeve 26*a* which prevents securing strap 26 from slipping up and off the slick polished glassed material of paddleboard 1. Sleeve 26*a* may comprise a rubber sheet of material with two slits or holes through which securing strap 26 may extend. When in use, sleeve 26*a* is between paddleboard 1 and securing strap 26. Without sleeve 26*a*, the nylon securing strap 26 will too easily move when it is tightened to any smooth surfaced paddleboard. For paddleboards that are inflatable, securing strap 26 may be used without sleeve 26*a* because the material of the paddleboard surface is more coarse and/or soft allowing the pure nylon strap to sink in or gain traction against the surface of the inflatable paddleboard. Although sleeve 26*a* is described as being rubber, it will be understood that sleeve 26*a* may be constructed of other materials and/or include patterns with slip-resistant or anti-slip properties without departing from the scope of the disclosure. In various embodiments, for example only and without limitation, embodiments of sleeve 26*a* may be made from polyvinyl chloride (PVC).

Figure 2A:
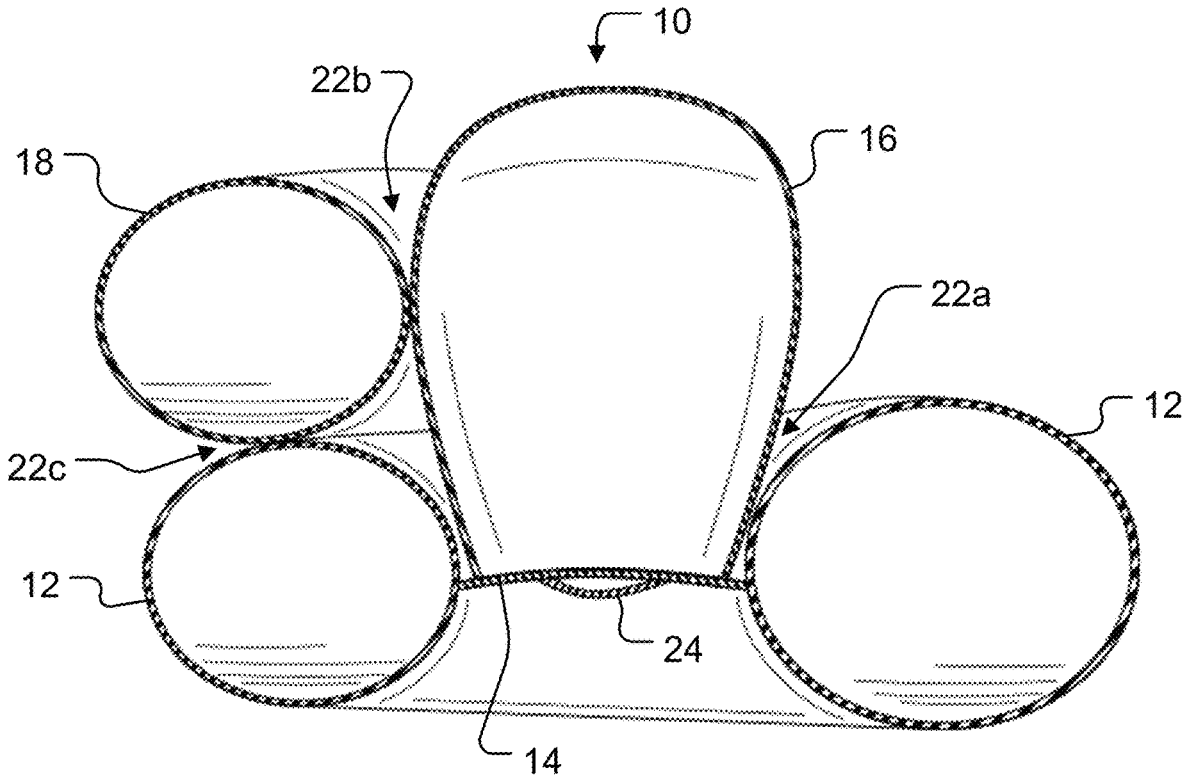
FIG. 2A is a cross-sectional view of an inflatable storage device according to the first embodiment of the disclosure taken along line 2A-2A of FIG. 2.

As shown in FIG. 2A, base member 14 is affixed to inflatable base 12, such that when inflatable base 12 is inflated, base member 14 is not coincident with the bottom of inflatable base 12. That is, base member 14 is raised above the bottom of inflatable base 12. In some embodiments, base member 14 may be affixed to inflatable base 12 such that base member 14 is located at the midpoint between the bottom of inflatable base 12 and the top of inflatable base 12.

Figure 9A:
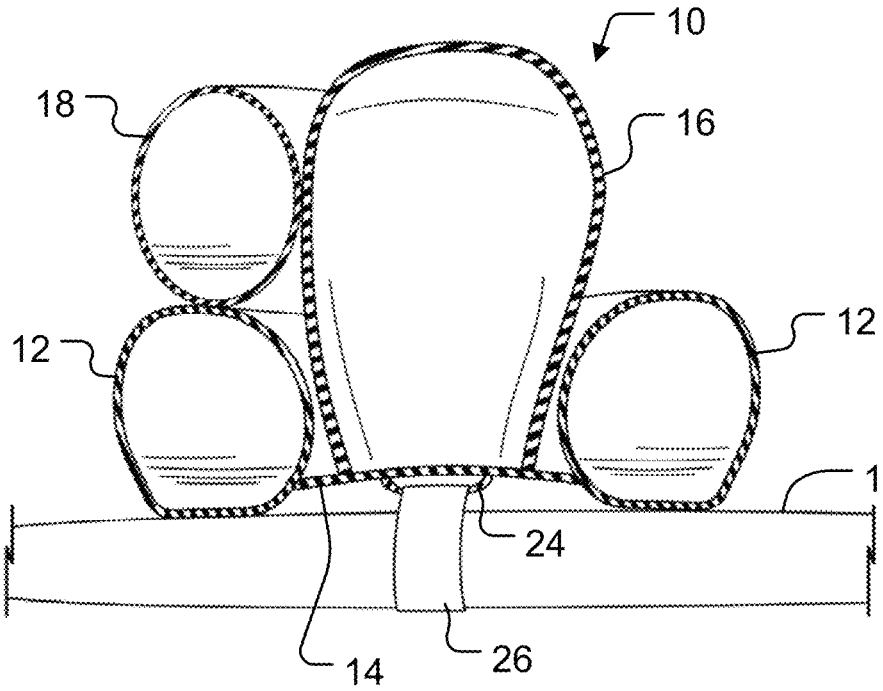
FIG. 9A is similar to FIG. 2A, but is a cross-sectional view of an inflatable storage device in an inflated state and attached to a paddleboard according to the first embodiment of the disclosure.

In other embodiments, for example, base member 14 may be affixed to inflatable base 12 such that base member 14 is located above the midpoint between the bottom of inflatable base 12 and the top of inflatable base 12. For example, when inflated base member 14 may be from about 1 inch (about 2.54 cm) to about 5 inches (about 12.7 cm) above the bottom of inflatable base 12 (e.g., about 1 inch (about 2.54 cm), about 2 inches (about 5.08 cm), about 3 inches (about 7.62 cm), about 4 inches (about 10.16 cm), about 5 inches (about 12.7 cm)). Thus, when inflatable base 12 is inflated, the air pressure inside inflatable base 12 acts to pull or lift the perimeter of base member 14 away from paddleboard 1 which places tension on securing strap 26 extending through securing loop 24, which is tending to pull base member 14 and inflatable base 12 toward paddleboard 1. The counter-acting forces of the air in inflatable base 12 lifting upwards while securing loop 24 is held proximate to a desired attachment surface (e.g., paddleboard 1), using any method of attachment or securing device as described herein or known in the art, place tension on base member 14. This applied tension to base member 14 pulls inflatable base 12 towards the surface to which securing loop 24 is attached, creating a tight, stable connection between storage device 10 and the surface (e.g., paddleboard 1). In effect, as shown in FIG. 9A, the tension in securing loop 24 and base member 14 pulls inflatable base 12 downward onto paddleboard 1, holding storage device 10 tight against paddleboard 1. The bottom portion of inflatable base 12 is thus pulled toward paddleboard, causing the bottom portion of inflatable base 12 to flatten, forming a stable base for storage device 10. By locating base member 14 at or above the midpoint between the bottom of inflatable base 12 and the top of inflatable base 12, storage device 10 is pulled tight against paddleboard 1 that would be difficult to achieve if base member 14 was located proximate the bottom of inflatable base 12.

Figure 7:
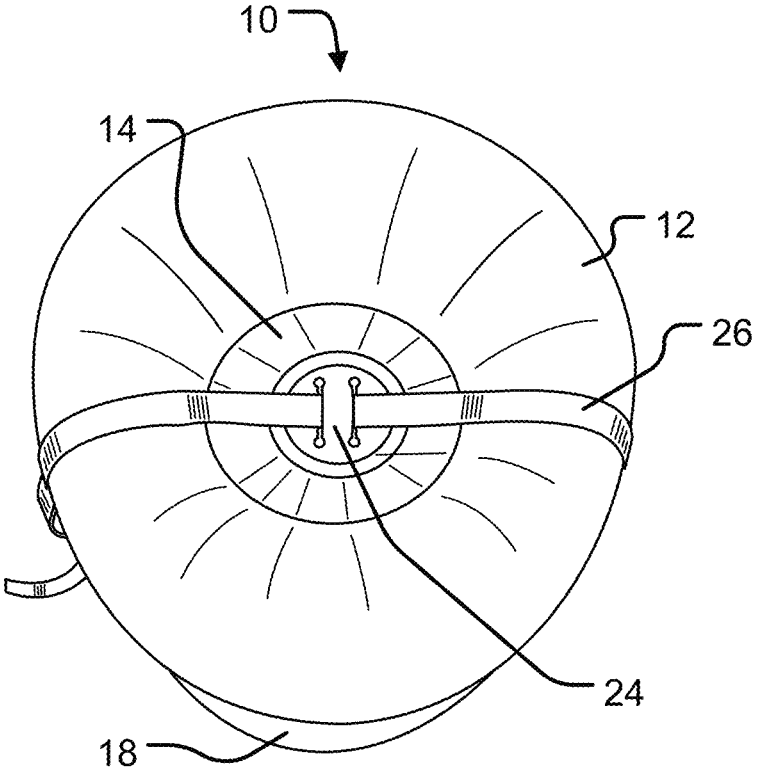
FIG. 7 is a bottom view of an inflatable storage device according to the first embodiment of the disclosure.
Figure 8:
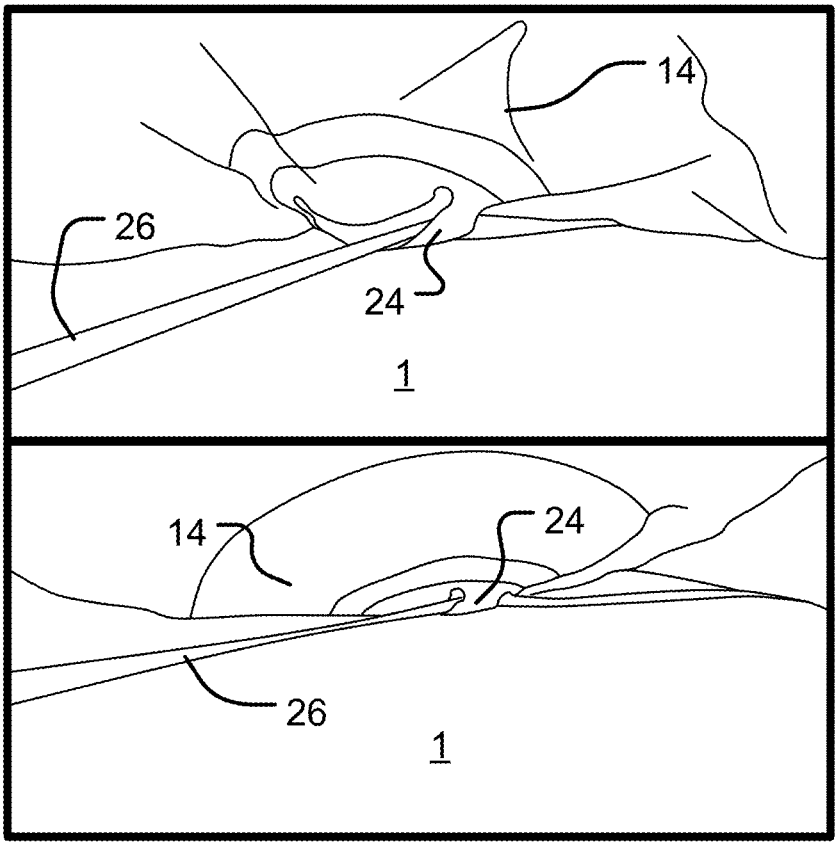
FIG. 8 are images of the bottom side of an inflatable storage device according to the first embodiment of the disclosure.

Additionally, as shown in FIGS. 2A, 7, and 9, securing loop 24 is located proximate the center of base member 14. This ensures that the tension force acting on base member 14 and inflatable base 12 is substantially equal or equal around the circumference of inflatable base 12. That is, because of the central location of securing loop 24, the force acting on inflatable base 12 is the same around inflatable base 12 such that storage device 10 is stable around the circumference of inflatable base 12. As such, storage device 10 is less likely to lean to one side.

It will be understood however, that in other embodiments, for example, base member 14 may be affixed to inflatable base 12 such that base member 14 is located below the midpoint between the bottom of inflatable base 12 and the top of inflatable base 12. In yet other embodiments, for example, base member 14 may be affixed to inflatable base 12 such that base member 14 is located coincident with the bottom of inflatable base 12. Additionally, in other embodiments, for example, securing loop 24 may not be centrally located on base member 14 and/or two or more securing loops 24 may be located on base member 14 in various locations.

Figure 10:
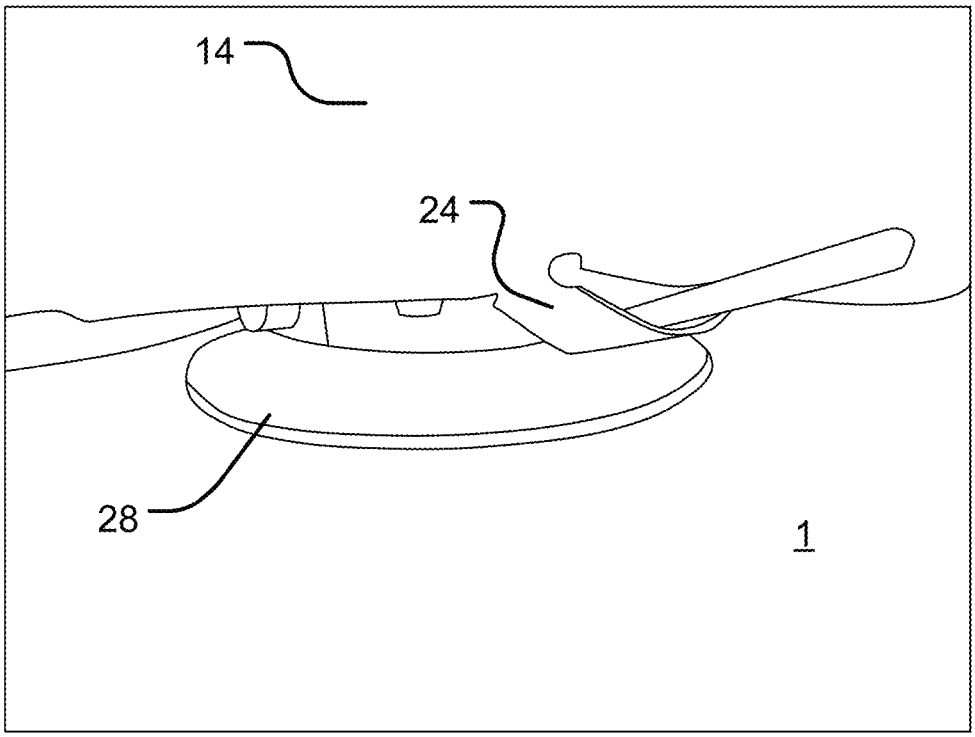
FIG. 10 is an image of the bottom side of an inflatable storage device in a deflated state according to the first embodiment of the disclosure.

Alternatively, as shown in FIG. 10, in various embodiments, for example, a suction cup 28 may be affixed to securing loop 24 such that the suction cup attaches to paddleboard 1 to retain storage device 10 on paddleboard 1. While suction cup 28 is shown as engaging with securing loop 24, it will be understood that in various embodiments, one or more suction cups may be permanently or removably affixed to base member 14 and/or inflatable base 12 such that suction cups can attach to paddleboard 1. That is, in some embodiments, one or more suction cups can be proximate the center of base member 14 and/or one or more suction cups can be located around inflatable base 12 (e.g., four suction cups about every 90 degrees).

Figure 11:
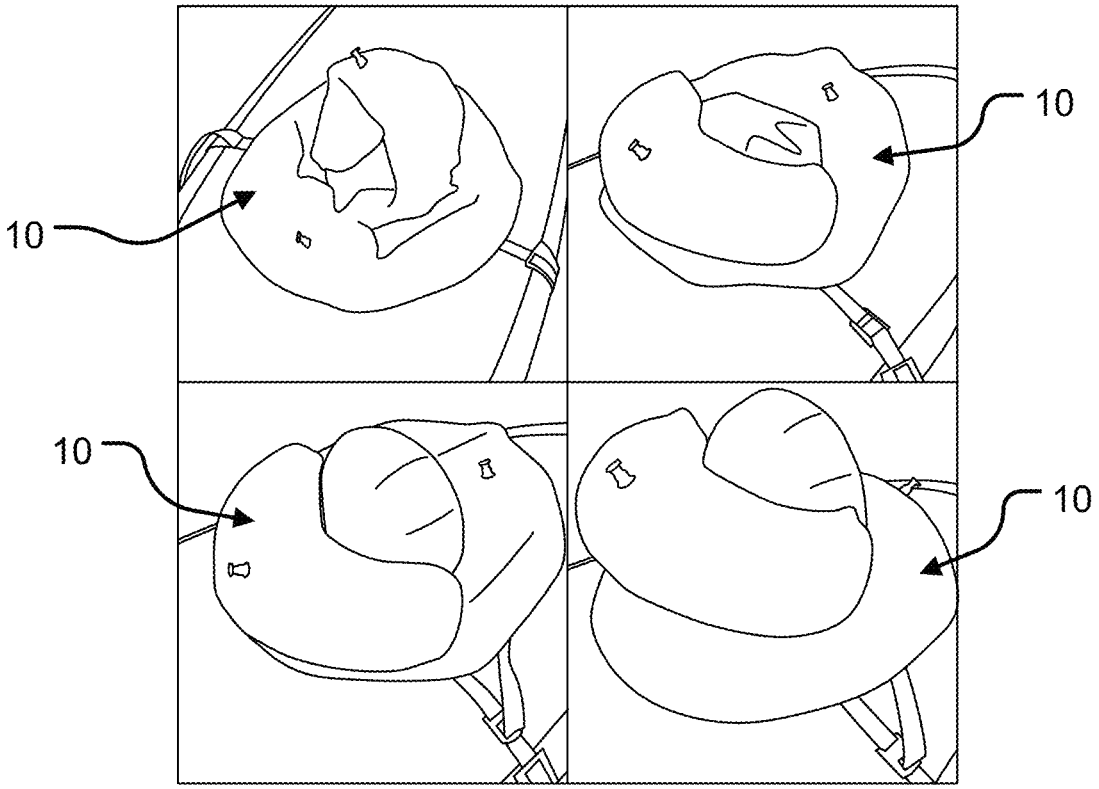
FIG. 11 are images of an inflatable storage device in various states of inflation according to the first embodiment of the disclosure.

Now with reference to FIG. 11, storage device 10 is shown in various states of inflation.

Figure 12:
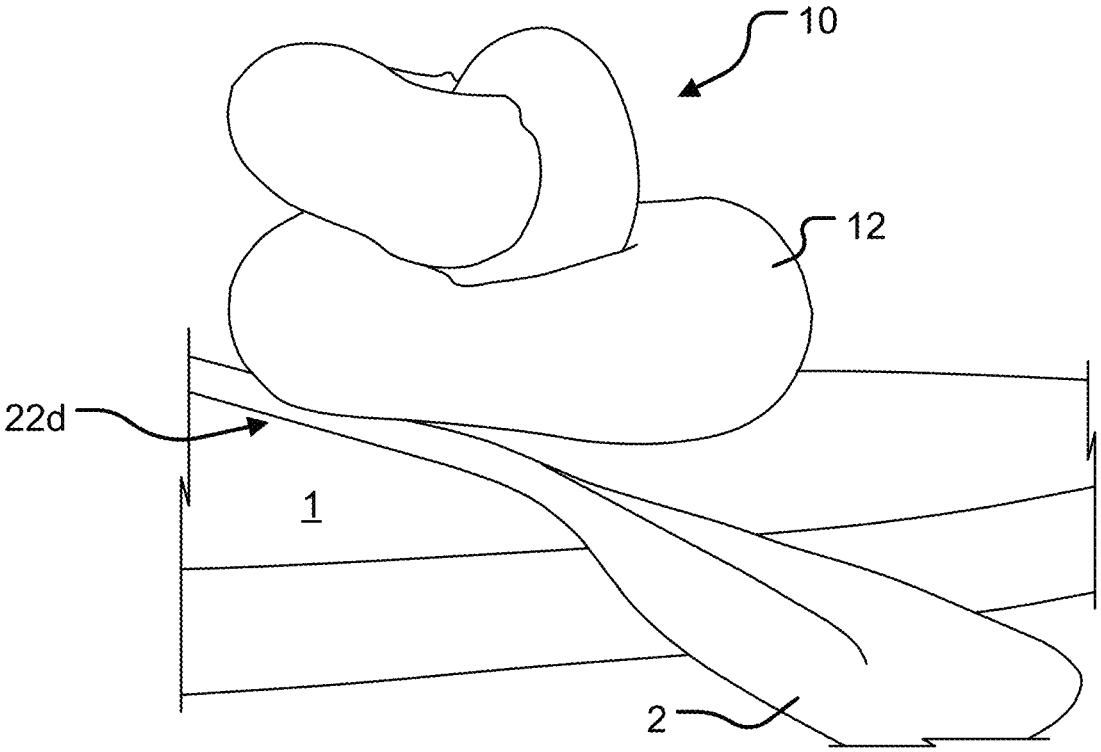
FIG. 12 is an image of the right side of an inflatable storage device according to the first embodiment of the disclosure.
Figure 13:
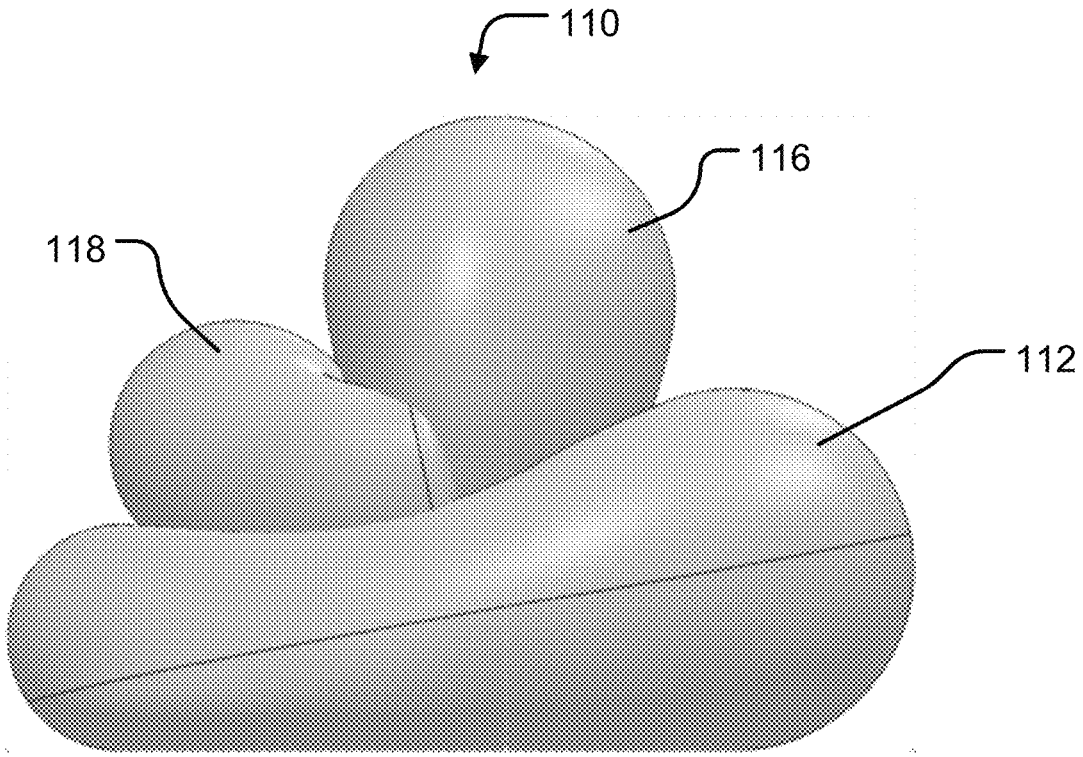
FIG. 13 is a right side view of an inflatable storage device according to a second embodiment of the disclosure.
Figure 14:
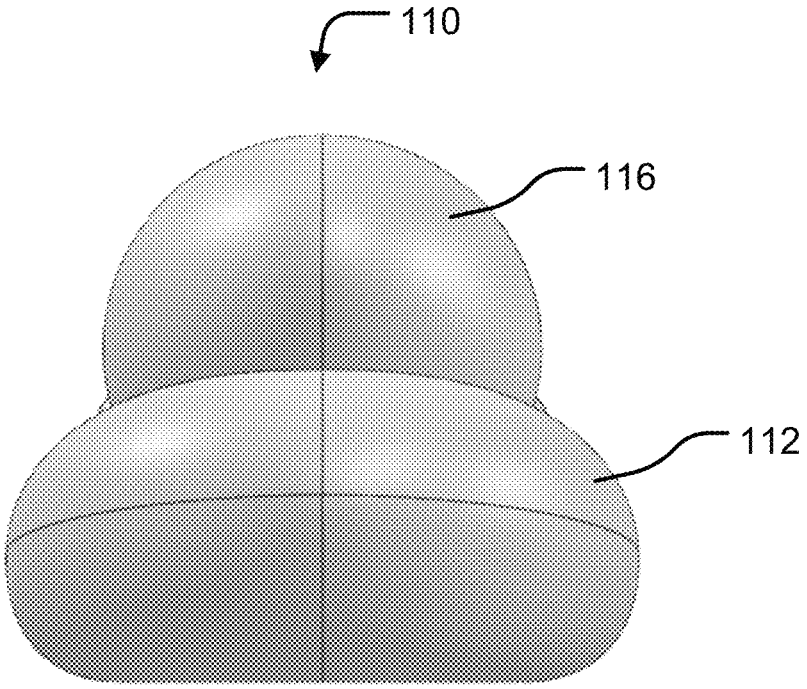
FIG. 14 is a back side view of an inflatable storage device according to the second embodiment of the disclosure.

In addition to storing items in first, second and third storage areas 22*a*, 22*b*, and 22*c* as described above, items may be sandwiched between inflatable base 12 and the structure or object to which storage device 10 is affixed. Therefore, when storage device 10 is affixed to a structure or object and storage device 10 is inflated, a fourth storage area 22*d* is created between storage device 10 and the structure or object (e.g., paddleboard 1). For example only, as shown in FIG. 12, paddle 2 may be held against paddleboard 1 by inflatable base 12 of storage device 10. Thus, paddle 2 may be stored on paddleboard 1 in the fourth storage area 22*d* between storage device 10 and paddleboard 1. It will be understood that any number of objects may be stored in this fourth storage area 22*d* by being sandwiched or wedged between storage device 10 and the structure or object to which it is secured, including but not limited to, paddles, shoes, sandals, wallets, phones, dog leashes, rope, etc.

Another embodiment of a storage device 110 of the disclosure is illustrated in FIGS. 13-19 and is described below. Some features of one or more of storage device 110 and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Storage device 110 includes an inflatable base 112, a base member 114, a first inflatable member 116, and a second inflatable member 118 which cooperate, when inflated, to form a population of storage areas.

Inflatable base 112 is an inflatable tube that is inner-tube or donut shaped. Inflatable base 112 may have a non-constant dimension. That is inflatable base 112 may have a smaller dimension (e.g., diameter) in the front of storage device 110 and may expand to a larger dimension (e.g. diameter) toward the back of storage device 110 (see FIGS. 13 and 17). In other embodiments, for example, inflatable base 112 may have a substantially constant dimension (e.g. diameter) around its entire perimeter. A base member 114 is affixed to the inside perimeter of inflatable base 112. That is, base member 114 serves to close off the "donut hole" in the center of inflatable base 112. Base member 114 may comprise one or more sheets of material that is adhered, buckled, Velcro, snapped and or otherwise fused to inner central perimeter of inflatable base 112. In other embodiments, for example, base member 114 may be integrally formed with inflatable base 112.

Affixed to base member 114 and extending upward and outward from base member 114 is first inflatable member 116. First inflatable member 116 is generally egg or light-bulb shaped with its narrow bottom end affixed to base member 114 and its wider top end extending upward and above the top of inflatable base 112. First inflatable member 116 is adhered or fused to base member 114. However, it will be understood that in other embodiments, first inflatable member 116 may be releasably affixed to base member 114 in a variety of ways, including but not limited to, buckles, straps, hook-and-loop style fasteners (e.g., Velcro®), any combination thereof, or in any manner known in the art.

Affixed to base member 114 and extending upward and outward from base member 114 is also second inflatable member 118. Second inflatable member 118 is generally crescent moon shaped. Second inflatable member 118 is adhered or fused to base member 114. However, it will be understood that in other embodiments, second inflatable member 118 may be releasably affixed to base member 114 in a variety of ways, including but not limited to, buckles, straps, hook-and-loop style fasteners (e.g., Velcro®), any combination thereof, or in any manner known in the art. Therefore, storage device 110 differs from storage device 10 in that second inflatable member 118 is affixed to base member 114 instead of first inflatable member 116.

Inflatable base 112, first inflatable member 116 and second inflatable member 118 may each include an inflation valve 9 as known in the art for inflating inflatable objects. Thus inflatable base 112, first inflatable member 116 and second inflatable member 118 are each independently inflatable. Inflatable base 112, first inflatable member 116 and second inflatable member 118 may be inflated in a variety of ways, including but not limited to, manually by a user blowing air through the inflation valves 9, by a pump blowing air through the inflation valves 9, using compressed air to blow air through the inflation valves 9, etc. In various embodiments inflatable base 112, first inflatable member 116 and second inflatable member 118 may be in fluid communication with one another. That is, air may travel freely between inflatable base 112, first inflatable member 116 and second inflatable member 118. In such embodiments, storage device have a single inflation valve 9 and inflatable base 112, first inflatable member 116 and second inflatable member 118 may all be inflated through that single inflation valve 9. Additionally, inflatable base 112 can exist as its own separate inflatable member while first inflatable member 116 and second inflatable member 118 are in fluid communication with one another. That is, inflatable base 112 has its own inflation valve 9 while first and second inflatable members 116, 118 share a single inflation valve 9. This combination of adjoining members can be applied to any combination of inflatable members herein.

When inflatable base 112 and first inflatable member 116 are inflated, first inflatable member 116 makes contact with and presses up against at least a portion of the inner perimeter of inflatable base 112. Additionally, when inflatable base 112, first inflatable member 116, and second inflatable member 118 are inflated, the inner crescent portion of second inflatable member 118 makes contact with and presses up against at least a portion of first inflatable member 116 and the outer crescent portion of second inflatable member 118 makes contact with and presses up against at least a portion of inflatable base 112.

Figure 18:
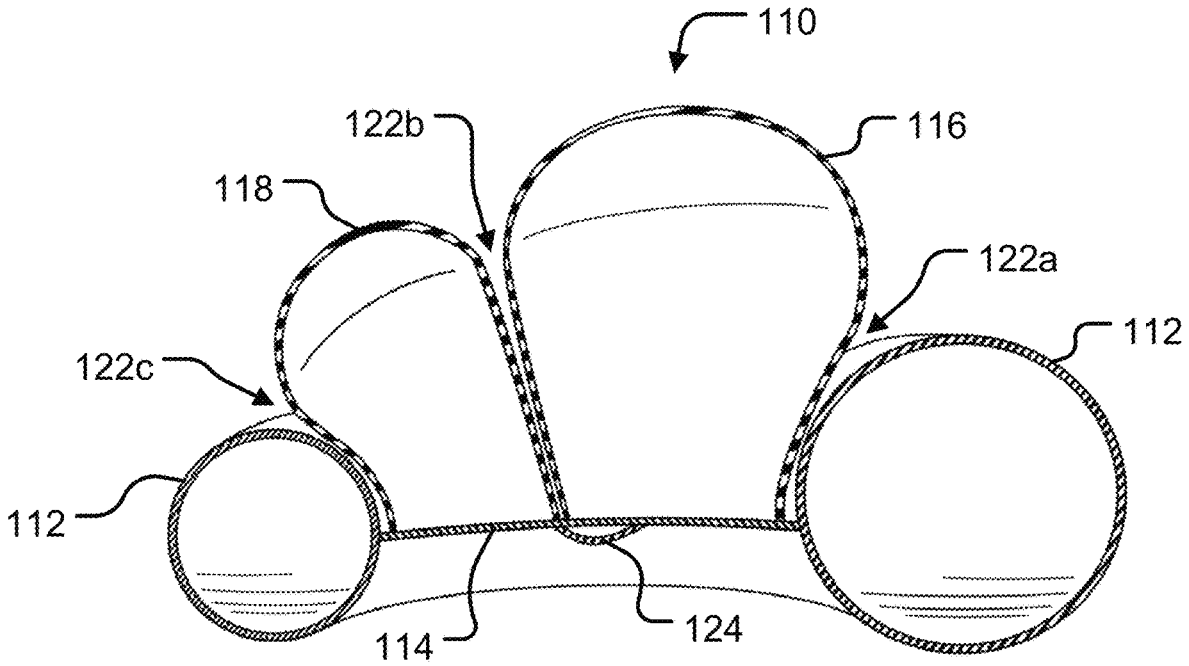
FIG. 18 is a cross-sectional view of an inflatable storage device according to the second embodiment of the disclosure taken along line 17-17 of FIG. 16.

As shown in FIG. 18, the contact between first inflatable member 116 and inflatable base 112 forms a first storage area 122*a* into which objects can be inserted. Because inflatable base 112 and first inflatable member 116 are inflated and press against one another, any object inserted into first storage area 122*a* between inflatable base 112 and first inflatable member 116 is held in place by the force exerted on the object by inflatable base 112 and first inflatable member 116. That is, the object is sandwiched between inflatable base 112 and first inflatable member 116.

Figure 19:
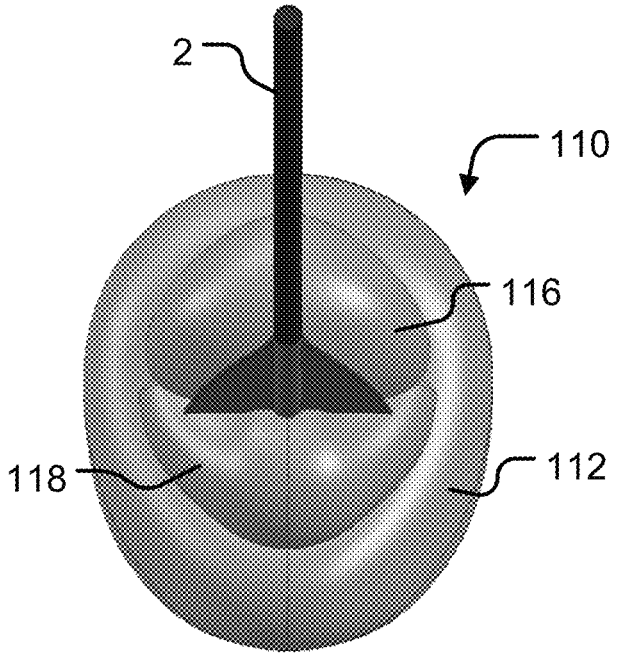
FIG. 19 is a top plan view of an inflatable storage device according to the second embodiment of the disclosure.

Additionally, the contact between first inflatable member 116 and second inflatable member 118 forms a second storage area 122*b* into which objects can be inserted. Because first inflatable member 116 and second inflatable member 118 are inflated and press against one another, any object inserted into second storage area 122*b* between first inflatable member 116 and second inflatable member 118 is held in place by the force exerted on the object by first inflatable member 116 and second inflatable member 118. That is, the object is sandwiched between first inflatable member 116 and second inflatable member 118. As shown in FIG. 19, the tip of a paddle 2 may be inserted into second storage area 122*b* and slid downward until the tip is proximate to or touches base member 114. At least a portion of the blade of paddle 2 is then held in second storage area 122*b*. Because of the force exerted on the tip and blade of paddle 2 by first inflatable member 116 and second inflatable member 118, paddle 2 may be securely retained in a generally vertical orientation in storage device 110.

The simple and rapid storage option provided by second storage area 122*b* provides the user with the ability to engage in a variety of activities on standup paddleboard 1, including but not limited to, functional fitness exercises involving use of both hands and recreational activities such as fishing, diving, sitting, lying down and other actions where secure storage of hand held paddles would be advantageous to the user.

With reference again to FIG. 18, the contact between second inflatable member 118 and inflatable base 112 forms a third storage area 122*c* into which objects can be inserted. Because second inflatable member 118 and inflatable base 112 are inflated and press against one another, any object inserted into third storage area 122*c* between second inflatable member 118 and inflatable base 112 is held in place by the force exerted on the object by second inflatable member 118 and inflatable base 112. That is, the object is sandwiched between second inflatable member 118 and inflatable base 112. The simple and rapid storage option provided by third storage area 122*c* provides the user with the ability to engage in a variety of activities on standup paddleboard 1, including but not limited to, functional fitness exercises involving use of both hands and recreational activities such as fishing, diving, sitting, lying down and other actions where secure storage of hand held paddles would be advantageous to the user.

In some embodiments, for example only, there is no contact between inflatable base 112, first inflatable member 116, and/or second inflatable member 118. Thus inflatable base 112, first inflatable member 116, and second inflatable member 118, by their close proximity to one another, cooperate to form storage areas 122*a*, 122*b*, 122*c*.

With continued reference to FIG. 18, as with storage device 10, the underside of storage device 110 is shown. Storage device 110 may further include a securing device, such as for example only, securing loop 124 to which straps, hooks, suction cups or the like may engage to retain storage device 110 on paddleboard 1.

Base member 114 is affixed to inflatable base 112, such that when inflatable base 112 is inflated, base member 114 is not coincident with the bottom of inflatable base 112. That is, base member 114 is raised above the bottom of inflatable base 112. In some embodiments, base member 114 may be affixed to inflatable base 112 such that base member 114 is located at the midpoint between the bottom of inflatable base 112 and the top of inflatable base 112. In other embodiments, for example, base member 114 may be affixed to inflatable base 112 such that base member 114 is located above the midpoint between the bottom of inflatable base 112 and the top of inflatable base 112. For example, when inflated base member 114 may be from about 1 inch (about 2.54 cm) to about 5 inches (about 12.7 cm) above the bottom of inflatable base 112 (e.g., about 1 inch (about 2.54 cm), about 2 inches (about 5.08 cm), about 3 inches (about 7.62 cm), about 4 inches (about 10.16 cm), about 5 inches (about 12.7 cm)). Thus, when inflatable base 112 is inflated, the air pressure inside inflatable base 112 acts to pull or lift the perimeter of base member 114 away from paddleboard 1 which places tension on securing strap 26 extending through securing loop 124, which is tending to pull base member 114 and inflatable base 112 toward paddleboard 1. The counter-acting forces of the air in inflatable base 112 lifting upwards while securing loop 124 is held proximate to a desired attachment surface (e.g., paddleboard 1), using any method of attachment or securing device as described herein or known in the art, place tension on base member 114. This applied tension to base member 114 pulls inflatable base 112 towards the surface to which securing loop 124 is attached, creating a tight, stable connection between storage device 110 and the surface (e.g., paddleboard 1). In effect, the tension in securing loop 124 and base member 114 pulls inflatable base 112 downward onto paddleboard 1, holding storage device 110 tight against paddleboard 1. The bottom portion of inflatable base 112 is thus pulled toward paddle-board, causing the bottom portion of inflatable base 112 to flatten, forming a stable base for storage device 110. By locating base member 114 at or above the midpoint between the bottom of inflatable base 112 and the top of inflatable base 112, storage device 110 is pulled tight against paddle-board 1 that would be difficult to achieve if base member 114 was located proximate the bottom of inflatable base 112.

Figure 15:
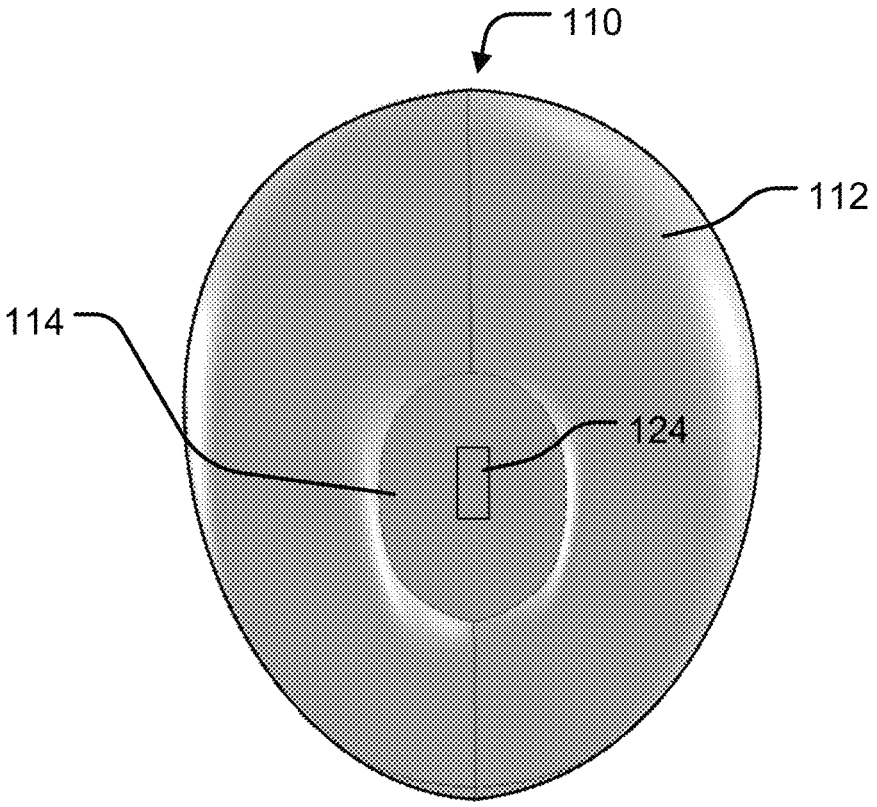
FIG. 15 is a bottom view of an inflatable storage device according to the second embodiment of the disclosure.
Figure 16:
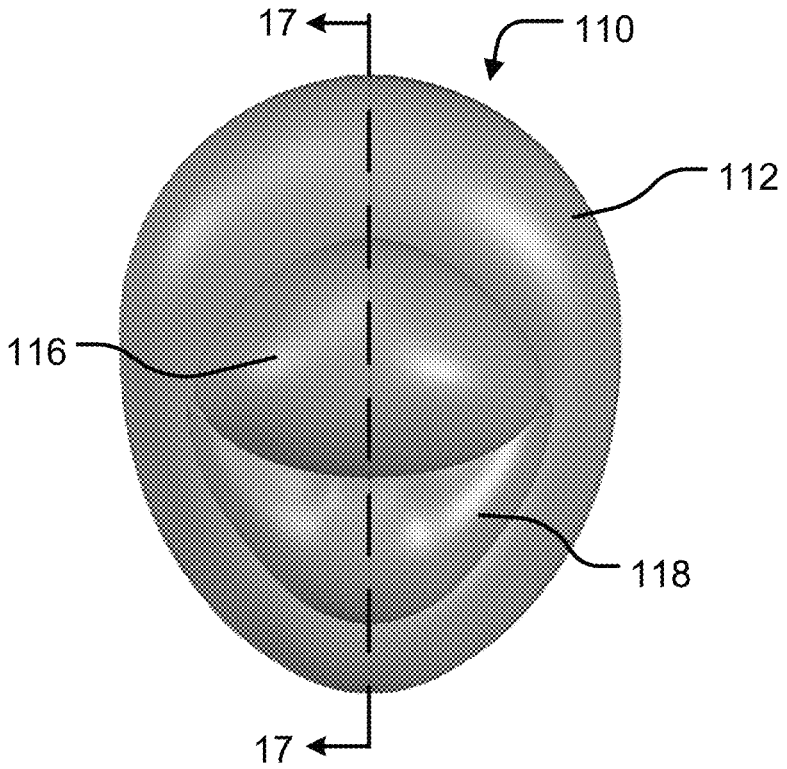
FIG. 16 is a top plan view of an inflatable storage device according to the second embodiment of the disclosure.
Figure 17:
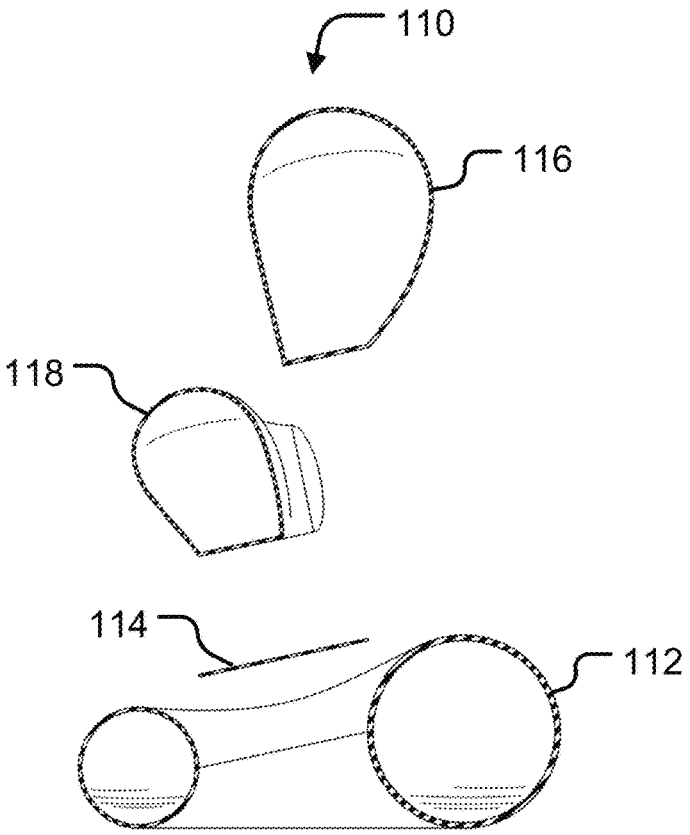
FIG. 17 is an exploded cross-sectional view of an inflatable storage device according to the second embodiment of the disclosure taken along line 17-17 of FIG. 16.

Additionally, as shown in FIGS. 15 and 18, securing loop 124 is located proximate the center of base member 114. This ensures that the tension force acting on base member 114 and inflatable base 112 is substantially equal or equal around the circumference of inflatable base 112. That is, because of the central location of securing loop 124, the force acting on inflatable base 112 is the same around inflatable base 112 such that storage device 110 is stable around the circumference of inflatable base. As such, storage device 110 is less likely to lean to one side or lift off one side.

It will be understood however, that in other embodiments, for example, base member 114 may be affixed to inflatable base 112 such that base member 114 is located below the midpoint between the bottom of inflatable base 112 and the top of inflatable base. In yet other embodiments, for example, base member 114 may be affixed to inflatable base 112 such that base member 114 is located coincident with the bottom of inflatable base 112. Additionally, in other embodi-ments, for example, securing loop 124 may not be centrally located on base member 114 and/or two or more securing loops 124 may be located on base member 114 in various locations.

Another embodiment of a storage device 210 of the disclosure is illustrated in FIGS. 20-33 and is described below. Some features of one or more of storage devices 210, 110 and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Figure 20:
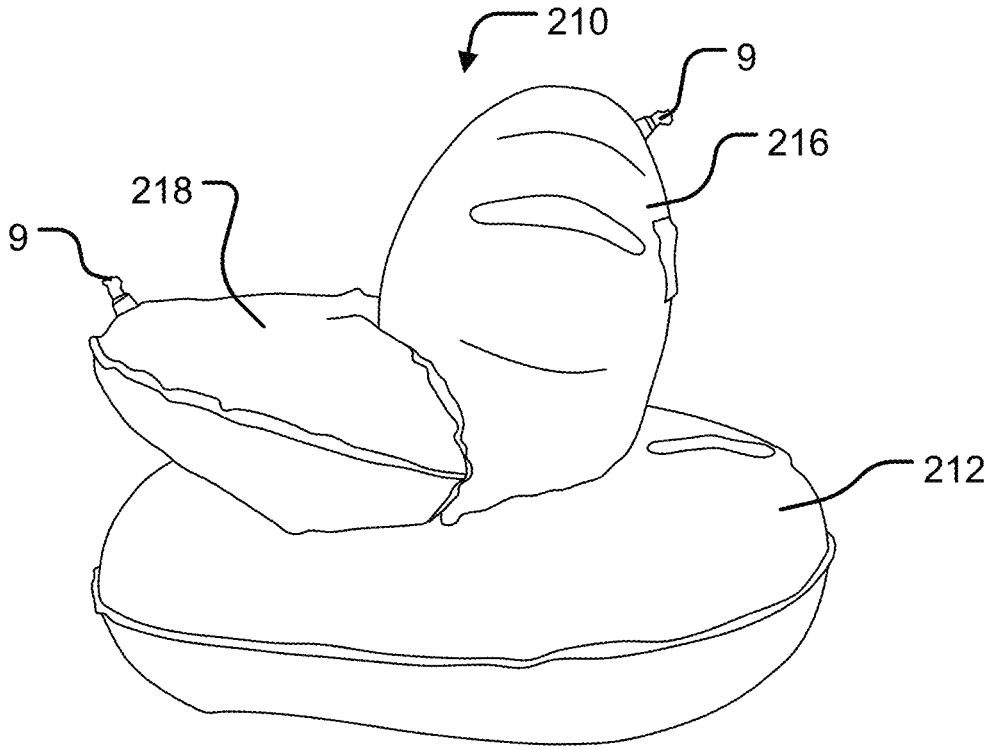
FIG. 20 is an image of the right side of an inflatable storage device according to a third embodiment of the disclosure.
Figure 21:
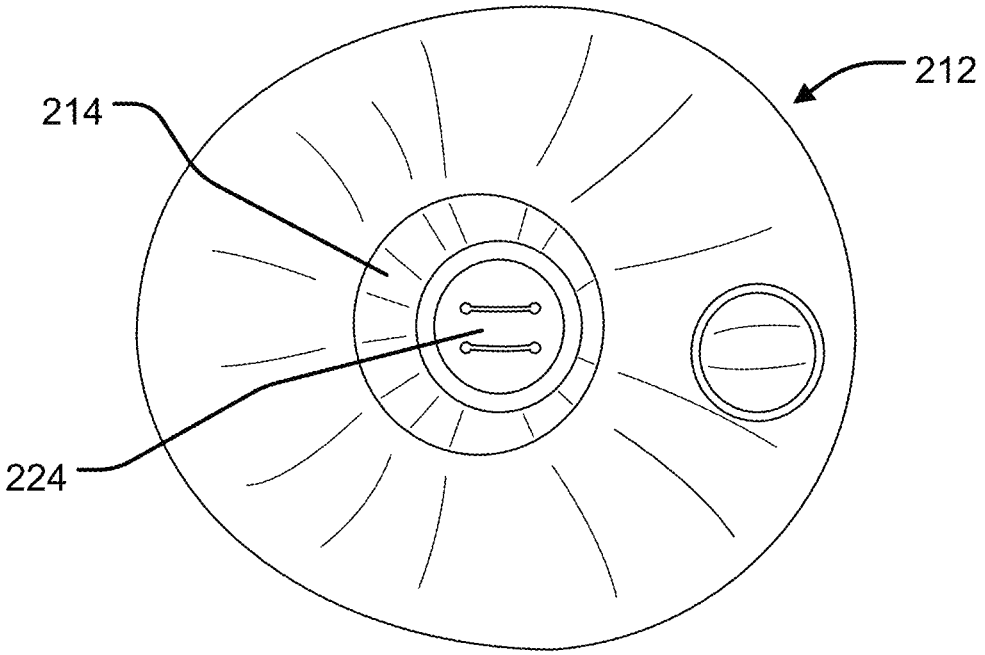
FIG. 21 is a bottom view of an inflatable storage device according to the third embodiment of the disclosure.

As shown in FIGS. 20 and 21, storage device 210 includes an inflatable base 212, a base member 214, a first inflatable member 216, and a second inflatable member 218 which cooperate, when inflated, to form a population of storage areas.

Figure 22:
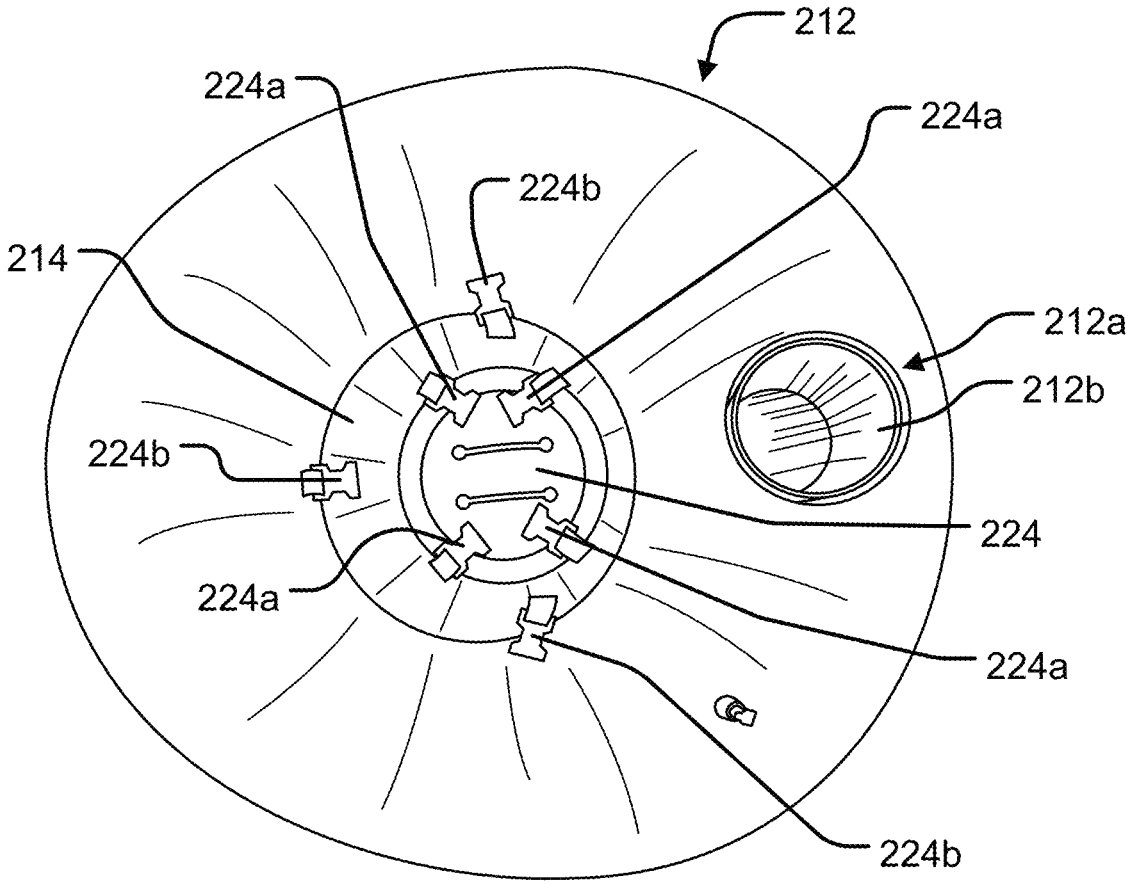
FIG. 22 is a top plan view of an inflatable base according to the third embodiment of the disclosure.

Inflatable base 212 is an inflatable tube that is inner-tube or donut shaped. Inflatable base 212 may have a substan-tially constant dimension (e.g. diameter) around its entire perimeter. In other embodiments, for example, inflatable base 212 may have a non-constant dimension. That is inflatable base 212 may have a smaller dimension (e.g., diameter) in the front of storage device 210 and may expand to a larger dimension (e.g. diameter) toward the back of storage device 210. As shown in FIG. 22, inflatable base 212 may include a cup holder 212*a*. Cup holder 212*a* may include a hard plastic sleeve 212*b* therein, which allows for sharp or jagged objects such as small anchors to be stored therein without damaging the walls of cup holder 212*a*. In various embodiments, hard plastic sleeve 212*b* may be integrally formed with inflatable base 212, while in other embodiments hard plastic sleeve 212*b* may be removably inserted into cup holder 212*a*.

Inflatable base 212 further includes a base member 214 which is affixed to the inside perimeter of inflatable base 212. That is, base member 214 serves to close off the "donut hole" in the center of inflatable base 212. Base member 214 may comprise a single sheet of material that is adhered or fused to inflatable base 212. A securing device, such as for example only, securing loop 224 is integrally formed in base member 214. Securing loop 224 is formed by cutting two openings into base member 214.

With continued reference to FIG. 22, inflatable base 212 further includes four buckles 224*a* affixed to base member 214 using straps fused to base member 214. Buckles 224*a* are generally located around securing loop 224, with secur-ing loop 224 centered between buckles 224*a*. As will be described in greater detail below, buckles 224*a* are used to connect first inflatable member 216 to inflatable base 212. Additionally, three buckles 224*b* are affixed to base member 214 using straps fused to base member 214. Buckles 224*b* are generally located proximate the perimeter of base mem-ber 214, with two buckles 224*b* located on the left and right sides of base member 214 (shown top and bottom in FIG. 22) and one buckle 224*b* located on the back side of base member 214 (shown on left in FIG. 22). As will be described in greater detail below, buckles 224*b* are used to connect second inflatable member 218 to inflatable base 212.

Figure 23:
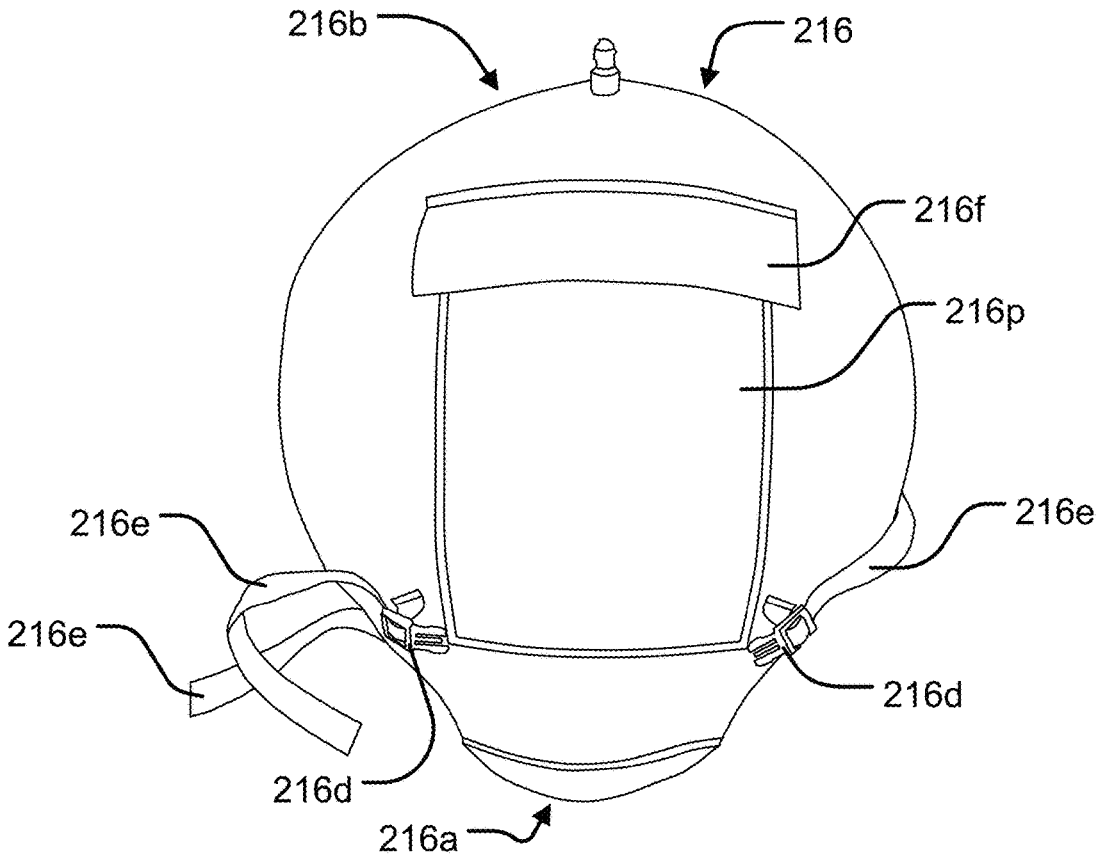
FIG. 23 is a back side view of a first inflatable member according to the third embodiment of the disclosure.
Figure 24:
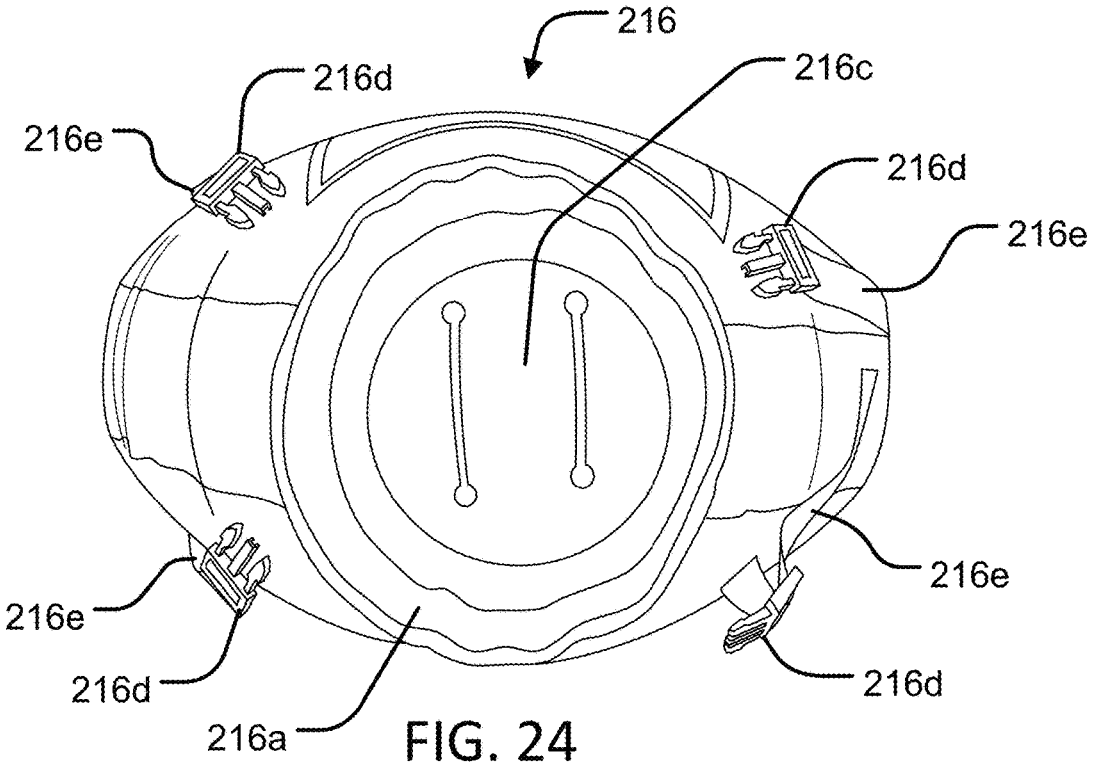
FIG. 24 is a bottom view of a first inflatable member according to the third embodiment of the disclosure.

Now with reference to FIGS. 23 and 24, first inflatable member 216 of storage device 210 will be described in detail. First inflatable member 216 is generally egg or light-bulb shaped having a narrow bottom end 216*a* and a wider top end 216*b*. A first inflatable member securing loop 216*c* is affixed to bottom end 216*a*. Additionally, four buckles 216*d* are affixed to first inflatable member 216 using straps 216*e* fused to first inflatable member 216. As shown in FIG. 23, buckles 216*d* are generally located proximate narrow bottom end 216*a*. When a user desires to connect first inflatable member 216 to inflatable base, the user connects buckles 216*d* with buckles 224*a* of inflatable base 212. As shown, buckles 216*d* are male side release buckles that insert into and lock with buckles 224*a* which are female side release buckles. While buckles 224*a* and 216*d* are shown as plastic side release buckles, it will be understood that other types and materials of buckles may be used without departing from the scope of the present disclosure.

The straps 216*e* to which buckles 216*d* are secured may be tightened to stabilize first inflatable member 216 on inflatable base 212. That is, tightening the straps restricts movement of first inflatable member 216 with respect to inflatable base 212. This may aid in retaining objects in storage device 210. Additionally, when in use, first inflatable member 216 may also be attached to base member 214 by extending a securing strap through both securing loop 216*c* of first inflatable member 216 and securing loop 224 of base member 214. The securing strap is then used to secure storage device 210 to an object, such as a paddle board. Extending a securing strap through both securing loop 216*c* of first inflatable member 216 and securing loop 224 of base member 214 provides greater stability of storage device 210 as a whole as well as tighter interaction between inflatable base 212 and first inflatable member 216 which increases the interactive ability of storage areas, slots, crevices existing within and between inflatable base 212, first inflatable member 216 and second inflatable member 218.

Figure 25:
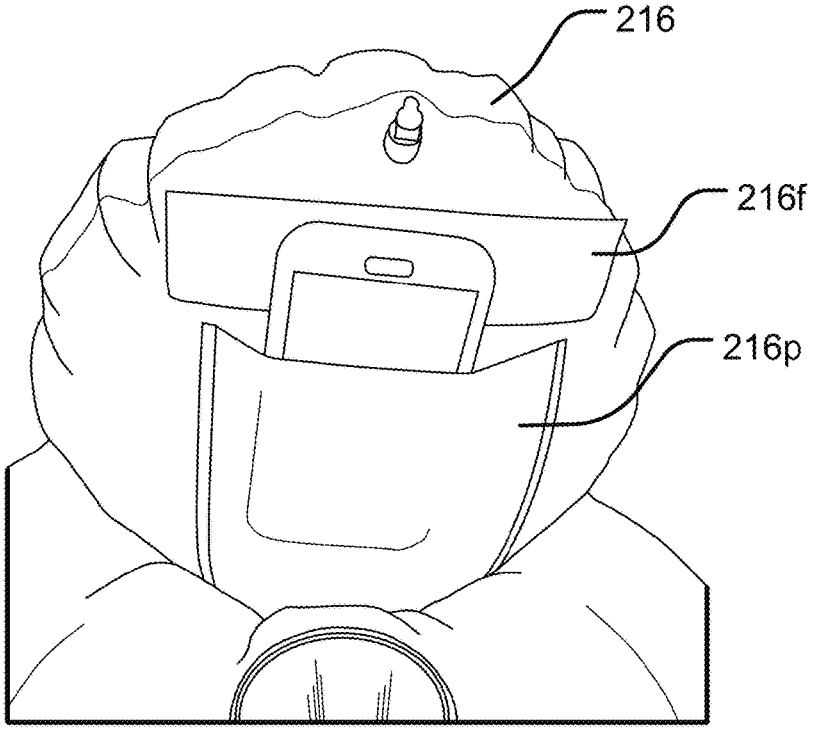
FIG. 25 is a back side view of a first inflatable member according to the third embodiment of the disclosure.

Additionally, as shown in FIGS. 23 and 25, various embodiments of first inflatable member 216 may further include a pocket 216*p* which may be used to store various items, such as for example, a phone, wallet, keys, etc. In various embodiments, pocket 216*p* may be molded into first inflatable member 216 such that pocket 216*p* extends into the interior of first inflatable member 216. In other embodiments, pocket 216*p* may be made by affixing or fusing a sheet to the exterior of first inflatable member 216, wherein three sides are fused to first inflatable member 216, leaving the fourth top side of the sheet unfused. It is desired to include a flap 216*f*, which may be used to close pocket 216*p*. Flap 216*f* may be used to make pocket 216*p* splashproof or waterproof. In various embodiments, a waterproof pocket (not shown) may be included in one or more of the inflatable members (e.g., inflatable base 212, first inflatable member 216, second inflatable member 218). The waterproof pocket may be a pocket within the inflatable member, wherein the bottom of the waterproof pocket is fused to the inner wall(s) of the inflatable member within which it is affixed. Fusing or welding the waterproof pocket to the inner wall surface prevents the pocket from being expelled out of the inflatable member when inflated or during inflation. The pocket opening may be sealed by one or more (e.g., one, two, three, or more) press-to-seal sealing devices (e.g., a Ziploc® seal). When the one or more press-to-seal sealing devices are pushed and closed and folded up, a flap with a hook-and-loop style fastener (e.g., Velcro®) may be used to cover the entire pocket entrance side and press-to-seal sealing devices. The press-to-seal sealing devices ensures that pocket is waterproof and the flap provides an aesthetically streamlined pocket which is hidden from immediate view. Thus, a user may discretely store items in the internal waterproof pocket.

Figure 26:
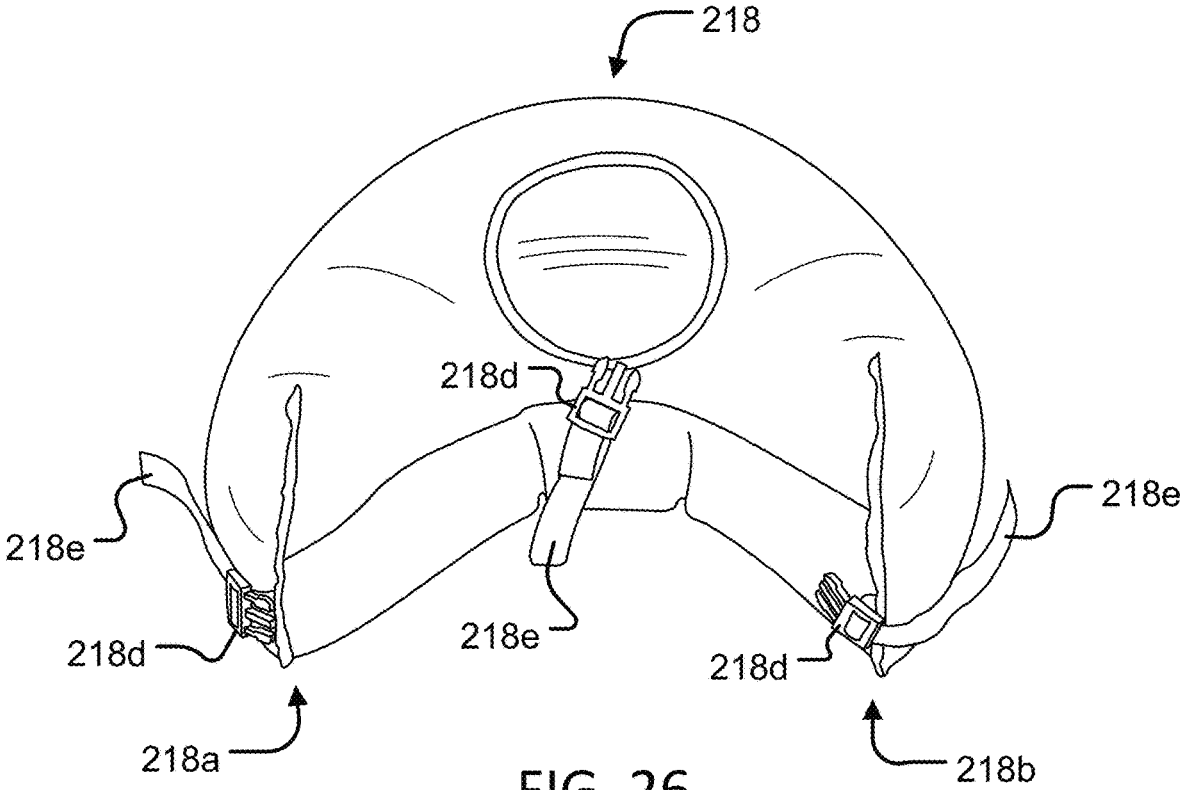
FIG. 26 is a bottom view of a second inflatable member according to the third embodiment of the disclosure.

Now with reference to FIGS. 26 and 27, second inflatable member 218 of storage device 210 will be described in detail. As shown in FIG. 26, second inflatable member 218 is generally crescent moon shaped and includes first and second ends 218*a*, 218*b*. Two buckles 218*d* are affixed to the bottom side of second inflatable member 218 using straps 218*e* fused proximate first and second ends 218*a*, 218*b*. A third buckle 218*d* is also affixed to second inflatable member 218 using a strap 218*e* fused proximate the mid-point of the inner crescent portion of second inflatable member 218. When a user desires to connect second inflatable member 218 to inflatable base, the user connects buckles 218*d* with buckles 224*b* of inflatable base 212 (see FIG. 22). As shown, buckles 218*d* are male side release buckles that insert into and lock with buckles 224*b* which are female side release buckles. While buckles 224*b* and 218*d* are shown as plastic side release buckles, it will be understood that other types and materials of buckles may be used without departing from the scope of the present disclosure. When second inflatable member 218 is affixed to inflatable base 212, it is oriented generally parallel to inflatable base 212. The straps 218*e* to which buckles 218*d* are secured may be tightened to stabilize second inflatable member 218 on inflatable base 212. That is, tightening the straps restricts movement of second inflatable member 218 with respect to inflatable base 212. This may aid in retaining objects in storage device 210.

Figure 27:
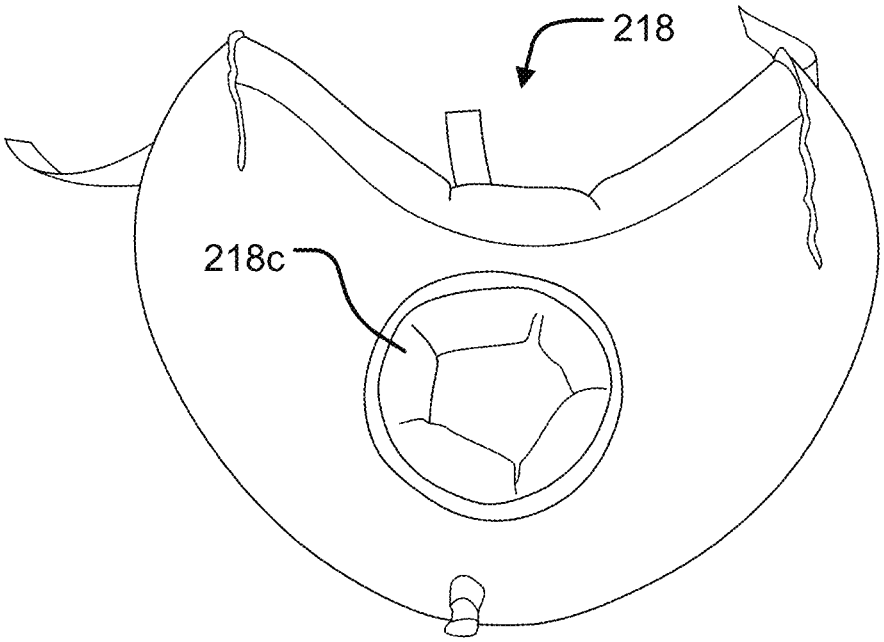
FIG. 27 is an image of the top side of a second inflatable member according to the third embodiment of the invention.

Additionally, as shown in FIG. 27, the top side of second inflatable member 218 may include a cup holder 218*c*. As shown, cup holder 218*c* is made from the same material as second inflatable member 218 and, when inflated, the inner walls of cup holder 218*c* expand inward. This allows cup holder 218*c* to securely hold a wide variety of cups, bottles or the like. It will also be understood that, in various embodiments, for example, cup holder 218*c* may also include a hard plastic sleeve much like the cup holder 212*a* of inflatable base 212.

Inflatable base 212, first inflatable member 216 and second inflatable member 218 may each include an inflation valve 9 as known in the art for inflating inflatable objects. Thus inflatable base 212, first inflatable member 216 and second inflatable member 218 are each independently inflatable. Inflatable base 212, first inflatable member 216 and second inflatable member 218 may be inflated in a variety of ways, including but not limited to, manually by a user blowing air through the inflation valves 9, by a pump blowing air through the inflation valves 9, using compressed air to blow air through the inflation valves 9, etc.

Figure 28:
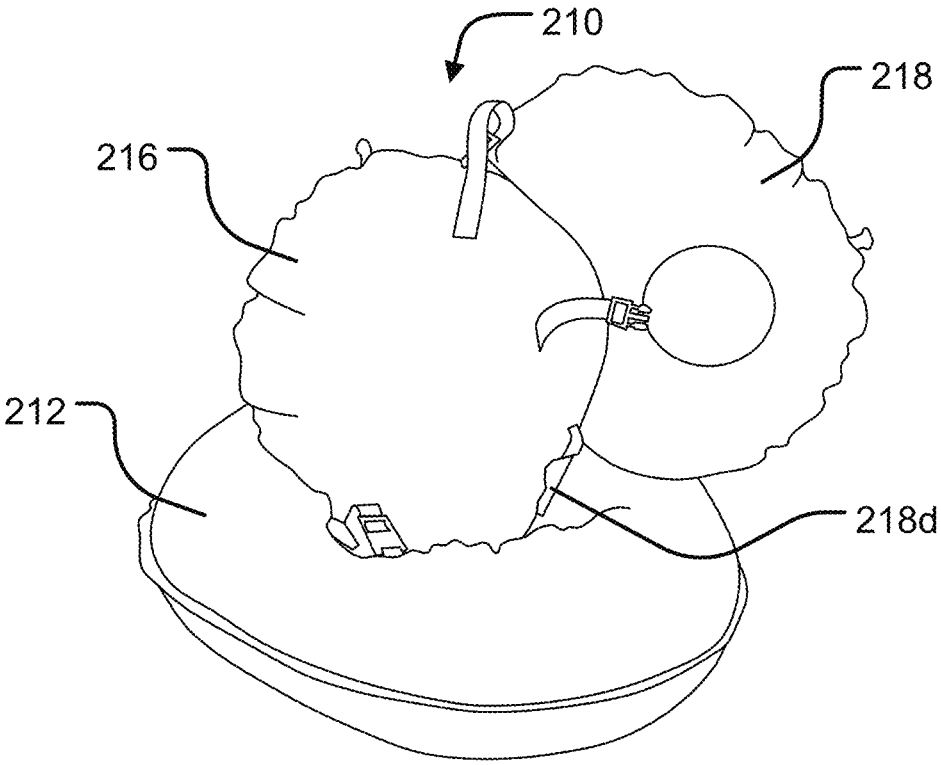
FIG. 28 is an image of the front side angle view of a partially assembled storage device according to the third embodiment of the disclosure.

As shown in FIG. 28, storage device 210 is shown partially assembled. First inflatable member 216 is buckled to inflatable base 212 and second inflatable member 218 is buckled with one buckle 218*d* to inflatable base 212.

Now with reference to FIGS. 29 through 33, additional features of storage device 210 are described in detail. When inflatable base 212 and first inflatable member 216 are inflated, first inflatable member 216 makes contact with and presses up against at least a portion of the inner perimeter of inflatable base 212. Additionally, when inflatable base 212, first inflatable member 216, and second inflatable member 218 are inflated, the inner crescent portion of second inflatable member 218 makes contact with and presses up against at least a portion of first inflatable member 216 and the bottom side of second inflatable member 218 makes contact with and presses up against at least a portion of inflatable base 212.

Figure 29:
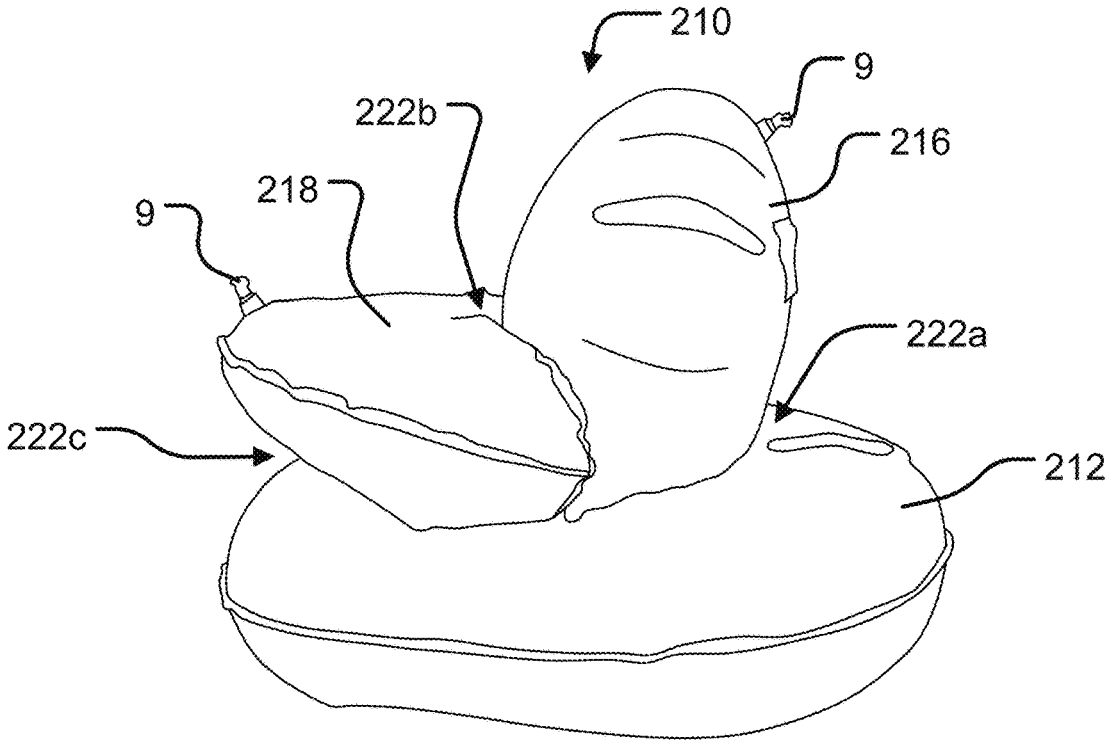
FIG. 29 is an image of the right side of an inflatable storage device according to a third embodiment of the disclosure.
Figure 32:
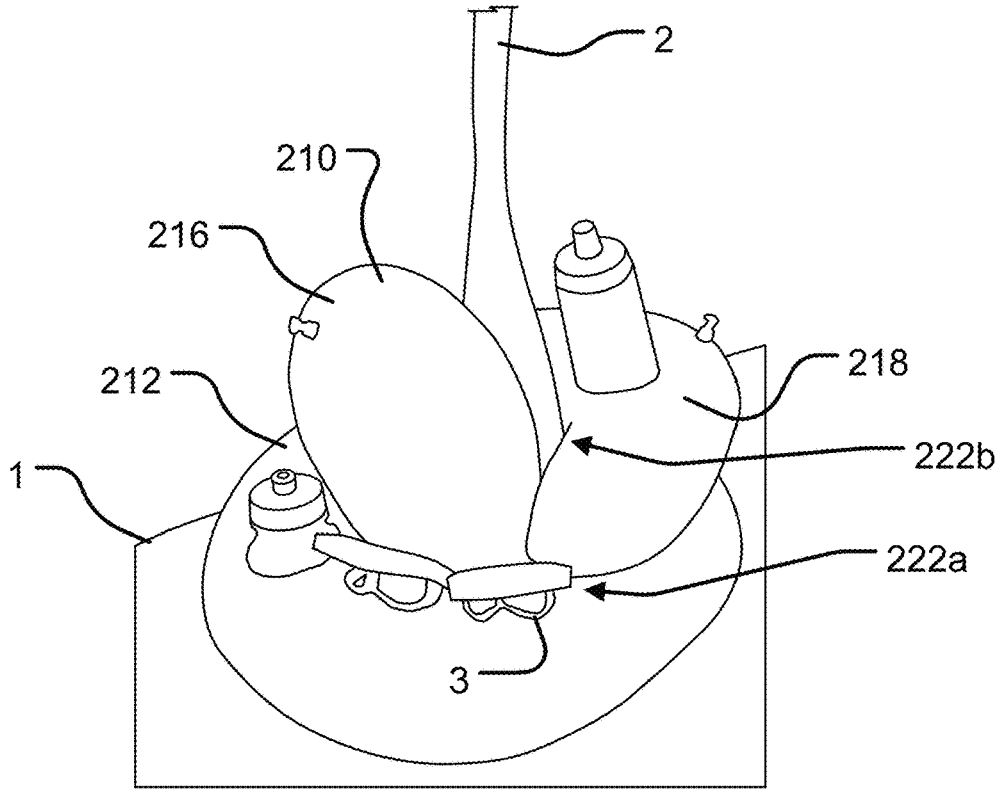
FIG. 32 is an image of the back side angle of an inflatable storage device according to a third embodiment of the disclosure.

In various embodiments, first inflatable member 216 and inflatable base 212 are in contact with each other around the entire inner perimeter of inflatable base 212. As shown in FIG. 29, the contact between first inflatable member 216 and inflatable base 212 forms a first storage area 222*a* into which objects can be inserted. In various embodiments, first storage area 222*a* extends around the entire inner perimeter of inflatable base 212. Because inflatable base 212 and first inflatable member 216 are inflated and press against one another, any object inserted into first storage area 222*a* between inflatable base 212 and first inflatable member 216 is held in place by the force exerted on the object by inflatable base 212 and first inflatable member 216. That is, the object is sandwiched between inflatable base 212 and first inflatable member 216. As shown in FIG. 32, objects such as, for example only and without limitation, sandals 3 may be inserted into and stored in first storage area 222*a*.

Figure 30:
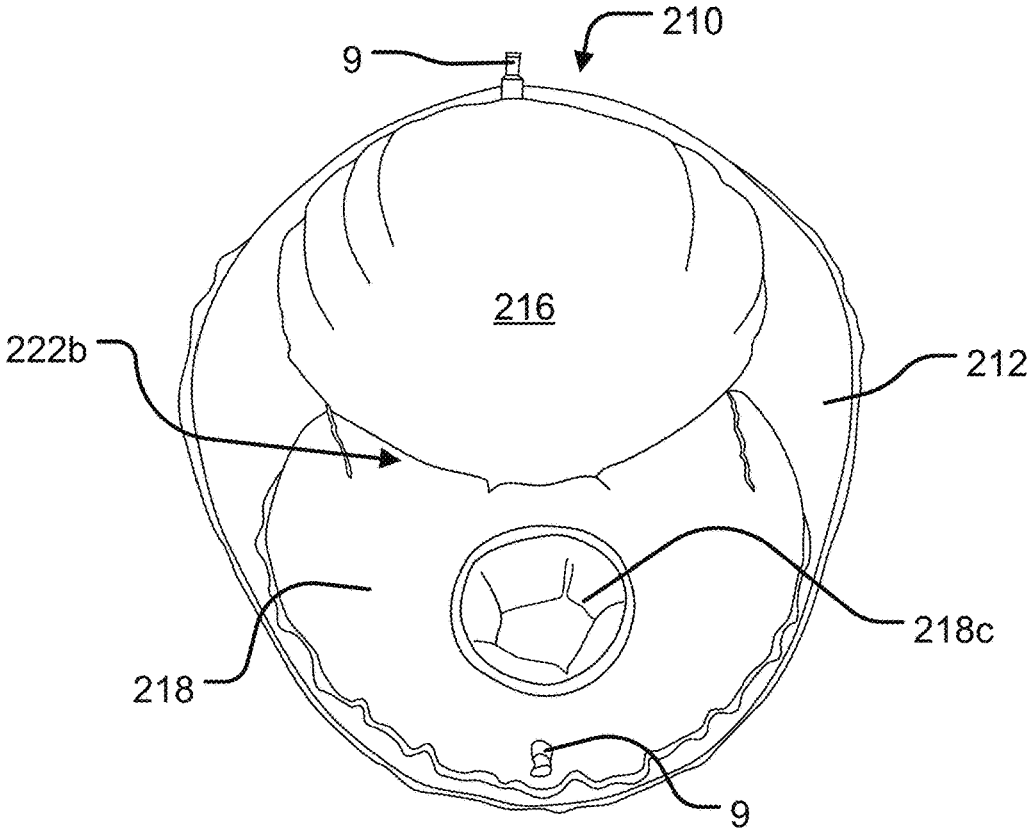
FIG. 30 is an image of the top of a storage device according to the third embodiment of the disclosure.

Additionally, as shown in FIGS. 29 and 30, the contact between first inflatable member 216 and second inflatable member 218 forms a second storage area 222*b* into which objects can be inserted. Because first inflatable member 216 and second inflatable member 218 are inflated and press against one another, any object inserted into second storage area 222*b* between first inflatable member 216 and second inflatable member 218 is held in place by the force exerted on the object by first inflatable member 216 and second inflatable member 218. That is, the object is sandwiched between first inflatable member 216 and second inflatable member 218. As shown in FIG. 32, objects such as, for example only and without limitation, paddle 2 may be inserted into and stored in second storage area 222*b*.

The simple and rapid storage option provided by second storage area 222*b* provides the user with the ability to engage in a variety of activities on standup paddleboard 1, including but not limited to, functional fitness exercises involving use of both hands and recreational activities such as fishing, diving, sitting, lying down and other actions where secure storage of hand held paddles would be advantageous to the user.

Figure 31:
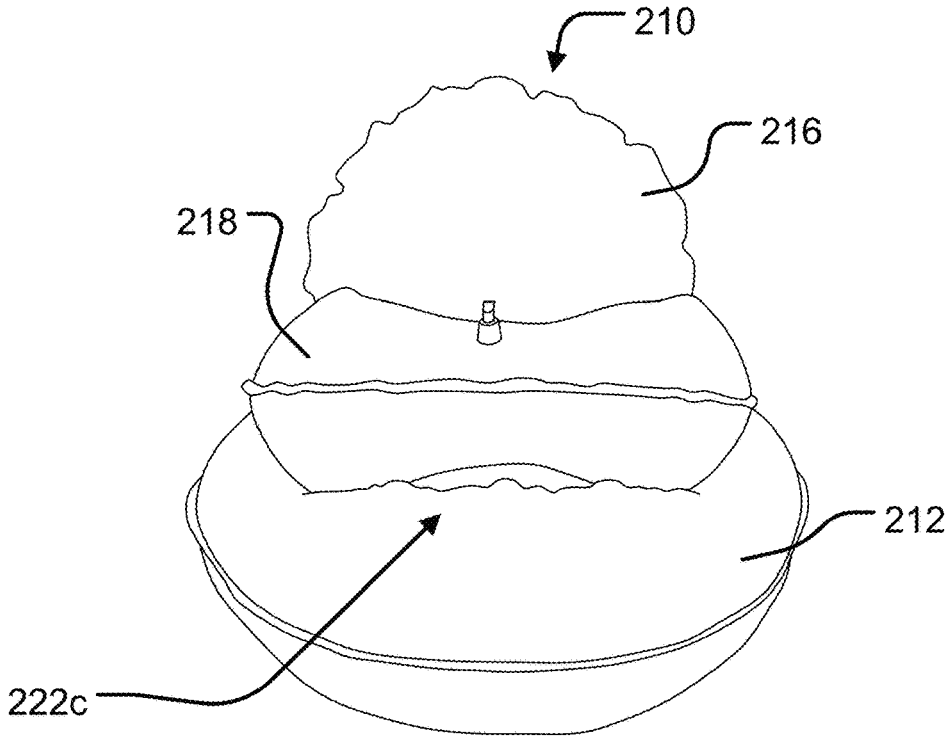
FIG. 31 is an image of the front of a storage device according to the third embodiment of the disclosure.

Furthermore, as shown in FIGS. 29 and 31, the contact between second inflatable member 218 and inflatable base 212 forms a third storage area 222*c* into which objects can be inserted. Because second inflatable member 218 and inflatable base 212 are inflated and press against one another, any object inserted into third storage area 222*c* between second inflatable member 218 and inflatable base 212 is held in place by the force exerted on the object by second inflatable member 218 and inflatable base 212. That is, the object is sandwiched between second inflatable member 218 and inflatable base 212. The simple and rapid storage option provided by third storage area 222*c* provides the user with the ability to engage in a variety of activities on standup paddleboard 1, including but not limited to, functional fitness exercises involving use of both hands and recreational activities such as fishing, diving, sitting, lying down and other actions where secure storage of hand held paddles would be advantageous to the user. As shown in FIG. 32, various items, such as for example, a paddle 2, sandals 3, and water bottles are shown being stored in storage device 210.

In some embodiments, for example only, there is no contact between inflatable base 212, first inflatable member 216, and/or second inflatable member 218. Thus inflatable base 212, first inflatable member 216, and second inflatable member 218, by their close proximity to one another, cooperate to form storage areas 222*a*, 222*b*, 222*c*.

Now with reference again to FIG. 21, the underside of storage device 210 is shown. As described above, the bottom of base member 214 includes securing device, such as for example only, securing loop 224 to which straps, hooks, suction cups or the like may engage to retain storage device 210 on paddleboard 1. A securing strap may extend through securing loop 224, through securing loop 216*c*, and around paddleboard 1 to retain storage device 210 to paddleboard.

As with storage devices 10 and 110, base member 214 of storage device 210 is affixed to inflatable base 212, such that when inflatable base 212 is inflated, base member 214 is not coincident with the bottom of inflatable base 212. That is, base member 214 is raised above the bottom of inflatable base 212. In some embodiments, base member 214 may be affixed to inflatable base 212 such that base member 214 is located at the midpoint between the bottom of inflatable base 212 and the top of inflatable base 212. In other embodiments, for example, base member 214 may be affixed to inflatable base 212 such that base member 214 is located above the midpoint between the bottom of inflatable base 212 and the top of inflatable base 212. For example, when inflated base member 214 may be from about 1 inch (about 2.54 cm) to about 5 inches (about 12.7 cm) above the bottom of inflatable base 212 (e.g., about 1 inch (about 2.54 cm), about 2 inches (about 5.08 cm), about 3 inches (about 7.62 cm), about 4 inches (about 10.16 cm), about 5 inches (about 12.7 cm)). Thus, when inflatable base 212 is inflated, the air pressure inside inflatable base 212 acts to pull or lift the perimeter of base member 214 away from paddleboard 1 which places tension on securing strap 26 extending through securing loops 224 and 216*c*, which is tending to pull base member 214 and inflatable base 212 toward paddleboard 1. The counteracting forces of the air in inflatable base 212 lifting upwards while securing loops 224 and 216*c* are held proximate to a desired attachment surface (e.g., paddleboard 1), using any method of attachment or securing device as described herein or known in the art, place tension on base member 214. This applied tension to base member 214 pulls inflatable base 212 towards the surface to which securing loop 224 is attached, creating a tight, stable connection between storage device 210 and the surface (e.g., paddleboard 1). In effect, the tension in securing loop 224 and base member 214 pulls inflatable base 212 downward onto paddleboard 1, holding storage device 210 tight against paddleboard 1. The bottom portion of inflatable base 212 is thus pulled toward paddleboard, causing the bottom portion of inflatable base 212 to flatten, forming a stable base for storage device 210. By locating base member 214 at or above the midpoint between the bottom of inflatable base 212 and the top of inflatable base 212, storage device 210 is pulled tight against paddleboard 1 that would be difficult to achieve if base member 214 was located proximate the bottom of inflatable base 212.

Additionally, securing loop 224 is located proximate the center of base member 214. This ensures that the tension force acting on base member 214 and inflatable base 212 is substantially equal or equal around the circumference of inflatable base 212. That is, because of the central location of securing loop 224, the force acting on inflatable base 212 is the same around inflatable base 212 such that storage device 210 is stable around the circumference of inflatable base. As such, storage device 210 is less likely to lean to one side or lift off one side.

It will be understood however, that in other embodiments, for example, base member 214 may be affixed to inflatable base 212 such that base member 214 is located below the midpoint between the bottom of inflatable base 212 and the top of inflatable base. In yet other embodiments, for example, base member 214 may be affixed to inflatable base 212 such that base member 214 is located coincident with the bottom of inflatable base 212. Additionally, in other embodiments, for example, securing loop 224 may not be centrally located on base member 214 and/or two or more securing loops 224 may be located on base member 214 in various locations.

Figure 33:
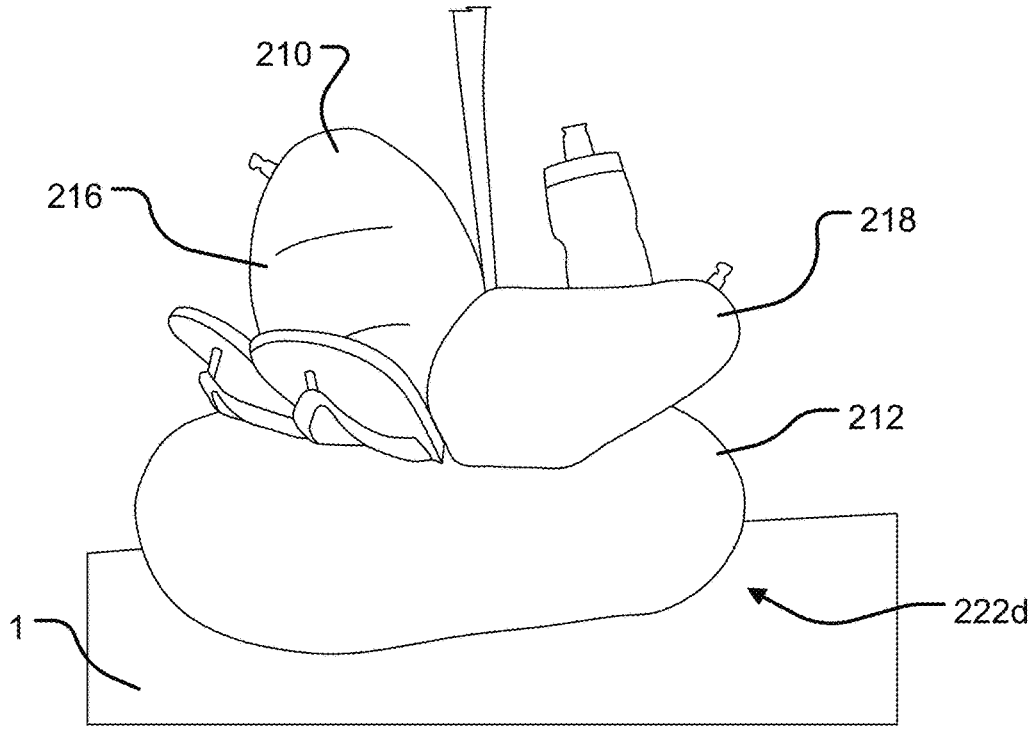
FIG. 33 is an image of the left side of an inflatable storage device according to a third embodiment of the disclosure.

In addition to storing items in first, second and third storage areas 222*a*, 222*b*, and 222*c* as described above, items may be sandwiched or wedged between inflatable base 212 and the structure or object to which storage device 210 is affixed. Therefore, as shown in FIG. 33, when storage device 210 is affixed to a structure or object and storage device 210 is inflated, a fourth storage area 222*d* is created between storage device 210 and the structure or object (e.g., paddleboard 1). It will be understood that any number of objects may be stored in this fourth storage area 222*d* by being sandwiched or wedged between storage device 210 and the structure or object to which it is secured, including but not limited to, paddles, shoes, sandals, wallets, phones, dog leashes, rope, etc.

Figure 34:
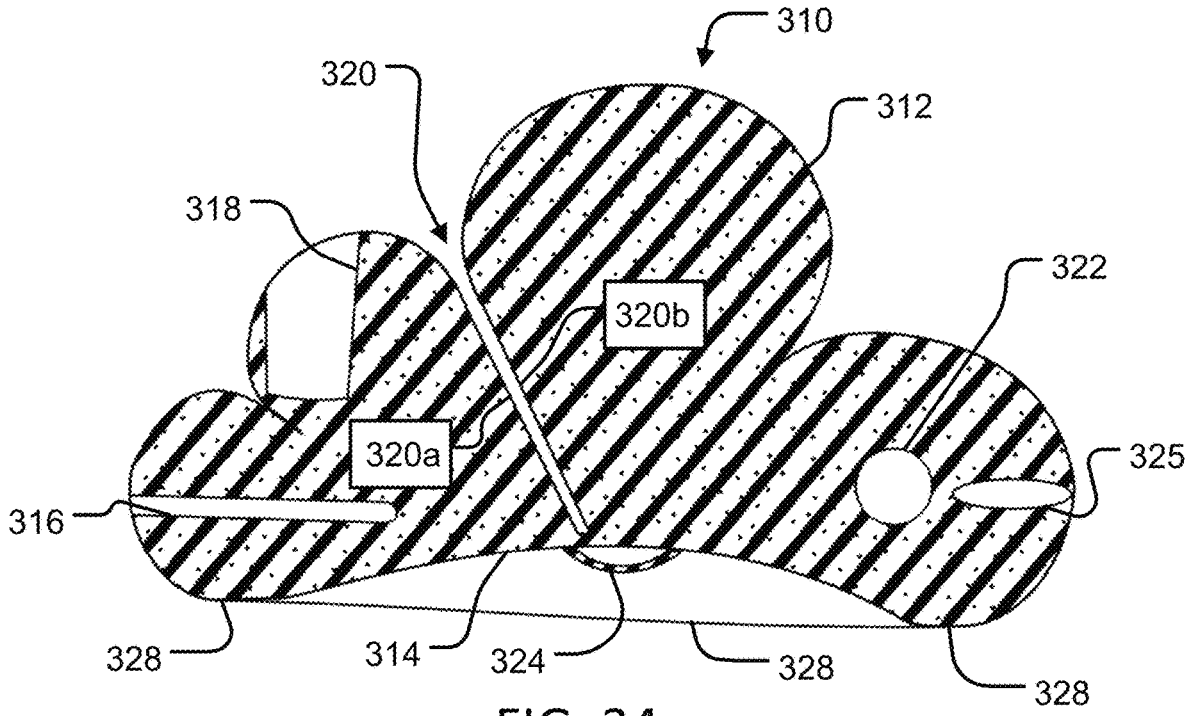
FIG. 34 is similar to FIG. 2A, but is a cross-sectional view of a storage device according to a fourth embodiment of the disclosure.

Another embodiment of a storage device 310 of the disclosure is illustrated in FIG. 34 and is described below. Some features of one or more of storage devices 310, 210, 110 and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Storage device 310 comprises a body 312 having a concave base 314 and a population of storage areas. Body 312 is generally solid or semi-solid and may be constructed from a variety of materials, including but not limited to foam, gel, plastic, rubber or other materials, combinations, hybrids or variations thereof. That is, unlike storage devices 10, 110 and 210 which are buoyant while inflated, storage device 310 may be made from buoyant materials and need not be inflated in order to float.

Storage device 310 includes a population of storage areas, which may include, but are not limited to, waterproof storage slot 316, cup holder 318, paddle slot 320, tunnel 322 and storage receptacle 325, each of which will be described in turn below.

Waterproof storage slot 316 may be used to store items, including but not limited to, cell phones, wallets, car keys, cameras, GPS devices, valuable belongings, or any other desired item. Such items can be placed directly into slot 316 or items can first be placed into a case of various sizes which houses any or all of said items.

Cup holder 318 may be used for the secure storage of beverage containers, including but not limited, to athletic squeezable bottles, soda cans, soda bottles, water bottles, beer cans, beer bottles, cups and the like. Easy and secure storage of such beverage containers in cup holder 318 allows a user to vigorously exercise or manipulate standup paddleboard 1 while the beverage containers stay secured within cup holder 318 and therefore within storage device 310 mounted on standup paddleboard 1. Cup holder 318 is shown, for example only and without limitation, in the front of storage device 310 however, it will be understood that in various embodiments, cup holder 318 may be placed in any other locations on storage device 310 without departing from the scope of the disclosure.

Storage device 310 may further include paddle slot 320 which comprises a thin slot into which the blade of a paddle (not shown) may be inserted for secure storage. Paddle slot 320 comprises two walls 320*a*, 320*b* that squeeze and close down on each other creating a snug fit that compresses against the paddle blade, which secures the paddle. Paddle slot 320 may be molded into storage device 310 such that walls 320*a*, 320*b* comprise the same material as body 312 of storage device 310. Accordingly, walls 320*a*, 320*b* may be constructed from a variety of materials, including but not limited to foam, gel, plastic, rubber or other buoyant materials, combinations, hybrids or variations thereof. Such materials are non-harmful to the integrity of the blade of a paddles no matter how violently the paddle is jolted or pushed while the paddle blade is held within paddle slot 320. The simple and rapid storage option provided by paddle slot 320 provides the user with the ability to engage in a variety of activities on standup paddleboard 1, including but not limited to, functional fitness exercises involving use of both hands and recreational activities such as fishing, diving, sitting, lying down and other actions where secure storage of hand held paddles would be advantageous to the user.

Storage device 310 may further include tunnel 322. Tunnel 322 may extend all the way from one side of body 312 to an opposite side of body 312, such that tunnel 322 is a through tunnel, while in other embodiments, tunnel 322 may only extend partially from one side of body 312 towards an opposite side of body 312, such that tunnel 322 is a blind tunnel. Tunnel 322 provides numerous a storage location for a variety of items, including but not limited to, snorkels, spear guns, fishing poles, anchors, rope, paddles and other accessories. Tunnel 322 therefore may provide a secure storage site for various size cylinder-shaped products. Where tunnel 322 is a through tunnel, it allows the products and materials stored therein to protrude from one or both sides of tunnel 322 during storage.

Storage device 310 may further include storage receptacle 325. Storage receptacle 325 is yet another secure storage site in which additional items such as but limited to, dog leashes, boating whistles, safety flares, lights, and other watercraft or recreational mandated accessories can be stored.

As described above, storage device 310 may further include a concave base 314 which terminates in a bottom rim 328 at bottom of storage device 310. Various embodiment of storage device 310 may not include concave base 314, which may depend on the materials used to construct storage device 310. Affixed proximate the center of concave base 314, may be a securing device, such as for example only, securing loop 324 to which straps, hooks, suction cups or the like may engage to retain storage device 310 on paddleboard 1. For example, securing loop 324 may be fused or affixed to concave base 314. A securing strap (not shown) may extend through securing loop 324 and around paddleboard 1 to retain storage device 310 to paddleboard 1. Securing loop 324 may be constructed and affixed to storage device 310 in the same or similar manner to securing loop 24, 124, and 324 described above with respect to storage devices 10, 110 and 210. While it is described that storage device 310 may be secured to paddleboard 1, storage device 310 may be secured to a variety of objects, including but not limited to, boats, docks, walls, canoes, kayaks, paddleboards, vehicles and numerous other objects desired by the user. Bottom rim 328 makes contact with the surface of the object to which storage device is secured and provides stability to storage device 310. Although, securing loop 324 is shown for securing storage device 310 to paddleboard 1, it will be understood that in various embodiments, other securing devices, such as for example only, the other securing devices described herein or one or more suction cups may be affixed to the bottom of storage device 310 that would permit securing storage device 310 to paddleboard 1 by suction force.

Figure 35:
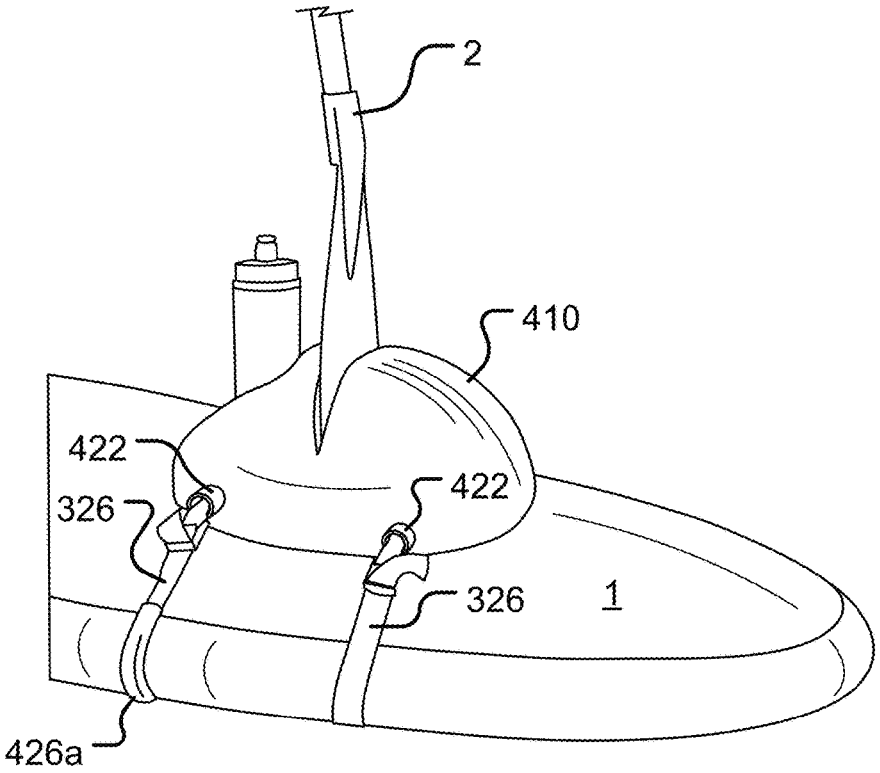
FIG. 35 is a side view of a storage device according to a fifth embodiment of the disclosure.

Another embodiment of a storage device 410 of the disclosure is illustrated in FIG. 35 and is described below. Some features of one or more of storage devices 410, 310, 210, 110 and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Storage device 410 may be substantially the same as storage device 310, but in addition to or alternative to having a concave base 314 and/or securing device, such as for example only, securing loop 324 (see FIG. 34), storage device 410 includes two through tunnels 422, through which a securing strap 326 may extend through each tunnel 422 to secure storage device 410 to paddleboard 1. Each tunnel 422 may be reinforced by a solid or semi-rigid or rigid pipe, such as for example only, a PVC pipe. As shown in FIG. 35, an alternative embodiment of rubber sleeve 426*a* is shown where rubber sleeve 426*a* is a rubber tube through which securing strap 326 extends.

Figure 36:
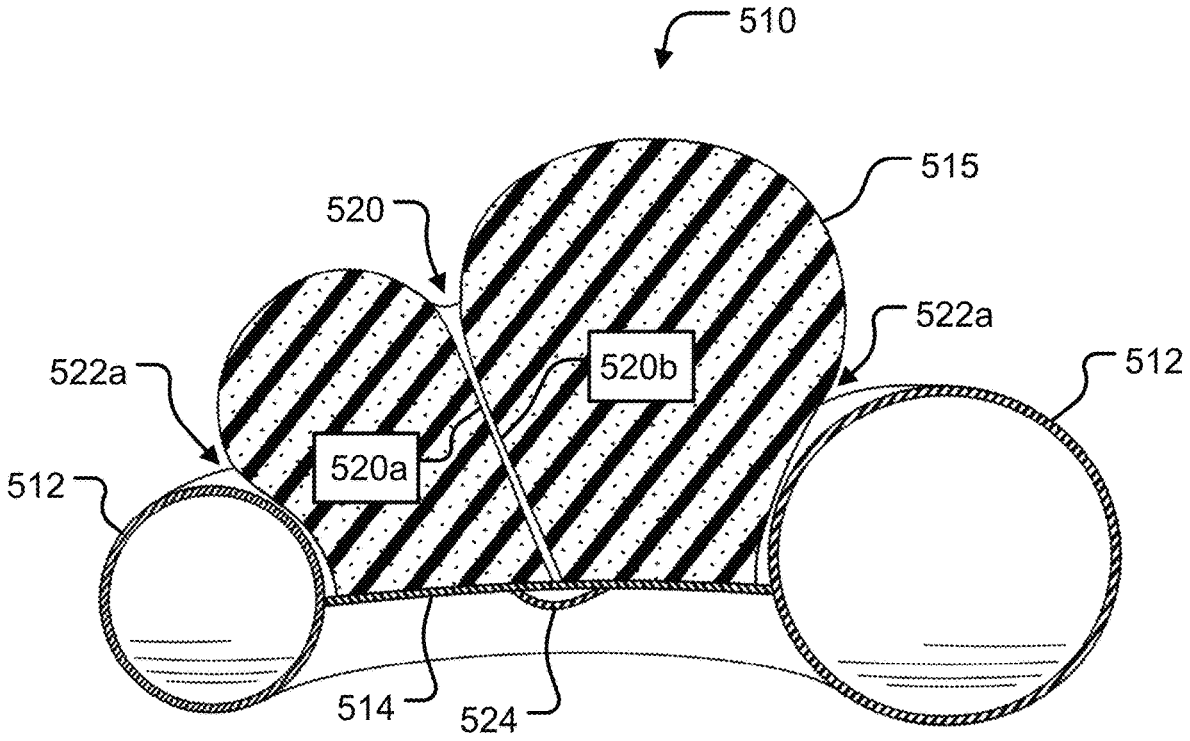
FIG. 36 is similar to FIG. 2A, but is a cross-sectional view of a combination inflatable/non-inflatable storage device according to a sixth embodiment of the disclosure.

Another embodiment of a storage device 510 of the disclosure is illustrated in FIG. 36 and is described below. Some features of one or more of storage devices 510, 410, 310, 210, 110 and 10 are common to one another and, accordingly, descriptions of such features in one embodiment should be understood to apply to other embodiments.

Furthermore, particular characteristics and aspects of one embodiment may be used in combination with, or instead of, particular characteristics and aspects of another embodiment.

Storage device 510 comprises a hybrid storage device having both inflatable and non-inflatable portions. Storage device 510 includes inflatable base 512, a base member 514, and a non-inflatable body 515.

Inflatable base 512 is an inflatable tube that is inner-tube or donut shaped. Inflatable base 512 may have a substantially constant dimension (e.g. diameter) around its entire perimeter. In other embodiments, for example, inflatable base 512 may have a non-constant dimension. That is inflatable base 512 may have a smaller dimension (e.g., diameter) in the front of storage device 510 and may expand to a larger dimension (e.g. diameter) toward the back of storage device 510. A base member 514 is affixed to the inside perimeter of inflatable base 512. That is, base member 514 serves to close off the "donut hole" in the center of inflatable base 512.

Base member 514 may comprise one or more sheets of material that are adhered or fused to inflatable base 512. In other embodiments, for example, base member 514 may be integrally formed with inflatable base 512. Inflatable base 512 and base member 514 may be the same or substantially similar to inflatable base 12 and base member 14 of storage device 10 described in greater detail elsewhere herein.

Affixed to base member 514 and extending upward and outward from base member 514 is non-inflatable body 515. Non-inflatable body 515 is generally solid or semi-solid and may be constructed from a variety of materials, including but not limited to foam, gel, plastic, rubber or other buoyant materials, combinations, hybrids or variations thereof.

Storage device 510 may further include paddle slot 520 in body 515 which comprises a thin slot into which the blade of a paddle (not shown) may be inserted for secure storage. Paddle slot 520 comprises two walls 520*a*, 520*b* that squeeze and close down on each other creating a snug fit that compresses against the paddle blade, which secures the paddle. Paddle slot 520 may be molded into storage device 510 such that walls 520*a*, 520*b* comprise the same material as body 515 of storage device 510. Accordingly, walls 520*a*, 5320*b* may be constructed from a variety of materials, including but not limited to foam, gel, plastic, rubber or other buoyant materials, combinations, hybrids or variations thereof. Such materials are non-harmful to the integrity of the blade of a paddles no matter how violently the paddle is jolted or pushed while the paddle blade is held within paddle slot 520. The simple and rapid storage option provided by paddle slot 520 provides the user with the ability to engage in a variety of activities on standup paddleboard 1, including but not limited to, functional fitness exercises involving use of both hands and recreational activities such as fishing, diving, sitting, lying down and other actions where secure storage of hand held paddles would be advantageous to the user.

While not shown, it will be understood that body 515 of storage device 510 may further include a population of storage areas, which may include but are not limited to, the waterproof storage slot 316, cup holder 318, paddle slot 320, tunnel 324 and storage receptacle 326 described with respect to storage device 310.

With continued reference to FIG. 36, when inflatable base 512 is inflated, body 515 makes contact with and presses up against at least a portion of the inner perimeter of inflatable base 512. In various embodiments, inflatable base 512 and body 515 are in contact with each other around the entire inner perimeter of inflatable base 512. The contact between inflatable base 512 and body 515 forms a first storage area 522*a* into which objects can be inserted. In various embodiments, first storage area 522*a* extends around the entire inner perimeter of inflatable base 512. Because inflatable base 512 and body 515 press against one another, any object inserted into first storage area 522*a* between inflatable base 512 and body 515 is held in place by the force exerted on the object by inflatable base 512 and body 515. That is, the object is sandwiched between inflatable base 512 and body 515.

In some embodiments, for example only, there is no contact between inflatable base 512 and body 515. Thus inflatable base 512 and body 515, by their close proximity to one another, cooperate to form storage area 522*a*.

Storage device 510 may further include a securing device, such as for example only, securing loop 524 to which straps, hooks, suction cups or the like may engage to retain storage device 510 on paddleboard 1. For example, securing loop 524 is fused or affixed to the underside of base member 514. A securing strap may extend through securing loop 524 and around paddleboard 1 to retain storage device 510 to paddleboard 1. Any of the other securing devices described herein including mounting assembly 1260 (see FIGS. 63, 63A and 64) may be used to secure storage device 510 to a structure or object without departing from the scope of the disclosure.

As with storage devices 10, 110 and 210, base member 514 of storage device 510 is affixed to inflatable base 512, such that when inflatable base 512 is inflated, base member 514 is not coincident with the bottom of inflatable base 512. That is, base member 514 is raised above the bottom of inflatable base 512. In some embodiments, base member 514 may be affixed to inflatable base 512 such that base member 514 is located at the midpoint between the bottom of inflatable base 512 and the top of inflatable base 512. In other embodiments, for example, base member 514 may be affixed to inflatable base 512 such that base member 514 is located above the midpoint between the bottom of inflatable base 512 and the top of inflatable base 512. For example, when inflated base member 514 may be from about 1 inch (about 2.54 cm) to about 5 inches (about 12.7 cm) above the bottom of inflatable base 512 (e.g., about 1 inch (about 2.54 cm), about 2 inches (about 5.08 cm), about 3 inches (about 7.62 cm), about 4 inches (about 10.16 cm), about 5 inches (about 12.7 cm)). Thus, when inflatable base 512 is inflated, the air pressure inside inflatable base 512 acts to pull or lift the perimeter of base member 514 away from paddleboard 1 which places tension on securing strap 26 extending through securing loop 524, which is tending to pull base member 514 and inflatable base 512 toward paddleboard 1. The counteracting forces of the air in inflatable base 512 lifting upwards while securing loop 524 is held proximate to a desired attachment surface (e.g., paddleboard 1), using any method of attachment or securing device as described herein or known in the art, place tension on base member 514. This applied tension to base member 514 pulls inflatable base 512 towards the surface to which securing loop 524 is attached, creating a tight, stable connection between storage device 510 and the surface (e.g., paddleboard 1). In effect, the tension in securing loop 524 and base member 514 pulls inflatable base 512 downward onto paddleboard 1, holding storage device 510 tight against paddleboard 1. The bottom portion of inflatable base 512 is thus pulled toward paddleboard, causing the bottom portion of inflatable base 512 to flatten, forming a stable base for storage device 510. By locating base member 514 at or above the midpoint between the bottom of inflatable base 512 and the top of inflatable base 512, storage device 510 is pulled tight against paddleboard 1 that would be difficult to achieve if base member 514 was located proximate the bottom of inflatable base 512.

Additionally, securing loop 524 is located proximate the center of base member 514. This ensures that the tension force acting on base member 514 and inflatable base 512 is substantially equal or equal around the circumference of inflatable base 512. That is, because of the central location of securing loop 524, the force acting on inflatable base 512 is the same around inflatable base 512 such that storage device 510 is stable around the circumference of inflatable base. As such, storage device 510 is less likely to lean to one side or lift off one side.

It will be understood however, that in other embodiments, for example, base member 514 may be affixed to inflatable base 512 such that base member 514 is located below the midpoint between the bottom of inflatable base 512 and the top of inflatable base. In yet other embodiments, for example, base member 514 may be affixed to inflatable base 512 such that base member 514 is located coincident with the bottom of inflatable base 512. Additionally, in other embodiments, for example, securing loop 524 may not be centrally located on base member 514 and/or two or more securing loops 524 may be located on base member 514 in various locations.

In other embodiments, for example, a hybrid storage device may be opposite storage device 510. That is, instead of inflatable base 512, a hybrid storage device may include a solid or semi-solid base and instead of solid or semi-solid body 515, a hybrid storage device may include an inflatable body (e.g., may include first and second inflatable members such as those described with respect to storage devices 10, 110, 210).

Figure 37:
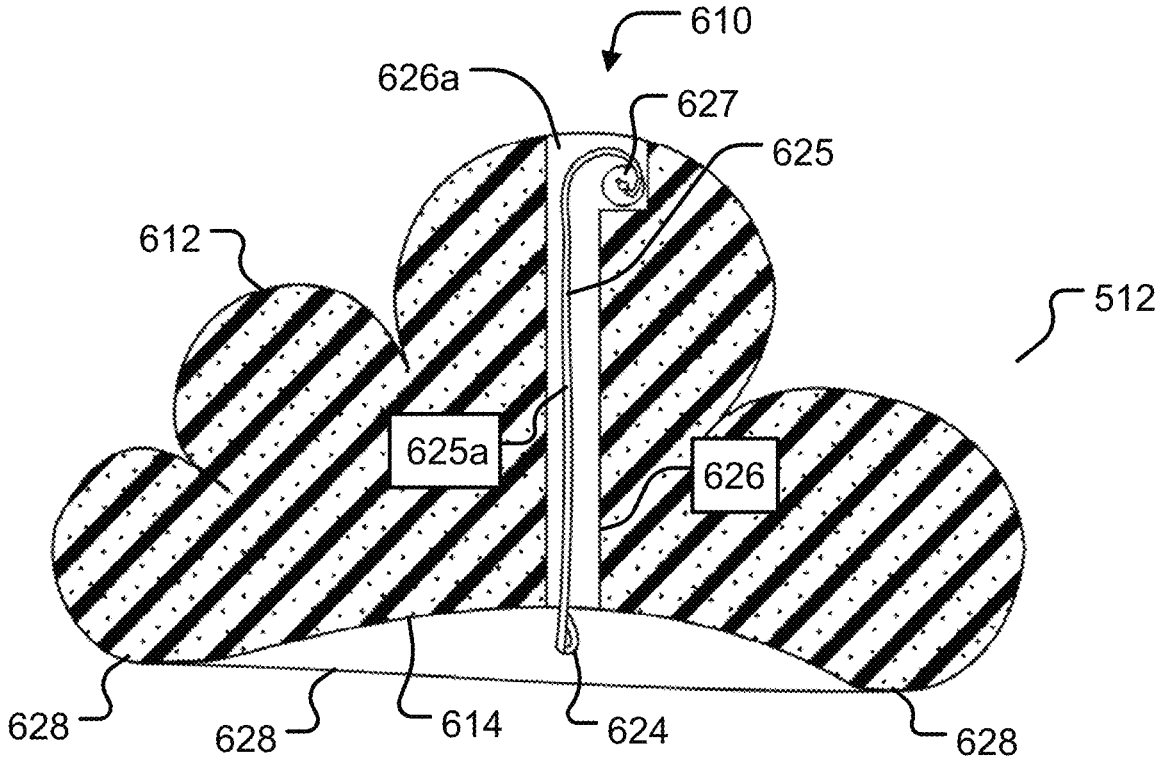
FIG. 37 is similar to FIG. 2A, but is a cross-sectional view of a storage device according to a seventh embodiment of the disclosure.

Another embodiment of a storage device 610 of the disclosure is illustrated in FIG. 37 and is described below. Some features of one or more of storage devices 610, 510, 410, 310, 210, 110 and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Storage device 610 comprises a body 612 having a population of storage areas, which may include, but are not limited to, waterproof storage slot 316, cup holder 318, paddle slot 320, tunnel 324 and storage receptacle 325 such as those described in connection with storage device 310 (see FIG. 34). Body 612 is generally solid or semi-solid and may be constructed from a variety of materials, including but not limited to foam, gel, plastic, rubber or other buoyant materials, combinations, hybrids or variations thereof. That is, unlike storage devices 10, 110 and 210 which are buoyant while inflated, storage device 610 may be made from buoyant materials and need not be inflated in order to float.

Storage device 610 further includes a concave base 614 which terminates in a bottom rim 628 at bottom of storage device 610. Extending upward from concave base 214 to the top of body 612 is a tunnel 626 through which securing device 625 extends. A securing device 625 comprises a strap or cord **625*a* with a securing member 624 at one terminal end of strap or cord 625*a* and a tightening mechanism 627 at a second terminal end of strap or cord 625*a*, opposite securing member 624. Attachment member 625 may be formed of a nylon webbing strap, such as straps used in come-along or tie down straps. However, it will be understood that other materials known in the art may be used without departing from the scope of the disclosure When attachment member 625 is extended through tunnel 626, securing member 624 is located proximate concave base 614. In various embodiments, for example, securing member 624 comprises a securing loop with which straps, hooks, suction cups or the like may engage to retain storage device 610 on paddleboard 1. Alternative to securing loop, in some embodiments for example, securing member 624 may comprise a hook, much like a come-along or tie down strap, wherein the hook engages with a loop, strap, hook, suction cup or the like affixed or attached to paddleboard 1**.

When attachment member 625 is extended through tunnel 626, tightening mechanism 627 is located proximate the top of body 612. As shown in FIG. 37, in various embodiments, an attachment well **626*a* may be located at the top of tunnel 626. Tightening mechanism 627 may reside in attachment well 626*a* such that tightening mechanism does not extend past the top of body 612 of storage device 610. By nesting tightening mechanism 627 in attachment well 626*a*, the possibility of a user of the paddleboard 1 falling and hitting themselves, such as their head or face, on tightening mechanism 627** is reduced or eliminated.

Tightening mechanism 627 may comprise a ratcheting assembly as used in come-along or tie down straps When securing member 624 is secured to paddleboard 1 by way of a loop, hook, strap, suction cup or the like, the user may then operate tightening mechanism 627 to draw in slack of and tighten strap or cord body **625*a*. That, in turn, presses the rim 628 of concave base 614 to the surface on which user is affixing the device (e.g., paddleboard 1). This creates a very stable and simple connection between storage device 610 and the surface (e.g., paddleboard 1**).

Much like the ratcheting assembly of come-along or tie down straps, tightening mechanism 627 may include a locking mechanism that ensures the tension applied by the user winding the slack is statically maintained during operation. The locking mechanism is then released upon removal of storage device 610, allowing for easy removal upward of the storage device 610 from paddleboard 1. When base 614 is a sufficient distance from the surface on which it was affixed (e.g., paddleboard 1), the user simply separates securing member 624 from whichever fastening method that was in place and removes storage device 610 from the surface on which it was affixed (e.g., paddleboard 1).

In other embodiments, for example, it will be understood that attachment member 625 may comprise a typical bungee cord having hooks at either end, wherein one hook proximate concave base 614 engages with a loop, hook, strap, suction cup or the like, on paddleboard 1 and a second hook proximate the top of body 612 engages with attachment well **626*a* or a loop, hook, strap, suction cup or the like in attachment well 626*a*, While it is described that storage device 610 may be secured to paddleboard 1, storage device 610 may be secured to a variety of objects, including but not limited to, boats, docks, walls, canoes, kayaks, paddleboards, vehicles and numerous other objects desired by the user. Bottom rim 628 makes contact with the surface of the object to which storage device is secured and provides stability to storage device 610**.

Figure 38:
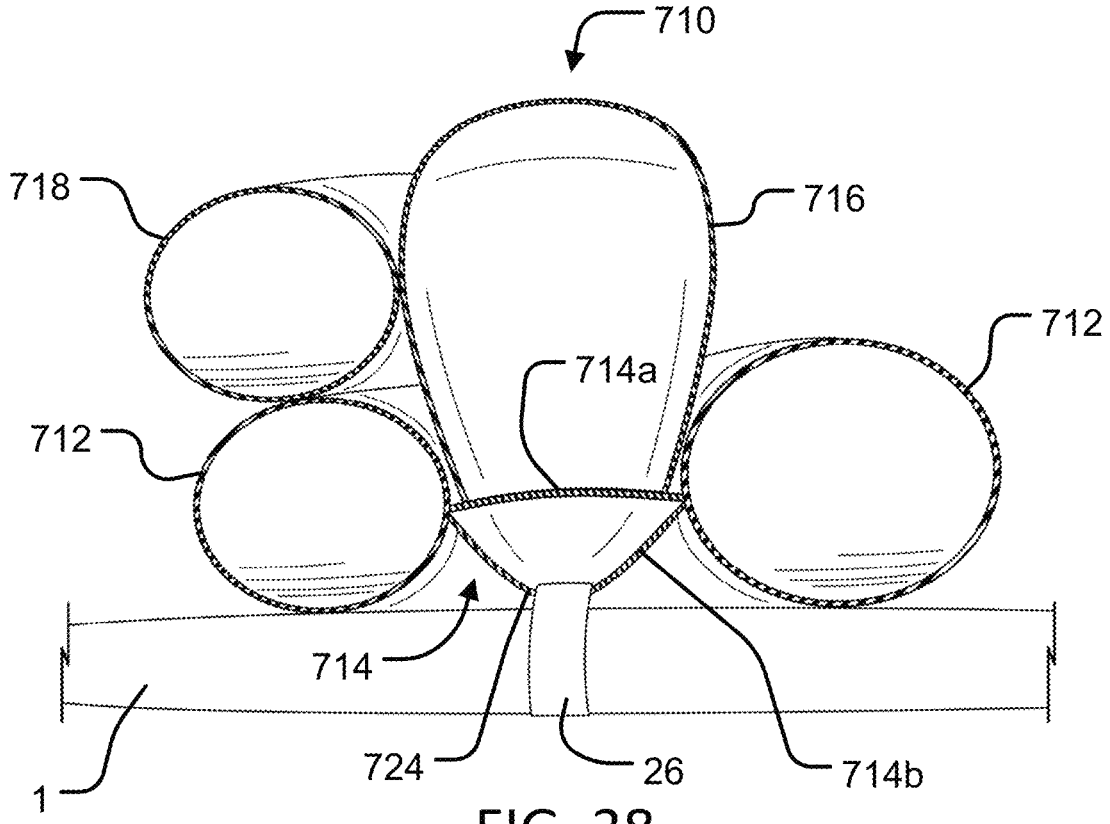
FIG. 38 is similar to FIG. 2A, but is a cross-sectional view of a storage device according to an eighth embodiment of the disclosure.

Another embodiment of a storage device 710 of the disclosure is illustrated in FIG. 38 and is described below. Some features of one or more of storage devices 710, 610, 510, 410, 310, 210, 110 and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

As shown in FIG. 38, storage device 710 includes an inflatable base 712, a first inflatable member 716, and a second inflatable member 718 which cooperate, when inflated, to form a population of storage areas. Storage device 710 further includes base member 714 is affixed to the inside perimeter of inflatable base 712, which serves to close off the "donut hole" in the center of inflatable base 712. Unlike base member 14 in storage device 10, base member 714 comprises a first base member sheet 714*a* and a second base member sheet 714*b*. First inflatable member 716 is affixed to and extends upward and outward from first base member sheet 714*a*. A securing device, such as for example, securing loop 724 is fused, cut into, embedded or otherwise affixed to the underside of second base member sheet 714*b*. Straps, hooks, suction cups or the like may engage with securing loop 724 to retain storage device 710 on paddleboard 1. For example, securing strap 26 is shown as extending through securing loop 724 and around paddleboard 1 to retain storage device 710 to paddleboard.

First and second base member sheets 714*a*, 714*b* are affixed to inflatable base 712, such that when inflatable base 712 is inflated, first and second base member sheets 714*a*, 714*b* are not coincident with the bottom of inflatable base 712. That is, first and second base member sheets 714*a*, 714*b* are raised above the bottom of inflatable base 712. Thus, when inflatable base 712 is inflated, the air pressure inside inflatable base 712 acts to pull or lift the perimeter of second base member sheet 714*b* away from paddleboard 1 which places tension on securing strap 26, which is tending to pull second base member sheet 714*b* and inflatable base 712 toward paddleboard 1. The counteracting forces of the air in inflatable base 712 lifting upwards while securing loop 724 is held proximate to a desired attachment surface (e.g., paddleboard 1), using any method of attachment or securing device as described herein or known in the art, place tension on base member 714. This applied tension to base member 714 pulls inflatable base 712 towards the surface to which securing loop 724 is attached, creating a tight, stable connection between storage device 710 and the surface (e.g., paddleboard 1). In effect, the tension in securing loop 724 and second base member sheet 714*b* pulls inflatable base 712 downward onto paddleboard 1, holding storage device 710 tight against paddleboard 1. The bottom portion of inflatable base 712 is thus pulled toward paddleboard 1, causing the bottom portion of inflatable base 712 to flatten, forming a stable base for storage device 710.

By including two separate base member sheets, the tension placed on second base member sheet 714*b* does not cause tension in first base member sheet 714*a*. Thus, first base member sheet 714*a* and first inflatable member affixed thereto, do not get pulled downward toward paddleboard 1 by securing strap 26.

It will be understood that, in some embodiments for example, first and second base member sheets 714*a*, 714*b* are fused to one another proximate the inside perimeter of inflatable base 712, with one or the other of first and second base member sheets 714*a* or 714*b* then fused to the inside perimeter of inflatable base 712. In other embodiments, for example, each of first and second base member sheets 714*a*, 714*b* are fused to the inside perimeter of inflatable base 712. In embodiments, having multiple base sheets fused together or otherwise secured to one another, second base member sheet 714*b*, first base member sheet 714*a* and first inflatable member 716 are simultaneously pulled towards the surface (e.g., paddleboard) to which securing loop 724 is attached, thereby providing further stability of the storage device 710 when device is attached to the given surface (e.g., paddleboard).

Figure 39:
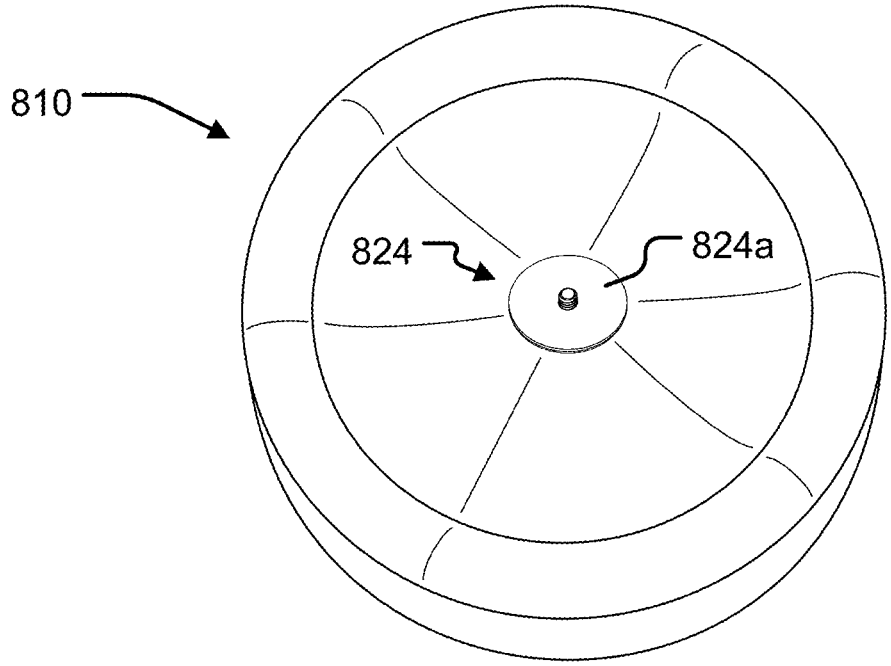
FIG. 39 is a bottom view of a storage device according to a ninth embodiment of the disclosure.
Figure 39A:
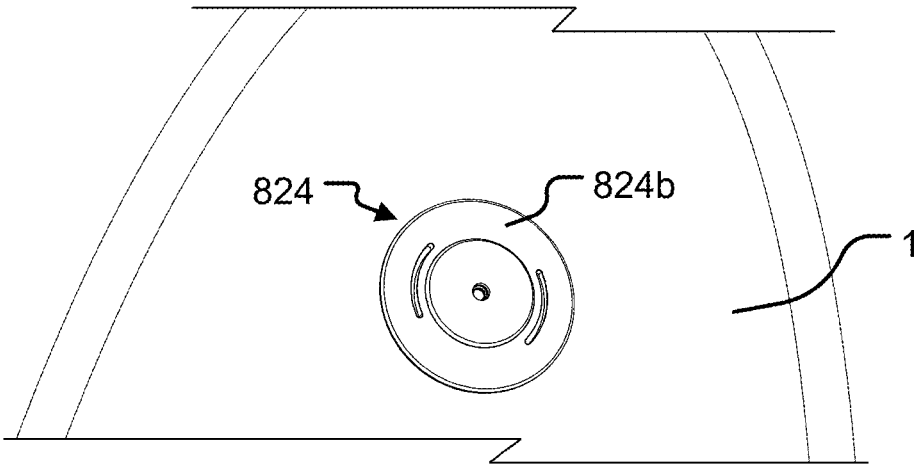
FIG. 39A is a top plan view of a securing device attached to a paddleboard according to a ninth embodiment of the disclosure.

Another embodiment of a storage device 810 of the disclosure is illustrated in FIGS. 39 and 39A and is described below. Some features of one or more of storage devices 810, 710, 610, 510, 410, 310, 210, 110 and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

As seen in FIGS. 39 and 39A, an alternative securing device for securing storage devices described herein is shown. Storage device 810 may be substantially the same as storage devices 710, 610, 510, 410, 310, 210, 110, and 10, except that storage device 810 includes screw attachment device 824 instead of a securing loop. Screw attachment device 824 includes a first threaded portion 824*a* affixed to or integrated with the bottom of storage device 810 and a second threaded portion 824*b* affixed or adhered to paddleboard 1. First threaded portion 824*a* screws into second threaded portion 824*b* to secure storage device 810 to paddleboard 1. It will be understood that screw attachment device 824 may be used with any storage or inflatable device described herein without departing from the scope of the disclosure. Additionally, in various embodiments, base mount 1262 described in greater detail in connection with FIGS. 63, 63A and 64 may be used as the second threaded portion 824*b* on storage device 810.

Figure 40:
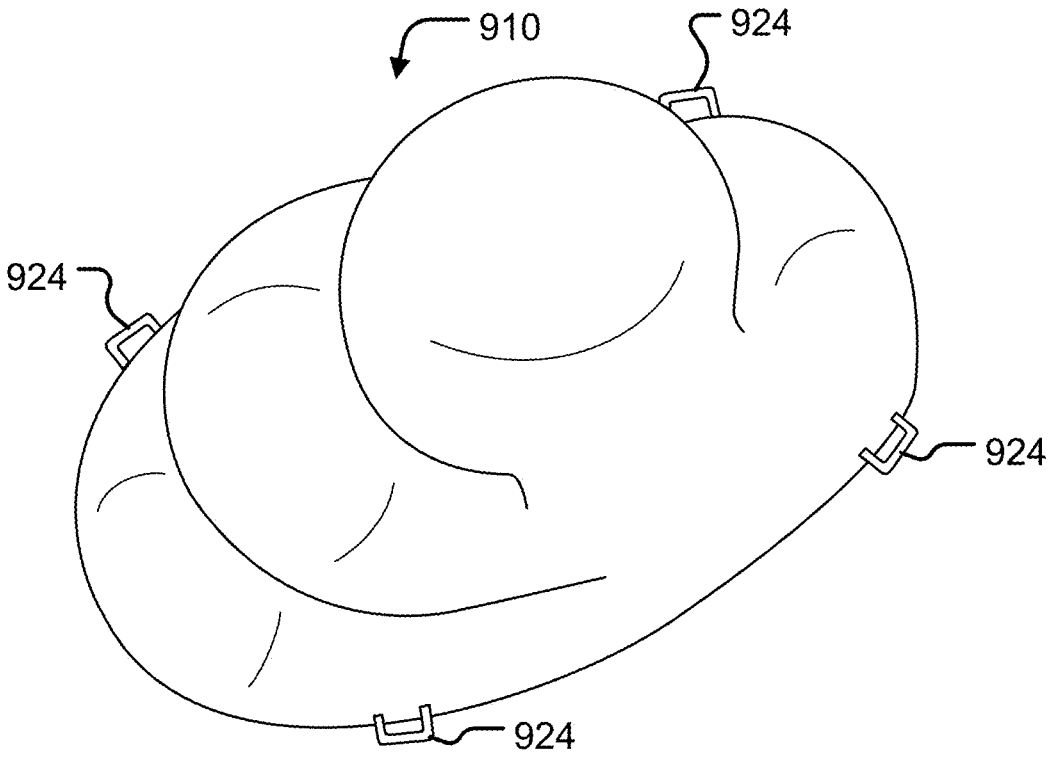
FIG. 40 is an isometric view of a storage device according to a tenth embodiment of the disclosure.

Another embodiment of a storage device 910 of the disclosure is illustrated in FIG. 40 and is described below. Some features of one or more of storage devices 910, 810, 710, 610, 510, 410, 310, 210, 110 and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

As seen in FIG. 40, yet another alternative securing device for securing storage devices described herein is shown. Storage device 910 may be substantially the same as storage devices 710, 610, 510, 410, 310, 210, 110, and 10, except that storage device 910 includes a population of fasteners 924 along the perimeter of storage device 910. As shown, storage device 910 may include four fasteners 924 located around the perimeter of storage device 910. It will be understood, however, that greater than four fasteners 924 or fewer than four fasteners 924 may be used without departing from the scope of the disclosure. Fasteners 924 may comprise hooks, buckles, loops, or other fasteners known in the art to which straps, attachment arms, anchors or any other material or attachment device may extend through or attach to mount to paddleboard 1. For example, straps may extend through fasteners 924 to secure storage device 910 to items such as but not limited to paddleboards, boats, kayaks, vehicles, docks, tables, or any other external solid surface as desired by the user. Since the storage device is light weight and naturally buoyant in foam form or the like, said device can also be attached to a rope or lanyard and used as a throw-able floatation device. It will be understood that fasteners 924 may be used with any storage device described herein without departing from the scope of the disclosure.

Figure 41:
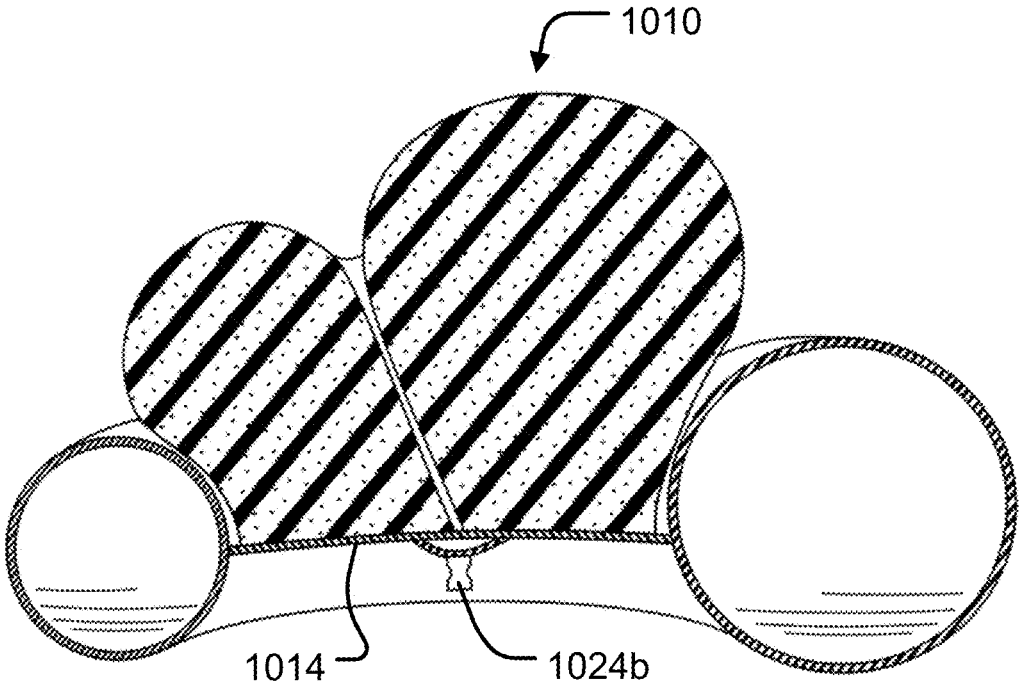
FIG. 41 is similar to FIG. 2A, but is a cross-sectional view of a storage device according to an eleventh embodiment of the disclosure.
Figure 42:
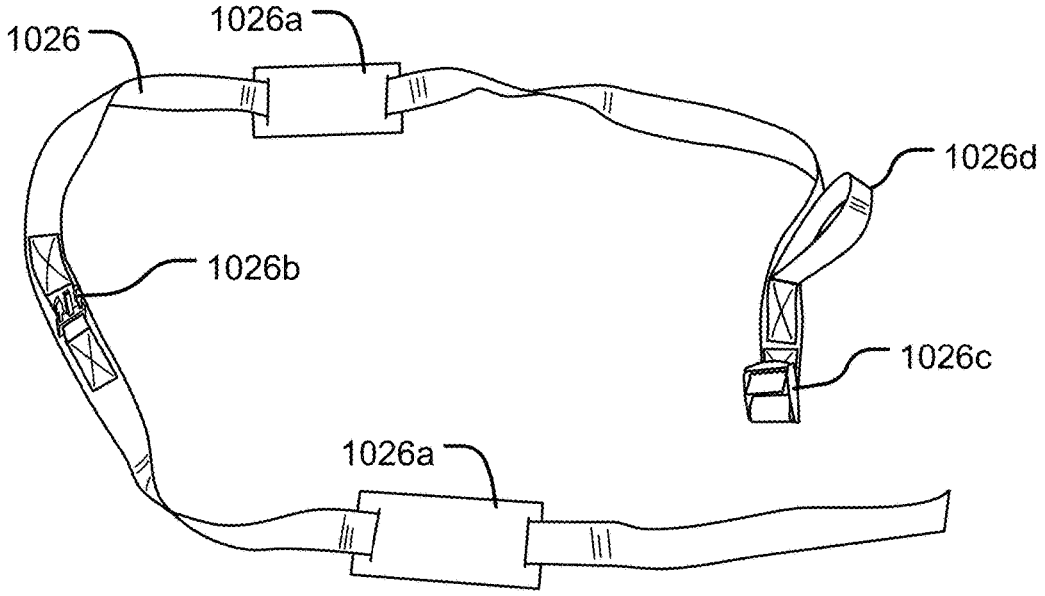
FIG. 42 is a top plan view of a securing strap which may be used with various embodiments of the disclosure.
Figure 43:
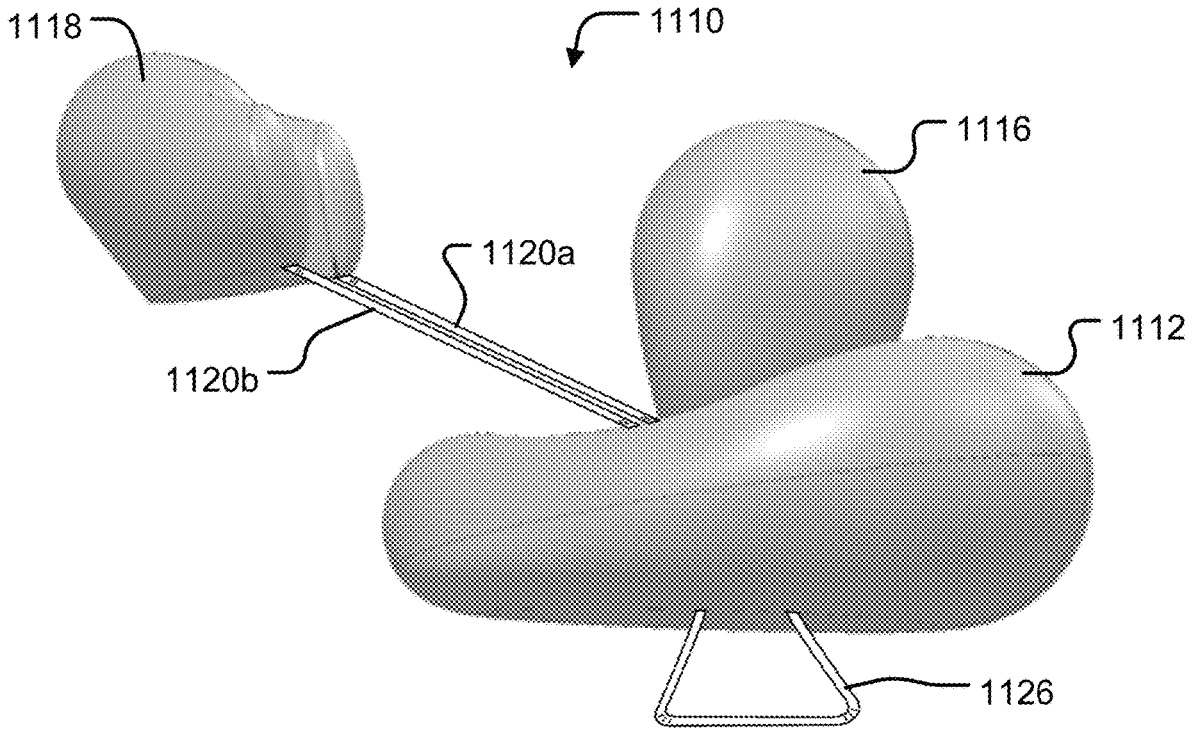
FIG. 43 is a right side view of a storage device according to a twelfth embodiment of the disclosure.
Figure 44:
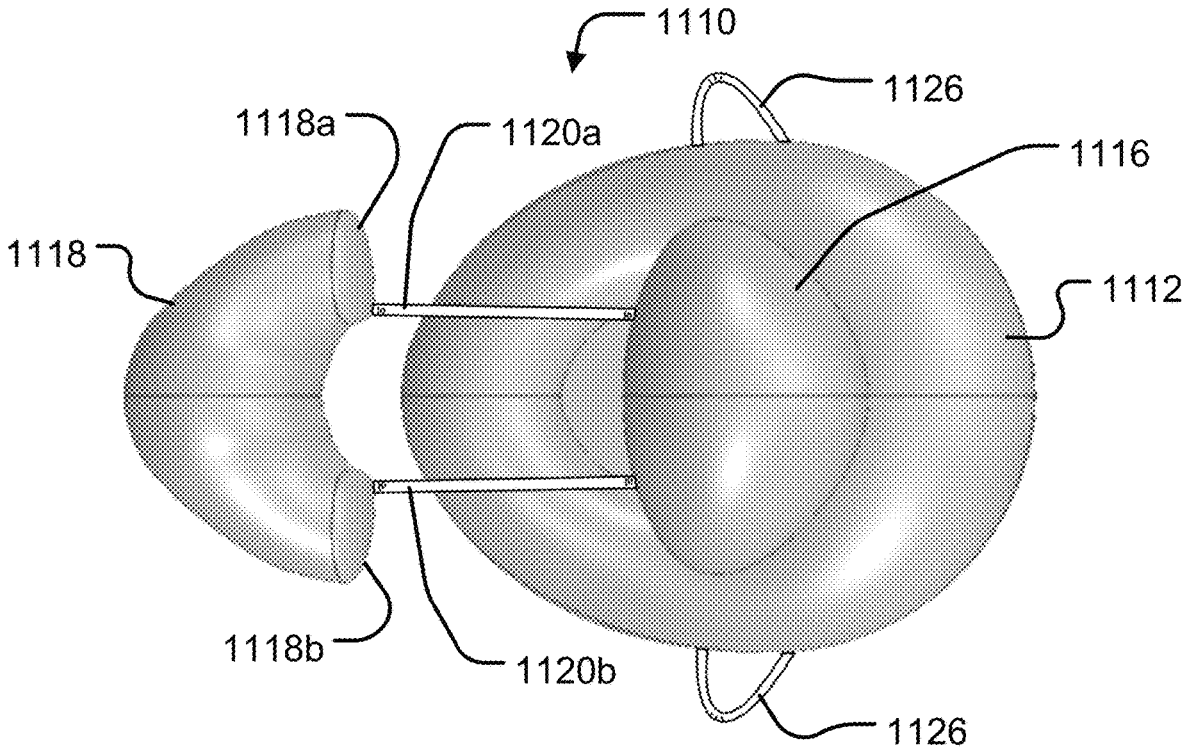
FIG. 44 is a top view of a storage device according to the twelfth embodiment of the disclosure.
Figure 45:
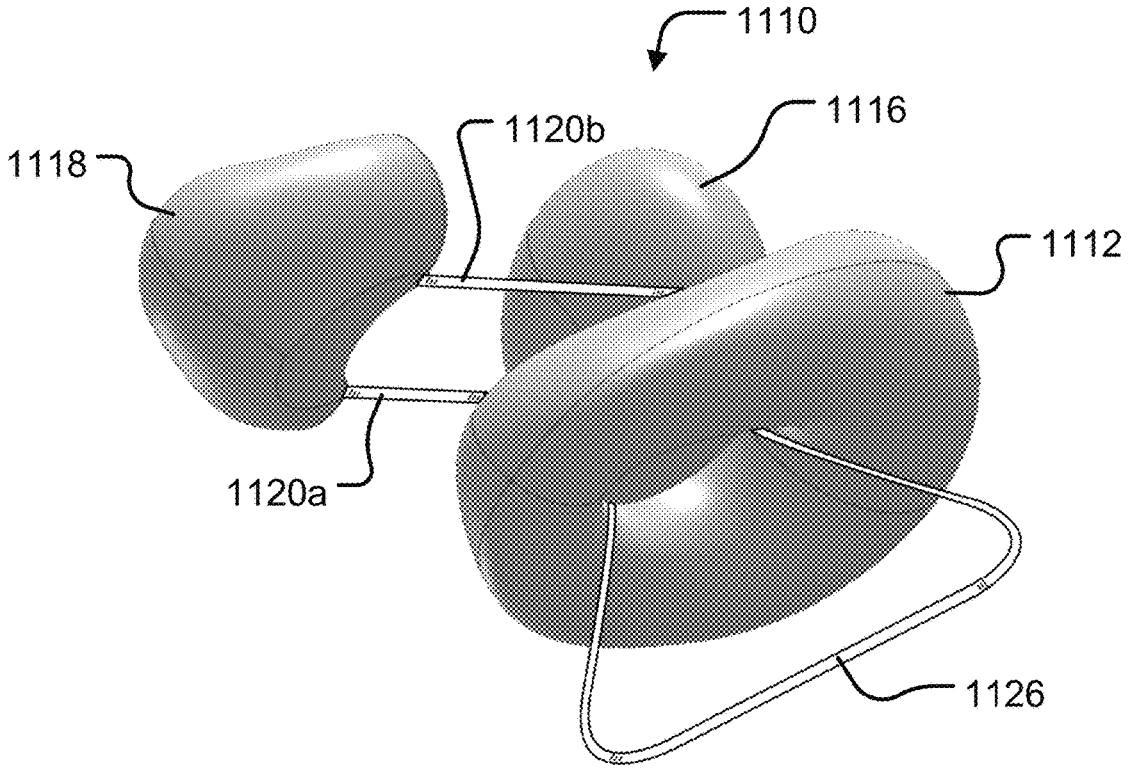
FIG. 45 is a bottom isometric view of a storage device according to the twelfth embodiment of the disclosure.
Figure 46:
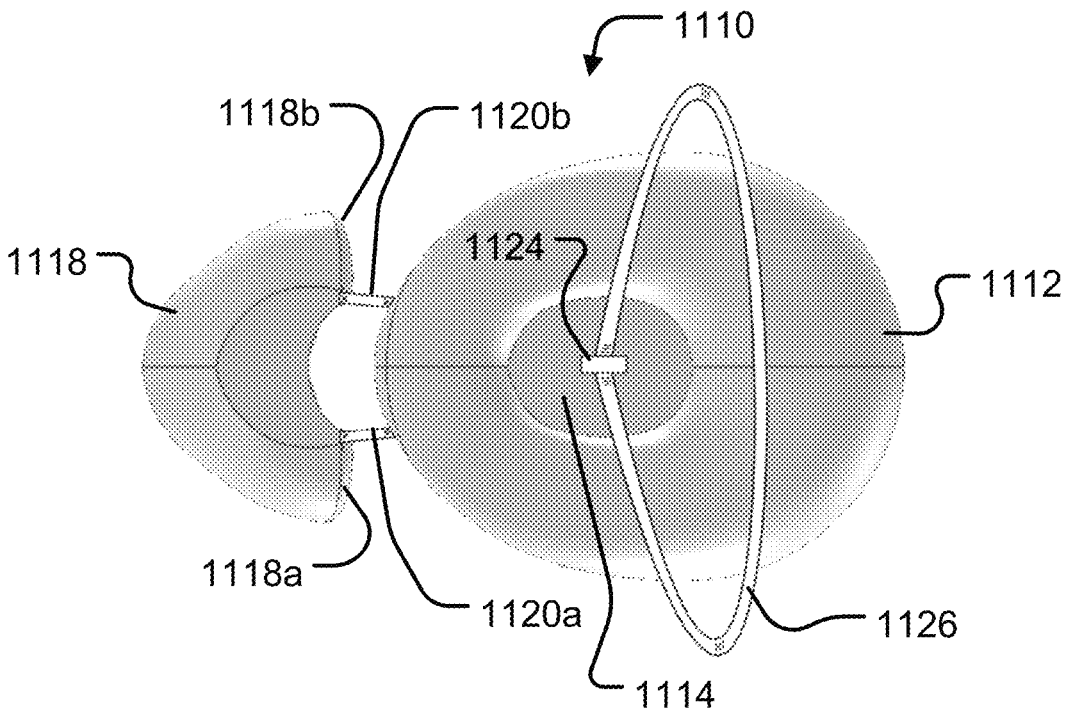
FIG. 46 is a bottom view of a storage device according to the twelfth embodiment of the disclosure.
Figure 47:
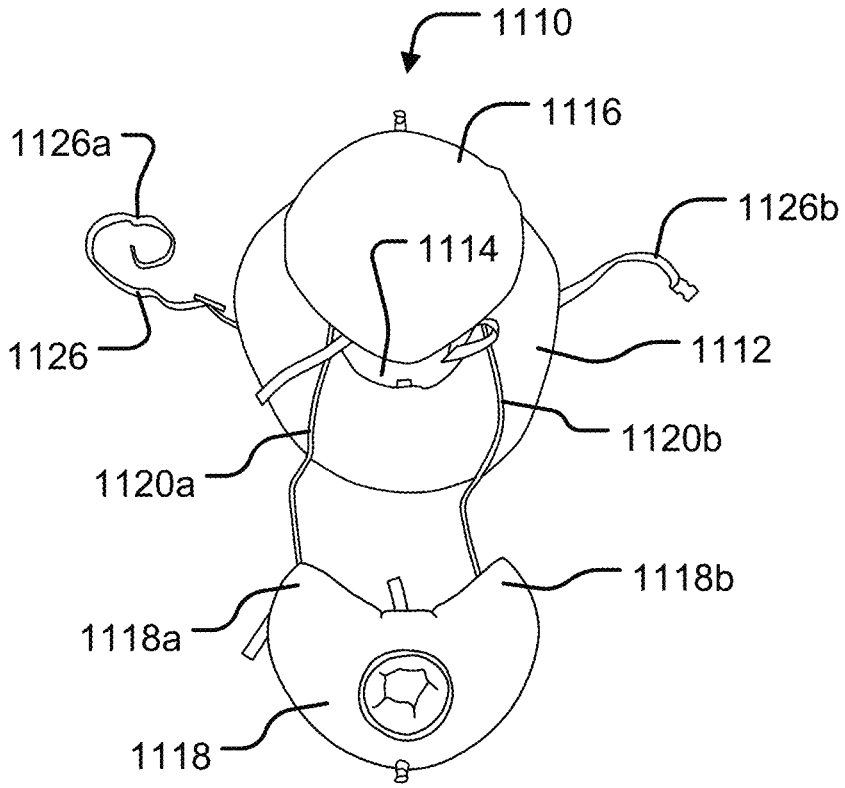
FIG. 47 is an image of a storage device according to the twelfth embodiment of the disclosure.

As seen in FIGS. 41 and 42, yet another alternative securing device for securing storage devices described herein is shown. Storage device 1010 may be substantially the same as storage devices 710, 610, 510, 410, 310, 210, 110, and 10, except that storage device 1010 includes a securing device comprising a buckle 1024*b* located on the bottom side of storage device 1010 for securing storage device 1010 to an item (e.g., paddleboard). For example, buckle 1024*b* may be fused to the bottom of base member 1014 of storage device 1010 and a corresponding buckle may be affixed to a paddleboard. Buckle 1024*b* may be a female side release buckle that receives and locks with a corresponding male side release buckle 1026*b* which may be affixed to securing strap 1026 (see FIG. 42). As shown, securing strap 1026 may also include sleeves 1026*a* like sleeves 26*a* described in greater detail elsewhere herein. Securing strap 1026 may also include a buckle 1026*c*, such as for example only a cam buckle or ladderlock buckle, at one end of the securing strap 1026 through which the other end of the securing strap may be inserted. Additionally, in various embodiments, the securing strap 1026 may also include a loop 1026*d* which may aid in pulling securing strap tightly against paddleboard 1. In some embodiments, for example, a male side release buckle may be affixed directly to paddleboard 1. It will be understood that this type of buckle may be used on any of the embodiments of storage devices described herein and may supplement and/or substitute the securing loops 24, 124, 224, 524, 724 and other securing devices described herein without departing from the scope of the disclosure. It will be understood that in other embodiments of securing strap 1026, buckle 1026*b* is not included on securing strap 1026. Additionally, it will be understood that embodiments of securing strap 1026, either with or without buckle 1026*b*, may be used on any of the embodiments of storage devices and/or inflatable devices described herein without departing from the scope of the disclosure.

In yet other embodiments, the securing device may comprise one or more magnets and/or electromagnets may be placed in and/or on the bottom of the storage devices described herein. The magnets and/or electromagnets may be used to attach the storage devices described herein to metal objects, such as vehicles, boats, coolers, posts, etc. Additionally, one or more metal plates may be affixed at certain times that the user wishes to attach the storage devices described herein. For example only and without limitation, a user may affix a metal plate to a paddleboard and may secure a storage device having one or more magnets and/or electromagnets by placing the magnet(s) and/or electromagnet(s) of the storage device proximate to the metal plate, such that the magnetic attraction pulls the storage device to the paddleboard.

Another embodiment of a storage device 1110 of the disclosure is illustrated in FIGS. 43-52 and is described below which may be used as a wearable personal flotation device ("PFD"). Some features of one or more of storage devices 1110, 1010, 910, 810, 710, 610, 510, 410, 310, 210, 110 and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

In addition to being used as a storage device as described in greater detail elsewhere herein, embodiments of the storage device may be used as a wearable personal flotation device. As an example, storage device 1110 is a variation of storage device 210.

As shown in FIGS. 43-48, storage device 1110 includes an inflatable base 1112, a base member 1114, a first inflatable member 1116, and a second inflatable member 1118 which cooperate, when inflated, to form a population of storage areas, such as those described in greater detail elsewhere herein. Storage device 1110 is substantially the same as storage device 210 described in greater detail elsewhere herein, except that second inflatable member 1118 includes tethers 1120*a*, 1120*b*, each tether having a first end affixed to first and second ends 1118*a*, 1118*b* of second inflatable member 1118 and each tether having a second end affixed to base member 1114. Second inflatable member 1118 can be detached from proximate base member 1114 and first inflatable member 1116 and can be used as a head rest for assisting a user in passive flotation. The length of tethers 1120*a*, 1120*b* can be adjusted to fit users of different sizes. Tethers 1120*a*, 1120*b* may be stored so as to not be visible or otherwise in the way of the use of storage device 1110 as a storage device, as described in greater detail elsewhere herein.

Figure 48:
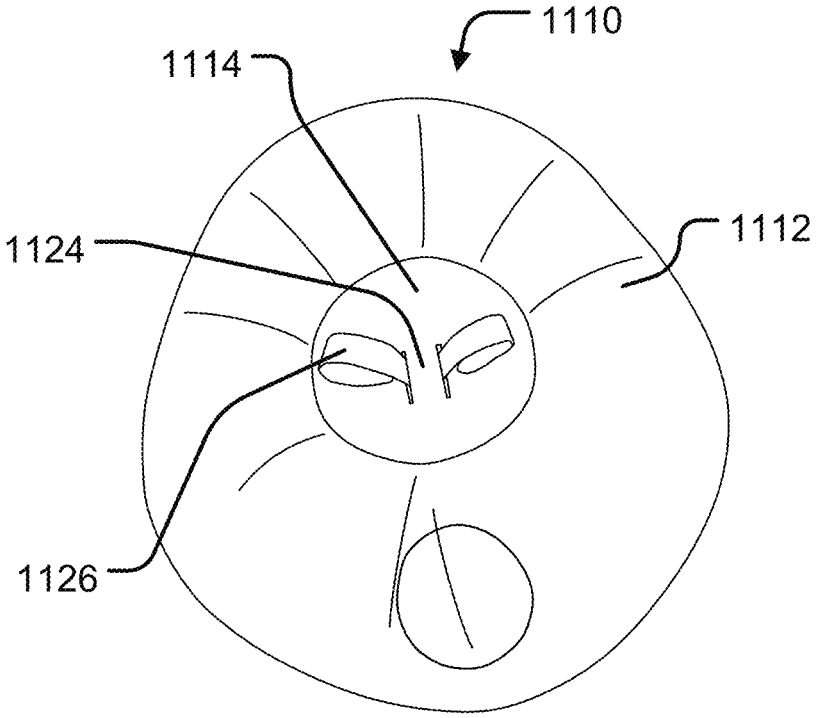
FIG. 48 is an image of the bottom of a storage device according to the twelfth embodiment of the disclosure.
Figure 49:
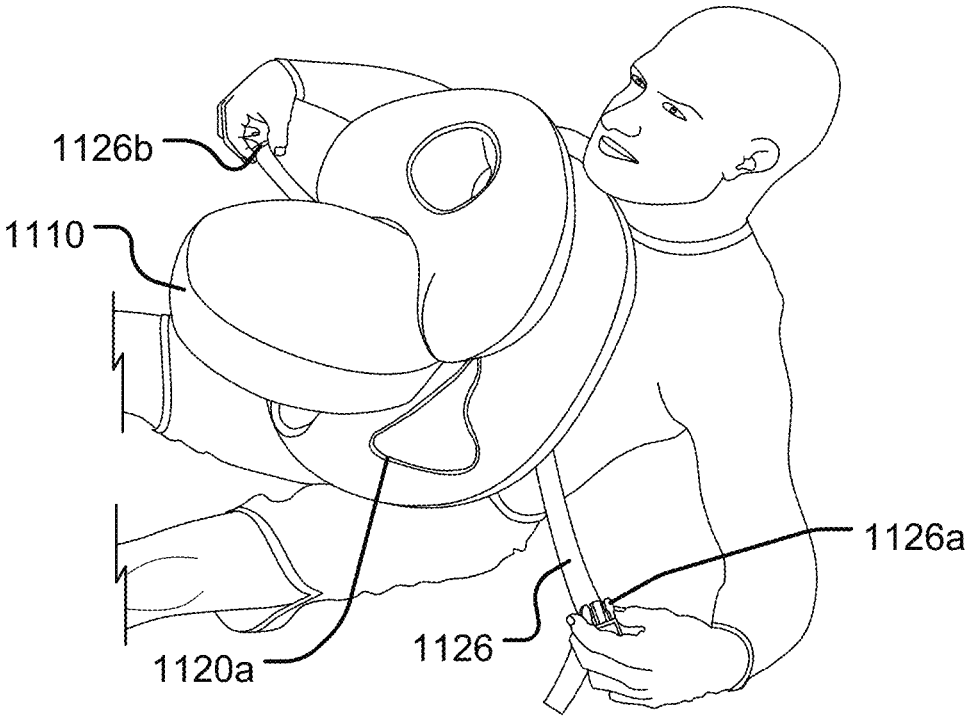
FIG. 49 shows the storage device according to the twelfth embodiment of the disclosure being worn as a personal flotation device.
Figure 50:
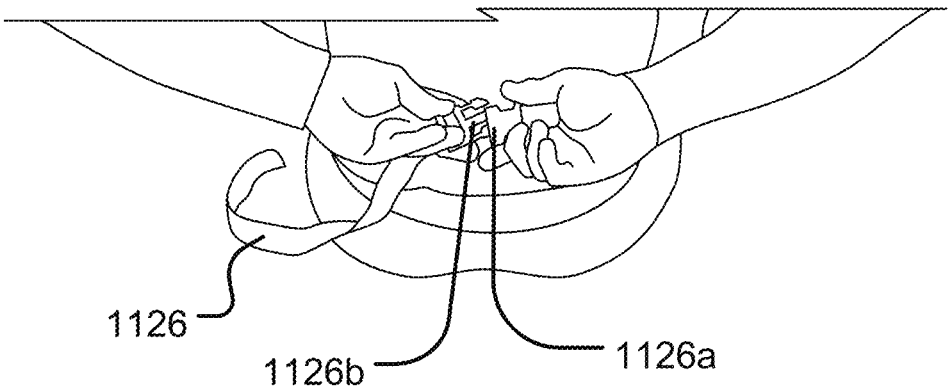
FIG. 50 shows the storage device according to the twelfth embodiment of the disclosure being worn as a personal flotation device.
Figure 51:
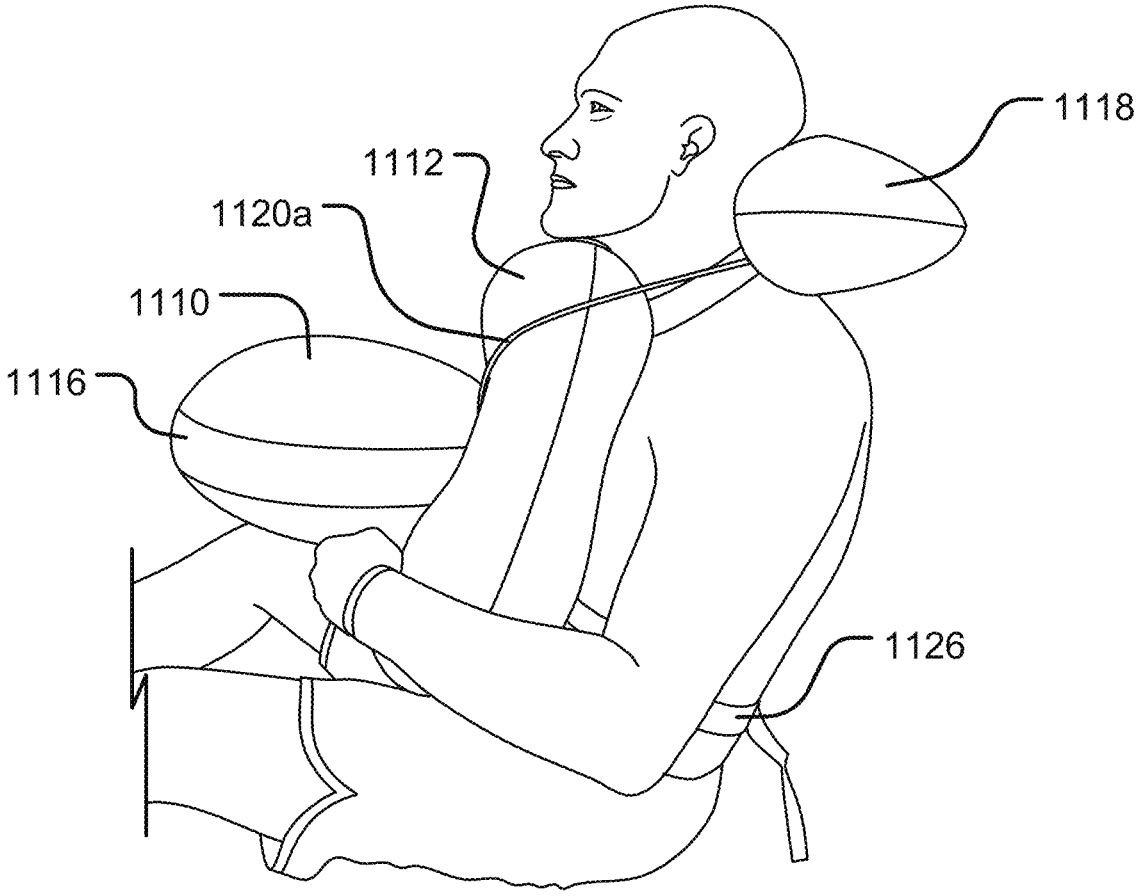
FIG. 51 shows the storage device according to the twelfth embodiment of the disclosure being worn as a personal flotation device.
Figure 52:
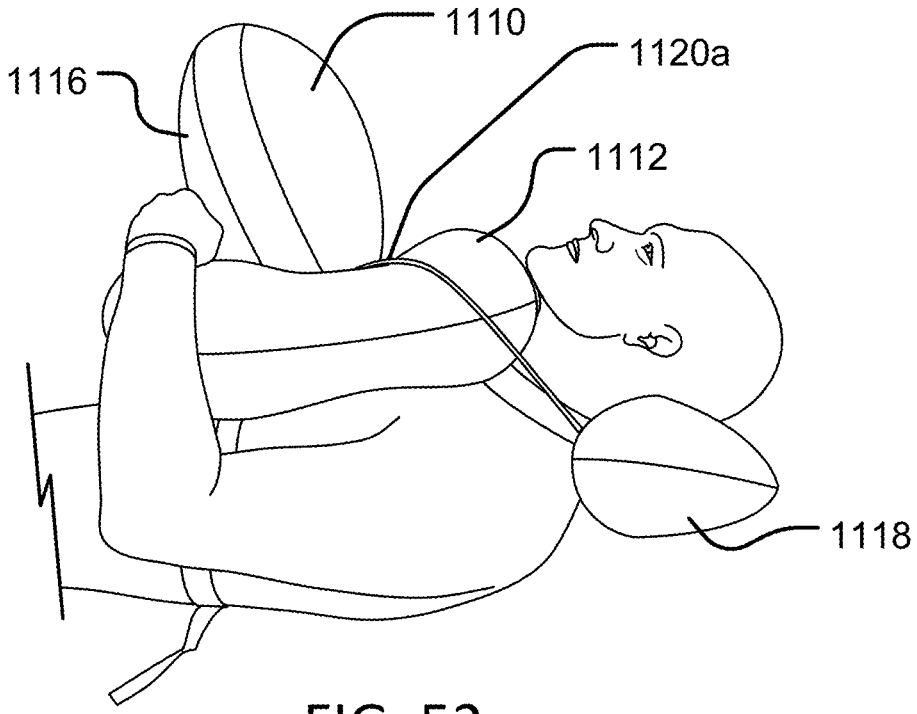
FIG. 52 shows the storage device according to the twelfth embodiment of the disclosure being worn as a personal flotation device.

Further, as shown in FIGS. 43-48, storage device 1110 also includes a torso strap 1126 for securing storage device 1110 to a user. Torso strap 1126 includes male and female side release buckles 1126*a*, 1126*b* which permit buckling torso strap 1126 around the torso of a user. As shown in FIG. 48, for example only and without limitation, torso strap 1126 may extend through securing loop 1124; however, it will be understood that torso strap 1126 may be affixed to storage device 1110 in any manner known in the art without departing from the scope of the disclosure. In various embodiments, for example, torso strap 1126 may comprise two separate straps affixed to storage device 1110 which may connect to one another to secure storage device 1110 to the user.

Additionally, torso strap 1126 may be rolled or tucked under storage device 1110 when in use as a storage device and attached to desired surfaces or objects so as to not interfere with the attachment or function of storage device 1110 as a storage device. When a user desires to use storage device 1110 as a personal flotation device, the user may unroll the torso strap 1126 and extend it around their torso and may buckle the side release buckles 1126*a*, 1126*b* to secure the storage device 1110 to their torso. While a torso strap is described for securing storage device 1110 to a user, it will be understood that any other device or method known in the art for securing flotation devices to a user may be used without departing from the scope of the disclosure.

Now with reference to FIGS. 49-52, storage device 1110 is shown being worn by a user for use as a personal flotation device. The user places inflatable base 1112 of storage device 1110 against their chest and grasps the ends of torso strap 1126. The user then brings the buckles 1126*a*, 1126*b* of the torso strap 1126 around to his or her back, where the user buckles the buckles 1126*a*, 1126*b*. The user may then place second inflatable member 1118 behind his or her head and adjusts tethers 1120*a*, 1120*b* so that second inflatable member 1118 rests comfortably behind the neck of the user and above the user's shoulders. The user can then float in the water with second inflatable member 1118 supporting the user's head and inflatable base 1112 providing flotation for the user's torso. Thus, the user can then be supported while floating from head through torso relatively effortlessly while the device is securely fitted around the user. It will be understood that in various embodiments, second inflatable member 1118 may not be removably affixed and may not be placed behind the user's head without departing from the scope of the disclosure. That is, storage device 1110 may still function as a personal flotation device even without second inflatable member 1118 being removably affixed and fitting behind a user's head.

It will be understood that in various embodiments, second inflatable member 1110 may be identical to second inflatable member 210, and tethers 1120*a*, 1120*b* may connect to buckles 218*d* on second inflatable member 210 and buckles 224*b* on base member 214.

Another embodiment of a storage device 1210 of the disclosure is illustrated in FIGS. 53-76 and is described below. Some features of one or more of storage device 1210, 1110, 1010, 910, 710, 610, 510, 410, 310, 210, 110, and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

As shown in FIGS. 53, 54, 55, 56, and 57, storage device 1210 includes an inflatable base 1212, a base member 1214, a first inflatable member 1216, and a second inflatable member 1218 which cooperate, when inflated, to form a population of storage areas. In various embodiments, for example only and without limitation, storage device 1210 may further include a second inflatable base 1213 affixed to inflatable base 1212, as will be described in greater detail below. Thus inflatable base 1212 can be considered the first inflatable base.

Inflatable base 1212 is an inflatable tube that is inner-tube or donut shaped. As shown, inflatable base 1212 may have a non-constant dimension. That is, inflatable base 1212 may have a smaller dimension (e.g., diameter) in the front of storage device 1210 and may expand to a larger dimension (e.g. diameter) toward the back of storage device 1210. This larger diameter toward the back of storage device 1210 provides improved aesthetics and adds support to the first inflatable member 1216 which increases the squeeze pressure on a paddle inserted between the first inflatable member 1216 and the second inflatable member 1218 as described elsewhere herein. In other embodiments, for example, inflatable base 1212 may have a substantially constant dimension (e.g. diameter) around its entire perimeter.

Figure 58:
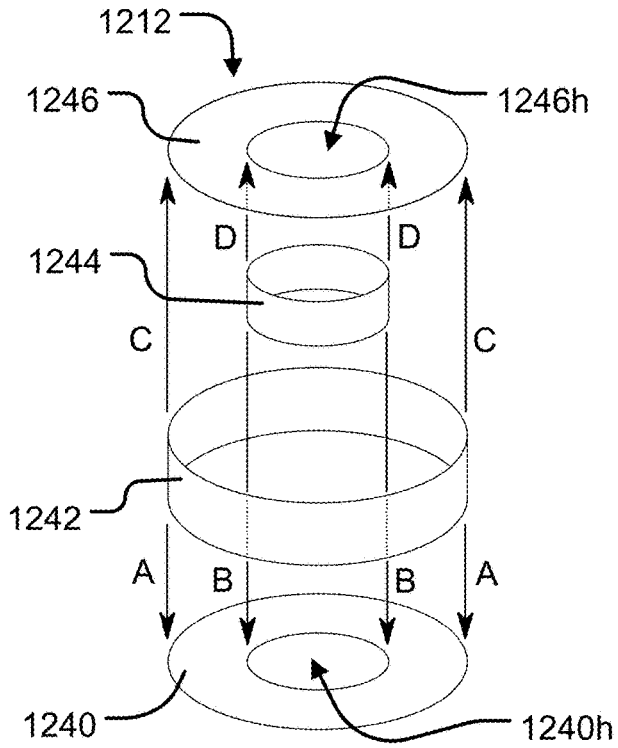
FIG. 58 is an isometric exploded view of an inflatable base of the storage device according to the thirteenth embodiment of the disclosure.
Figure 59:
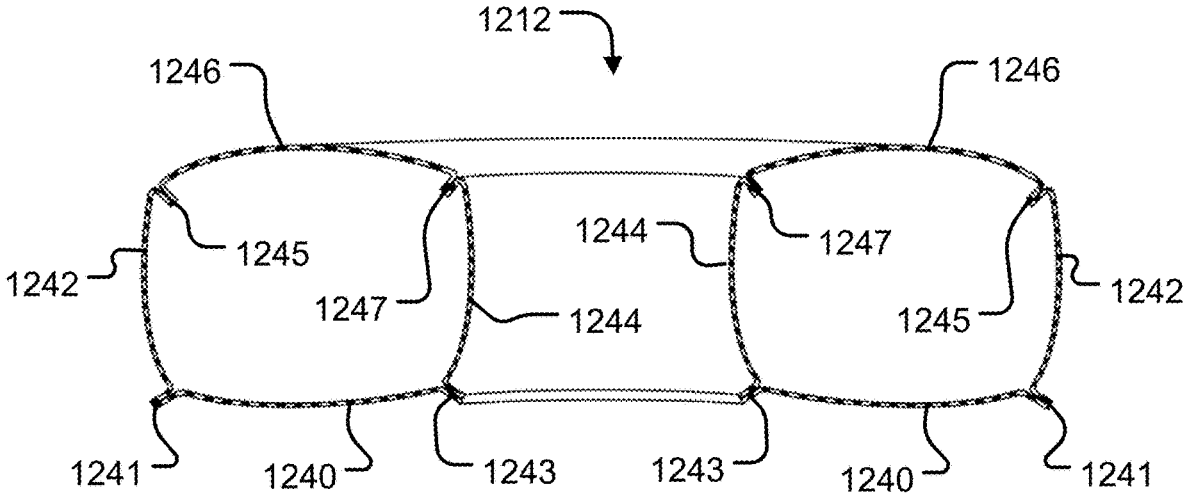
FIG. 59 is a cross-sectional view of the inflatable base of the storage device according to the thirteenth embodiment of the disclosure taken along line 57-57 of FIG. 55.

Now with reference to FIG. 58 (in exploded view with arrows A, B, C, and D showing cooperation of components of inflatable base 1212) and FIG. 59 (in cross-section) an embodiment of inflatable base 1212 is shown and described, where inflatable base 1212 is constructed of four individual sheets which are fused together to form inflatable base 1212. That is, in this embodiment, for example, inflatable base 1212 comprises a bottom sheet 1240, a top sheet 1246, an outer wall 1242, and an inner wall 1244. Bottom sheet 1240 forms the bottom of inflatable base 1212. Bottom sheet 1240 is shown as being donut or O-shaped, having a hole 1240*h* extending there through. The bottom end of outer wall 1242 is fused along the outer perimeter of bottom sheet 1240 to create bottom outer seam 1241. The bottom end of inner wall 1244 is fused along the perimeter of hole 1240*h* of bottom sheet 1240 to create bottom inner seam 1243. Top sheet 1246 forms the top of inflatable base 1212. Like bottom sheet 1240, top sheet 1246 is shown as being donut or O-shaped, having a hole 1246*h* extending there through. The top end of outer wall 1242 is fused along the outer perimeter of top sheet 1246 to create top outer seam 1245. The top end of inner wall 1244 is fused along the perimeter of hole 1246*h* of top sheet 1246 to create top inner seam 1247. Bottom sheet 1240, outer wall 1242, inner wall 1244 and top sheet 1246 are fused together in this manner to create inflatable base 1212 having within it a chamber which can hold air.

In some embodiments, for example only and without limitation, bottom outer seam 1241, bottom inner seam 1243, top outer seam 1245 and top inner seam 1247 may be fin seams. To enhance appearance and to provide a smooth outside to inflatable base 1212, inflatable base 1212 may be constructed such that top outer seam 1245 and top inner seam 1247 are inside inflatable base 1212. Bottom outer seam 1241 and bottom inner seam 1243 may be externally located so that other parts of storage device 1210 may be adhered to inflatable base 1212 as described below. However, in other embodiments, for example only and without limitation, bottom outer seam 1241 and bottom inner seam 1243 may be fin seams, while top outer seam 1245 and top inner seam 1247 may be lap seams. In other embodiments, for example only and without limitation, bottom outer seam 1241 and bottom inner seam 1243 may be lap seams, while top outer seam 1245 and top inner seam 1247 may be fin seams. In yet other embodiments, for example only and without limitation, bottom outer seam 1241, bottom inner seam 1243, top outer seam 1245 and top inner seam 1247 may be lap seams. In yet other embodiments, for example only and without limitation, bottom outer seam 1241, bottom inner seam 1243, top outer seam 1245 and top inner seam 1247 may be fin seams. It will be understood that other seam types may be used without departing from the scope of the disclosure.

While an inflatable base 1212 is described as being constructed of four individual sheets which are fused together to form inflatable base 1212, it will be understood that inflatable base 1212 may be constructed out of any number of individual sheets without departing from the scope of the disclosure. For example only and without limitation, in various embodiments, an inflatable base may be constructed of three individual sheets such as a bottom sheet, a top sheet, and an inner wall, wherein the outside of the bottom sheet and the top sheet are fused or adhered to one another. In such embodiments, the inner wall still provides structural integrity and the outer wall is not present. In yet other embodiments, for example only and without limitation, inflatable base may be constructed of five or more individual sheets. In other embodiments, for example only and without limitation, inflatable base may be constructed of one or two individual sheets. For example only and without limitation, a single sheet may be formed into an inner tube to form inflatable base.

Figure 57:
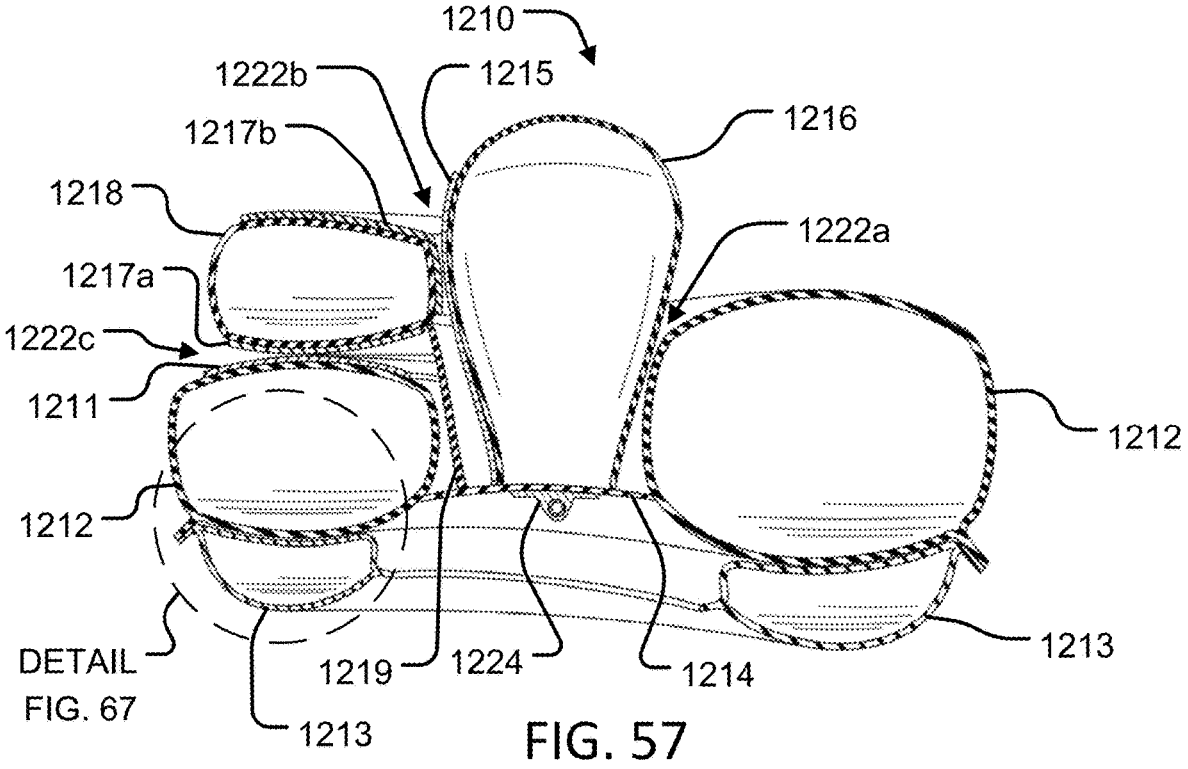
FIG. 57 is a cross-sectional view of the storage device according to the thirteenth embodiment of the disclosure taken along line 57-57 of FIG. 55.

A base member 1214 is affixed to the inside perimeter of inflatable base 1212 (see FIG. 57). That is, base member 1214 serves to close off the hole 1240*h* in bottom sheet 1240 of inflatable base 1212. Base member 1214 may comprise one or more sheets of material. Base member 1214 is fused to inner perimeter of hole 1240*h* in bottom sheet 1240 inflatable base 1212. Thus, where bottom inner seam 1243 is a fin seam, base member 1214 may be adhered or fused directly to bottom inner seam 1243. In other embodiments, for example, base member 1214 may be integrally formed with inflatable base 1212. That is, bottom sheet 1240 may not have a hole. In such embodiments, the bottom sheet also serves to function as base member 1214 and inner wall 1244 is fused to bottom sheet 1240.

Inner wall 1244 provides seam pressure relief otherwise directed to the seam of the base member 1214 around inner circumference of the main donut. Thus, this four part construction of inflatable base 1212 allows for increased durability of storage device 1210. Inner wall 1244 may be constant in height throughout inner perimeter of bottom sheet 1240 and top sheet 1246 and provides structural integrity to the functional workings of base member 1214 fused thereto, as well as structural integrity to the rest of the inflatable structures attached thereto.

Figure 60:
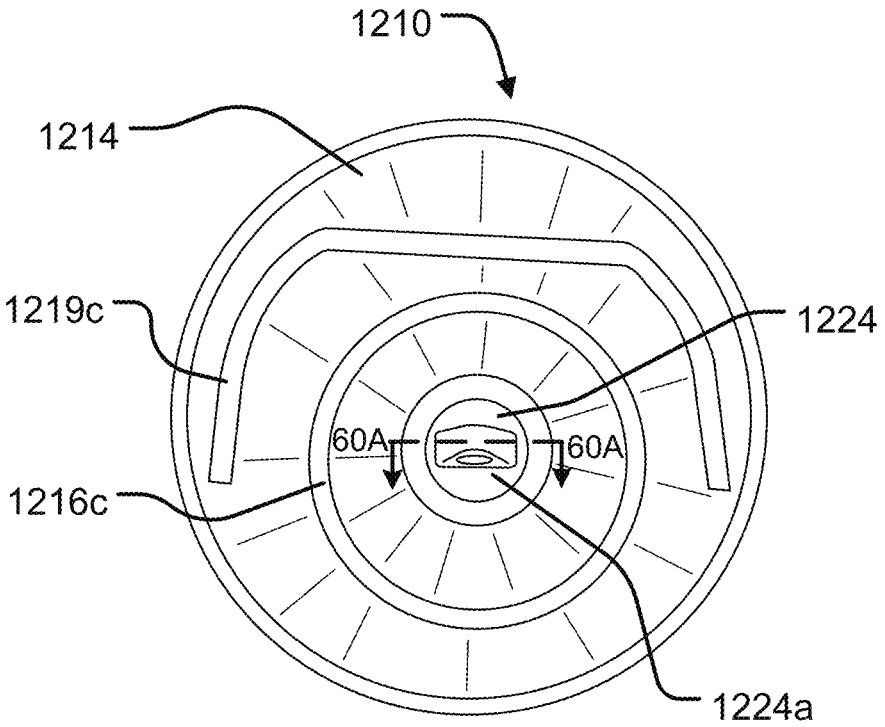
FIG. 60 is a bottom view of the storage device according to the thirteenth embodiment of the disclosure.

As shown, for example, in FIGS. 53, 54, 55, 56, and 57, affixed to base member 1214 and extending upward and outward from base member 1214 is first inflatable member 1216. First inflatable member 1216 is generally egg or light-bulb shaped with its narrow bottom end affixed to base member 1214 and its wider top end extending upward and above the top of inflatable base 1212. First inflatable member 1216 is adhered or fused to base member 1214. The narrow bottom end of first inflatable member 1216 is circular in shape and is fused along a circle 1216*c* to base member 1214 (as shown in FIG. 60). However, it will be understood that in other embodiments, first inflatable member 1216 may be releasably affixed to base member 1214 in a variety of ways, including but not limited to, buckles, straps, hook-and-loop style fasteners (e.g., Velcro®), any combination thereof, or in any manner known in the art.

Storage device 1210 further includes second inflatable member 1218. Second inflatable member 1218 is generally crescent moon shaped and is oriented generally parallel to inflatable base 1212. Second inflatable member 1218 is connected to base member 1214 by a sheet of material forming a curtain or wall 1219. A bottom end of curtain 1219 is adhered or fused to base member 1214 along a C-shaped line 1219*c* (see FIG. 60). A top end of curtain 1219 is adhered or fused to second inflatable member 1218 along the inner crescent moon shape of second inflatable member 1218. That is, curtain 1219 is adhered or fused to the side of second inflatable member 1218 proximate first inflatable member 1216. Thus, when viewed from above or below, curtain 1219 is C-shaped. Curtain 1219 therefore serves to fix second inflatable member 1218 to base member 1214. Additionally, curtain 1219 functions like a sleeve into which the blade of a paddle can be slid along. Because curtain 1219 is an additional layer of material between the blade of a paddle and inflatable base 1212, curtain 1219 also serves to protect inflatable base 1212 from damage or puncture from the blade of a paddle when the blade of the paddle is inserted or removed from storage device 1210.

Figure 61:
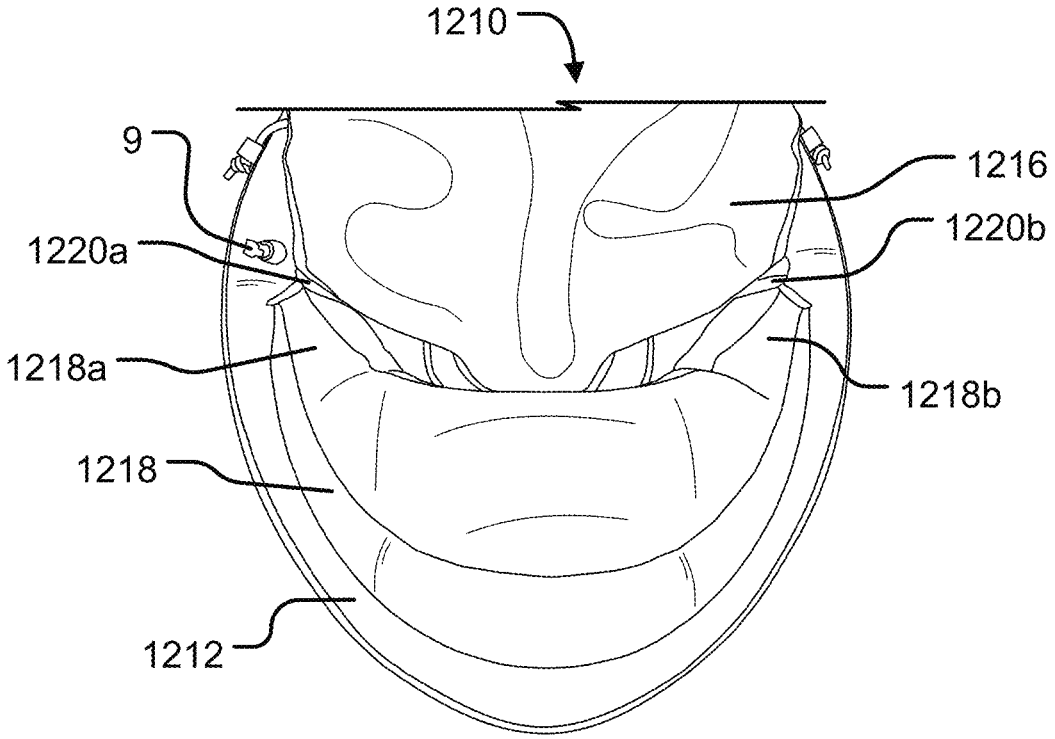
FIG. 61 is a top plan view of the storage device according to the thirteenth embodiment of the disclosure.
Figure 62:
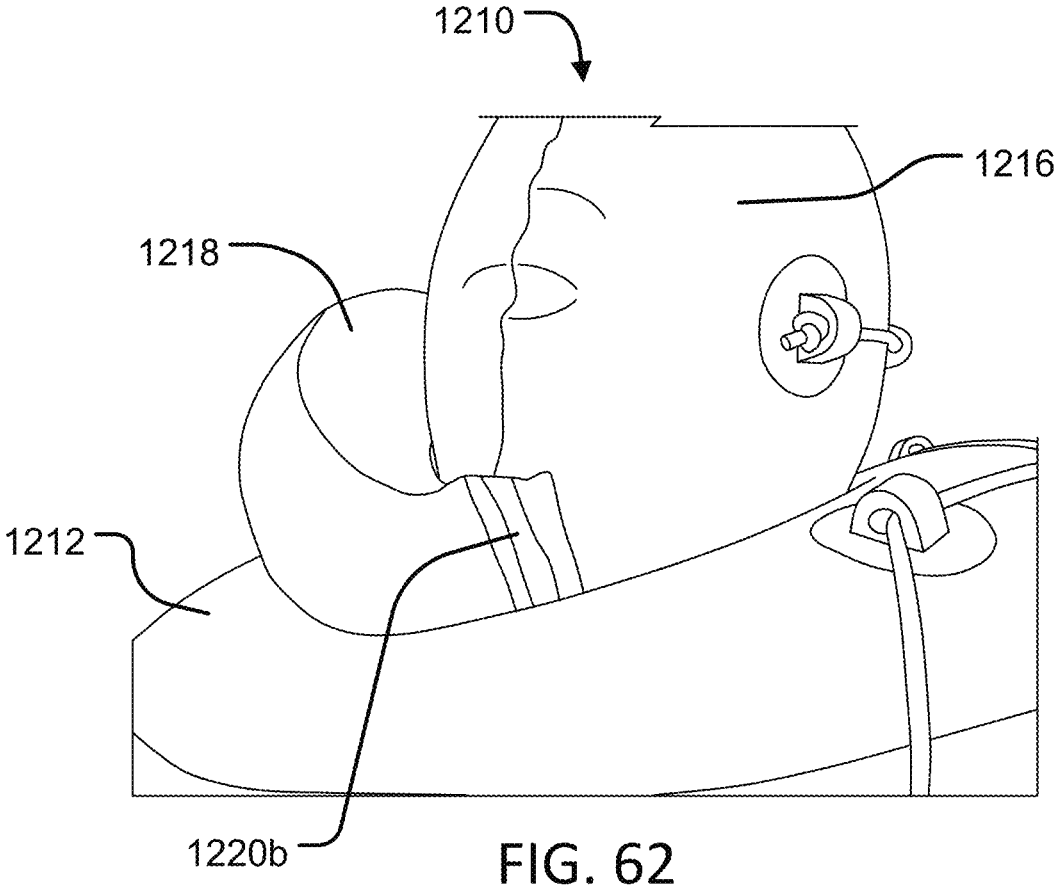
FIG. 62 is an image of the right side of the storage device according to the thirteenth embodiment of the disclosure.

As shown in FIGS. 61 and 62, second inflatable member 1218 may further include first and second ends 1218*a*, 1218*b* which are secured to first inflatable member 1216 by straps 1220*a*, 1220*b*. That is, second inflatable member 1218 is adhered or fused to straps 1220*a*, 1220*b*, and straps 1220*a*, 1220*b* are adhered or fused to first inflatable member 1216. In addition to securing second inflatable member 1218 to first inflatable member 1216, straps 1220*a*, 1220*b* aid in keeping the blade of a paddle in storage device 1210. That is, straps 1220*a*, 1220*b* may restrain the blade of the paddle from side-to-side motion, thereby reducing or eliminating the possibility of the paddle from falling to one side or the other.

Inflatable base 1212, first inflatable member 1216, second inflatable member 1218 and second inflatable base 1213 may each include an inflation valve 9 as known in the art for inflating inflatable objects. Thus inflatable base 1212, first inflatable member 1216, second inflatable member 1218 and second inflatable base 1213 are each independently inflatable. Inflatable base 1212, first inflatable member 1216, second inflatable member 1218, and second inflatable base 1213 may be inflated in a variety of ways, including but not limited to, manually by a user blowing air through the inflation valves 9, by a pump blowing air through the inflation valves 9, using compressed air to blow air through the inflation valves 9, etc. In various embodiments inflatable base 1212, first inflatable member 1216, second inflatable member 1218, and/or second inflatable base 1213 may be in fluid communication with one another. That is, air may travel freely between inflatable base 1212, first inflatable member 1216, second inflatable member 1218, and/or second inflatable base 1213. In such embodiments, storage device 1210 may have a single inflation valve 9 and inflatable base 1212, first inflatable member 1216, second inflatable member 1218, second inflatable base 1213 may all be inflated through that single inflation valve 9. Additionally, inflatable base 1212 can exist as its own separate inflatable member while first inflatable member 1216 and second inflatable member 1218 are in fluid communication with one another. That is, inflatable base 1212 has its own inflation valve 9 while first and second inflatable members 1216, 1218 share a single inflation valve 9. This combination of adjoining members can be applied to any combination of inflatable members herein. However, as described in greater detail below, second inflatable base 1213 may exist as its own separate inflatable member while inflatable base 1212, first inflatable member 1216 and second inflatable member 1218 are in fluid communication with one another. That is, second inflatable base 1213 has its own inflation valve 9 while inflatable base 1212, first inflatable member 1216 and second inflatable member 1218 share a single inflation valve 9.

When inflatable base 1212 and first inflatable member 1216 are inflated, first inflatable member 1216 makes contact with and presses up against at least a portion of the inner perimeter of inflatable base 1212. Additionally, when inflatable base 1212, first inflatable member 1216, and second inflatable member 1218 are inflated, the inner crescent portion of second inflatable member 1218 makes contact with and presses up against at least a portion of first inflatable member 1216 and bottom side of second inflatable member 1218 makes contact with and presses up against at least a portion of inflatable base 1212.

Figure 53:
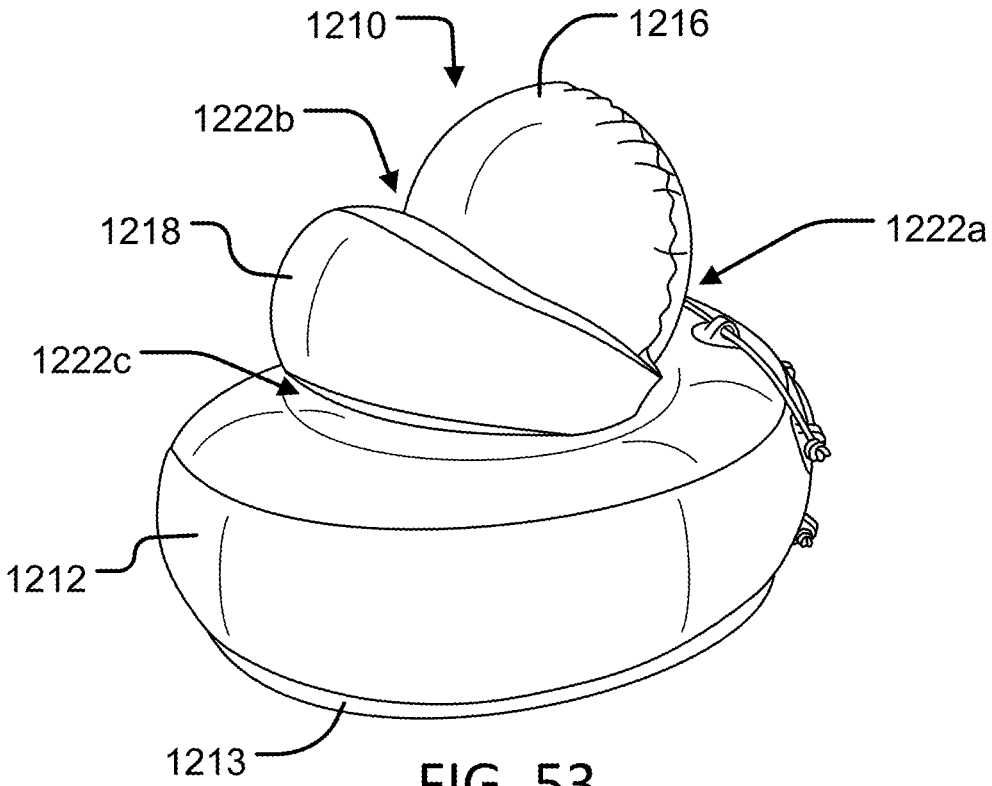
FIG. 53 is an isometric view of a storage device according to a thirteenth embodiment of the disclosure.
Figure 54:
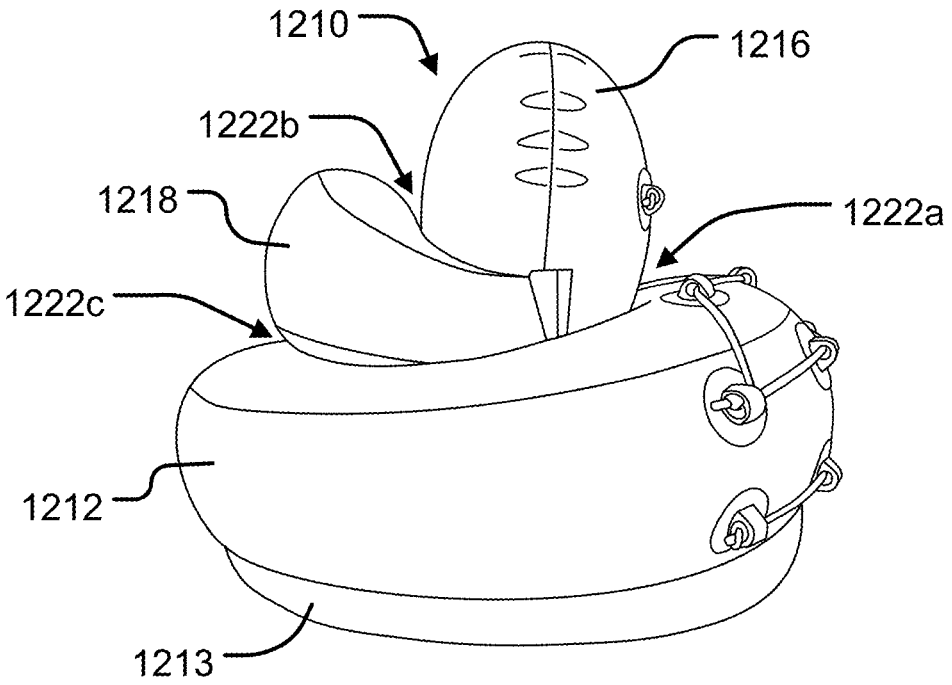
FIG. 54 is an image of the right side of the storage device according to the thirteenth embodiment of the disclosure.
Figure 55:
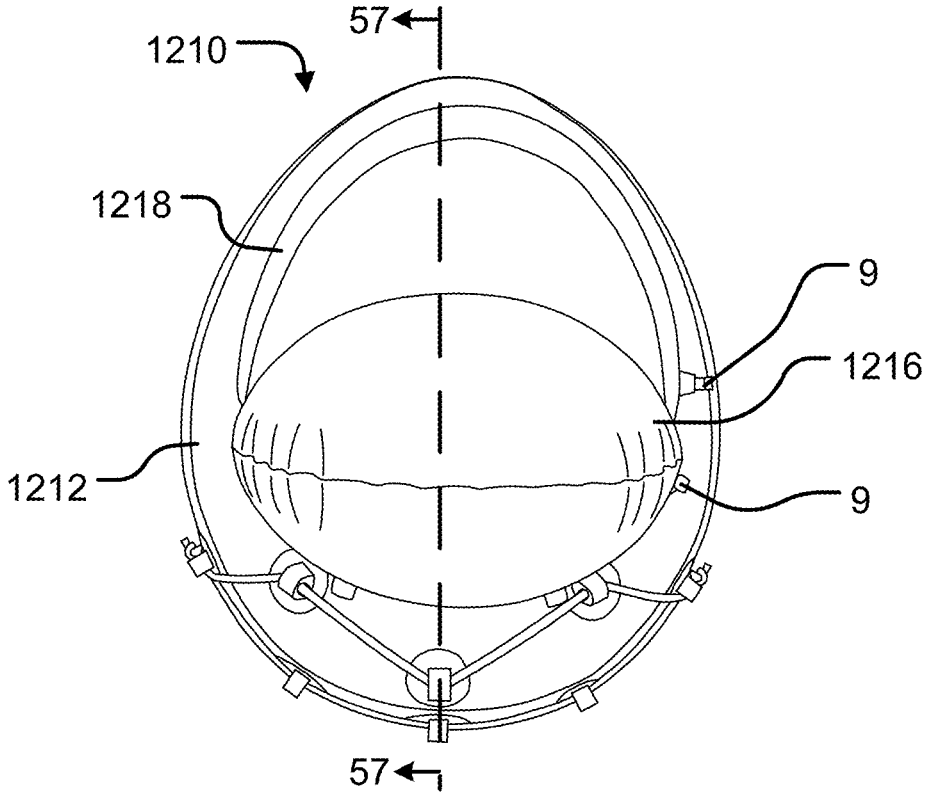
FIG. 55 is an image of the top of the storage device according to the thirteenth embodiment of the disclosure.
Figure 56:
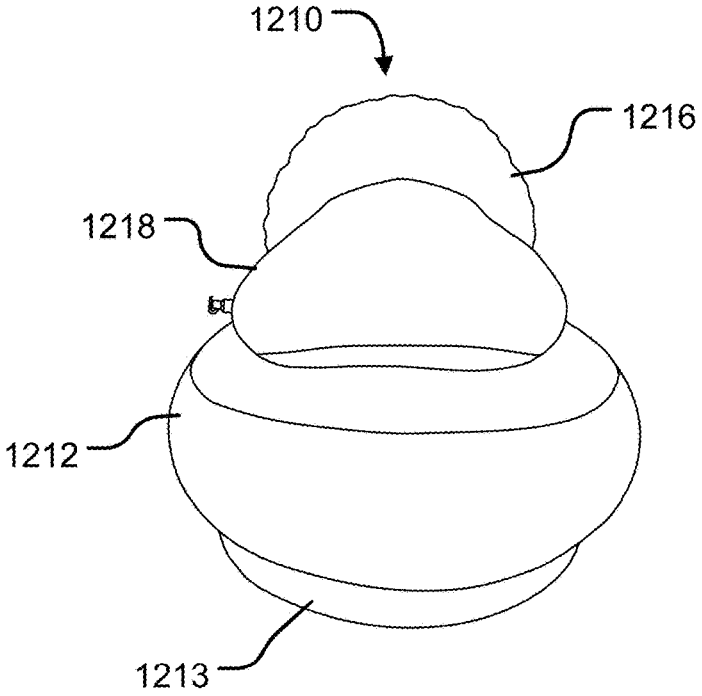
FIG. 56 is an image of the front of the storage device according to the thirteenth embodiment of the disclosure.

Now with reference to FIGS. 53, 54, and 57, the contact between first inflatable member 1216 and inflatable base 1212 forms a first storage area 1222*a* into which objects can be inserted. Because inflatable base 1212 and first inflatable member 1216 are inflated and press against one another, any object inserted into first storage area 1222*a* between inflatable base 1212 and first inflatable member 1216 is held in place by the force exerted on the object by inflatable base 1212 and first inflatable member 1216. That is, the object is sandwiched between inflatable base 1212 and first inflatable member 1216.

Additionally, the contact between first inflatable member 1216 and second inflatable member 1218 forms a second storage area 1222*b* into which objects can be inserted. Because first inflatable member 1216 and second inflatable member 1218 are inflated and press against one another, any object inserted into second storage area 1222*b* between first inflatable member 1216 and second inflatable member 1218 is held in place by the force exerted on the object by first inflatable member 1216 and second inflatable member 1218. That is, the object is sandwiched between first inflatable member 1216 and second inflatable member 1218. For example, the tip of a paddle may be inserted into second storage area 1222*b* and slid downward until the tip is proximate to or touches base member 1214. At least a portion of the blade of the paddle is then held in second storage area 1222*b*. Because of the force exerted on the tip and blade of the paddle by first inflatable member 1216 and second inflatable member 1218, paddle 2 may be securely retained in a generally vertical orientation in storage device 1210.

The simple and rapid storage option provided by second storage area 1222*b* provides the user with the ability to engage in a variety of activities on a standup paddleboard, including but not limited to, functional fitness exercises involving use of both hands and recreational activities such as fishing, diving, sitting, lying down and other actions where secure storage of hand held paddles would be advantageous to the user.

Furthermore, the contact between second inflatable member 1218 and inflatable base 1212 forms a third storage area 1222*c* into which objects can be inserted. Because second inflatable member 1218 and inflatable base 1212 are inflated and press against one another, any object inserted into third storage area 1222*c* between second inflatable member 1218 and inflatable base 1212 is held in place by the force exerted on the object by second inflatable member 1218 and inflatable base 1212. That is, the object is sandwiched between second inflatable member 1218 and inflatable base 1212. The simple and rapid storage option provided by third storage area 1222*c* provides the user with the ability to engage in a variety of activities on a standup paddleboard, including but not limited to, functional fitness exercises involving use of both hands and recreational activities such as fishing, diving, sitting, lying down and other actions where secure storage of hand held paddles would be advantageous to the user.

In some embodiments, for example only, there is no contact between inflatable base 1212, first inflatable member 1216, and/or second inflatable member 1218 when inflatable base 1212, first inflatable member 1216, and/or second inflatable member 1218 are inflated. Thus inflatable base 1212, first inflatable member 1216, and second inflatable member 1218, by their close proximity to one another, cooperate to form storage areas 1222*a*, 1222*b*, 1222*c*.

Further, with specific reference again to FIG. 57, storage device 1210 may optionally include one or more protective layers proximate storage areas 1222*a*, 1222*b*, 1222*c* in order to protect inflatable base 1212, first inflatable member 1216 and second inflatable member 1218 from damage or puncture from objects placed in storage areas 1222*a*, 1222*b*, 1222*c*. Thus, inflatable base 1212 may optionally further include protective layer 1211 adhered or fused to the top side of inflatable base 1212 below where second inflatable member 1218 is located. Protective layer 1211 is proximate storage area 1222*c*. Additionally, second inflatable member 1218 may further optionally include protective layer 1217*a* adhered or fused to the bottom side of second inflatable member 1218 above where inflatable base 1212 is located. Protective layer 1217*a* faces protective layer 1211, and is proximate storage area 1222*c*. Further, second inflatable member 1218 may also optionally include protective layer 1217*b* adhered or fused to the top and inner crescent moon shape of second inflatable member 1218. The portion of protective layer 1217*b* that is adhered or fused to the inner crescent moon shape of second inflatable member 1218 is proximate storage area 1222*b*. Additionally, first inflatable member 1216 may further optionally include protective layer 1215 adhered or fused to the side of first inflatable member 1216 facing second inflatable member 1218. Protective layer 1215 may extend from at or near the bottom of first inflatable member 1216 to above second inflatable member 1218. Therefore, protective layer 1215 faces at least a portion of protective layer 1218*b*, and is proximate storage area 1222*b*.

Protective layer 1211 provides an additional layer of material between inflatable base 1212 and an object (e.g., the blade of a paddle) inserted into storage area 1222*c*, and therefore serves to protect inflatable base 1212 from damage or puncture from the object when the object is inserted into, removed from and/or stored in storage area 1222*c* of storage device 1210. Likewise, protective layer 1217*a* provides an additional layer of material between second inflatable member 1218 and an object (e.g., the blade of a paddle) inserted into storage area 1222*c*, and therefore serves to protect second inflatable member 1218 from damage or puncture from the object when the object is inserted into, removed from and/or stored in storage area 1222*c* of storage device 1210. Likewise, protective layer 1217*b* provides an additional layer of material between second inflatable member 1218 and an object (e.g., the blade of a paddle) inserted into storage area 1222*b*, and therefore serves to protect second inflatable member 1218 from damage or puncture from the object when the object is inserted into, removed from and/or stored in storage area 1222*b* of storage device 1210. Likewise, protective layer 1215 provides an additional layer of material between first inflatable member 1216 and an object (e.g., the blade of a paddle) inserted into storage area 1222*b*, and therefore serves to protect first inflatable member 1216 from damage or puncture from the object when the object is inserted into, removed from and/or stored in storage area 1222*b* of storage device 1210.

Figure 57A:
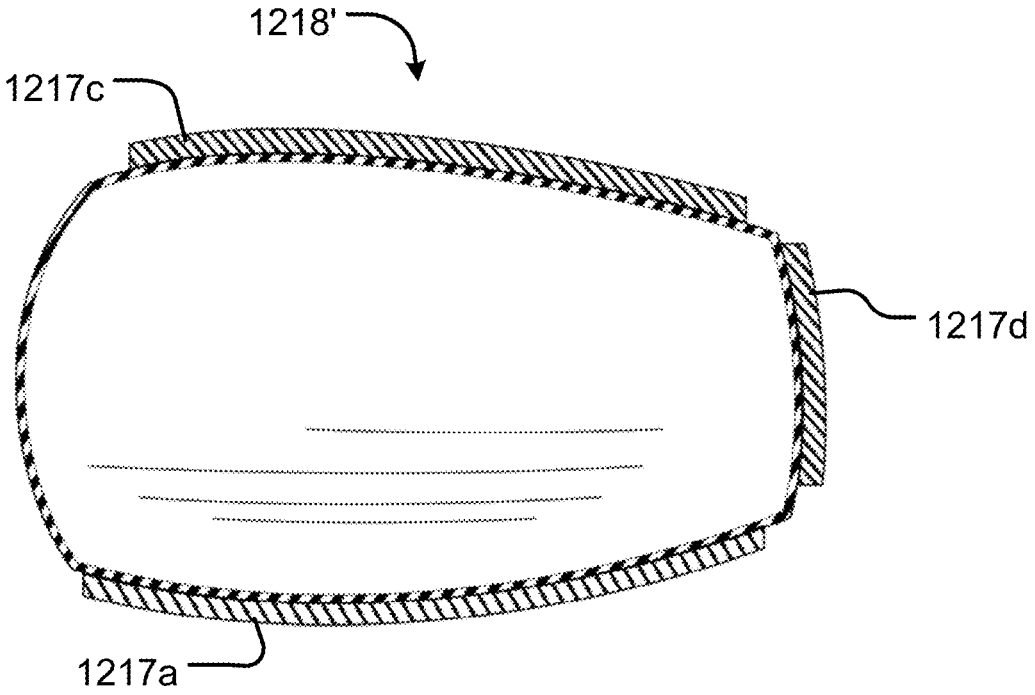
FIG. 57A is a cross-sectional view of the second inflatable member of the storage device according to the thirteenth embodiment of the disclosure taken along line 57-57 of FIG. 55.
Figure 57B:
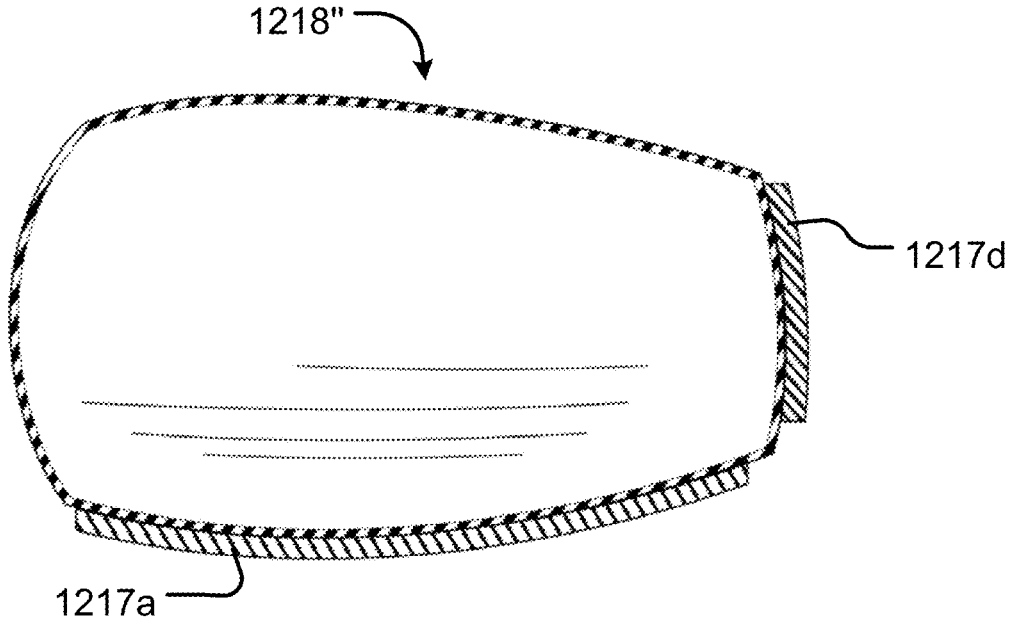
FIG. 57B is a cross-sectional view of the second inflatable member of the storage device according to the thirteenth embodiment of the disclosure taken along line 57-57 of FIG. 55.

In other embodiments, for example only and without limitation, as shown in FIG. 57A, second inflatable member 1218' may optionally include protective layers 1217*c* and 1217*d* instead of protective layer 1217*b*. Protective layer 1217*c* may be adhered or fused to the top of second inflatable member 1218'. Protective layer 1217*d* may be adhered or fused to the inner crescent moon shape of second inflatable member 1218'. In yet other embodiments, for example only and without limitation, as shown in FIG. 57B, second inflatable member 1218" may optionally include protective layer 1217*d* adhered or fused to the inner crescent moon shape of second inflatable member 1218".

Although not shown, it will be understood that additional protective layers may be provided on the sides of first inflatable member 1216 and inflatable base 1213 that face one another and therefore would serve to protect first inflatable member 1216 and inflatable base 1213 from damage or puncture from an object inserted into, removed from and/or stored in storage area 1222*a* of storage device 1210.

For example only and without limitation, inflatable base 1212, first inflatable member 1216, and second inflatable member 1218 may be constructed of 0.55 mil PVC and protective layers 1211, 1215, 1218*a* and 1218*b*, may also be constructed of 0.55 mil PVC.

Figure 60A:
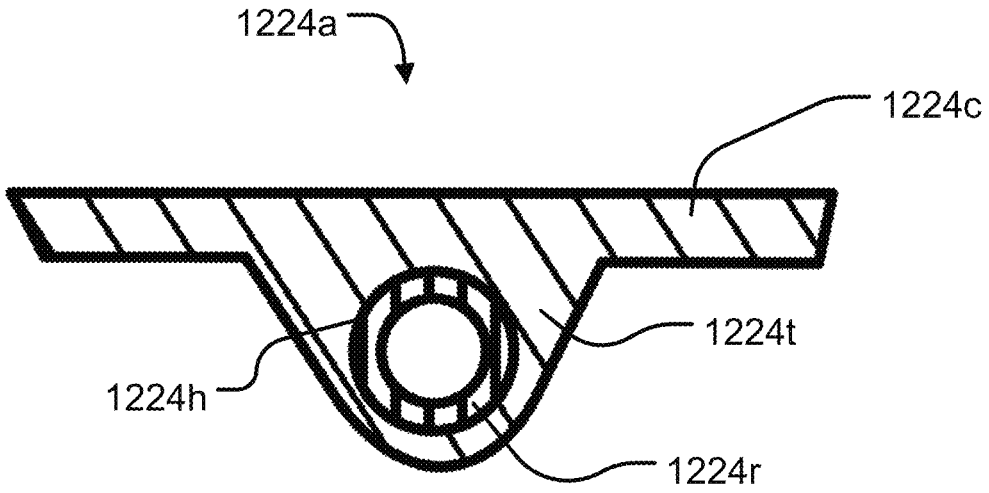
FIG. 60A is a cross-sectional view of a rope tie which may be used in various embodiments of the disclosure taken along line 60A-60A of FIG. 60.
Figure 65:
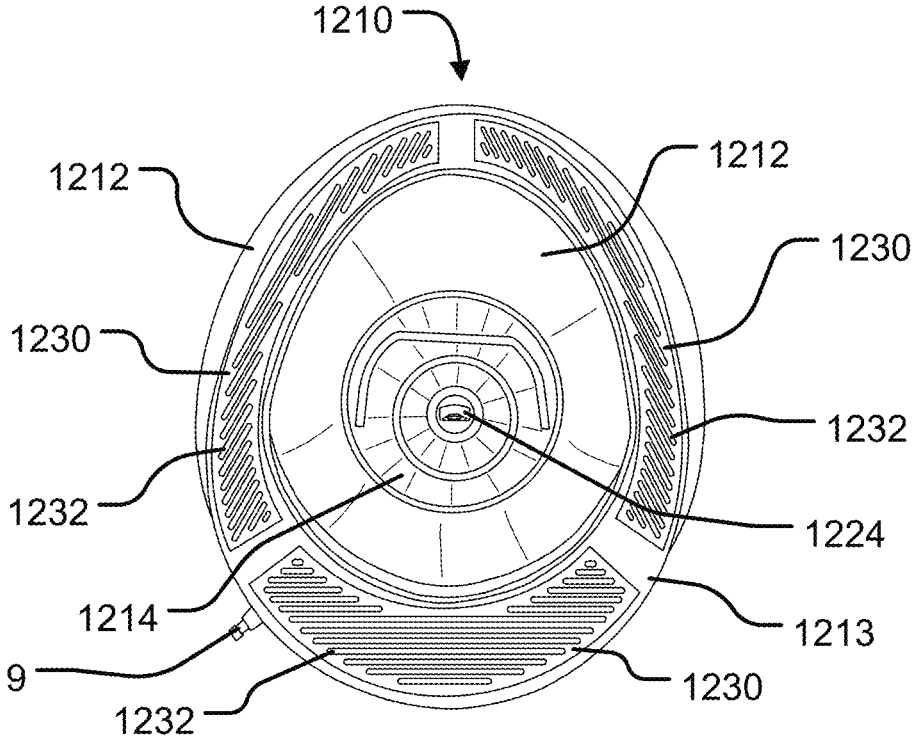
FIG. 65 is a bottom view of the storage device according to the thirteenth embodiment of the disclosure.
Figure 66:
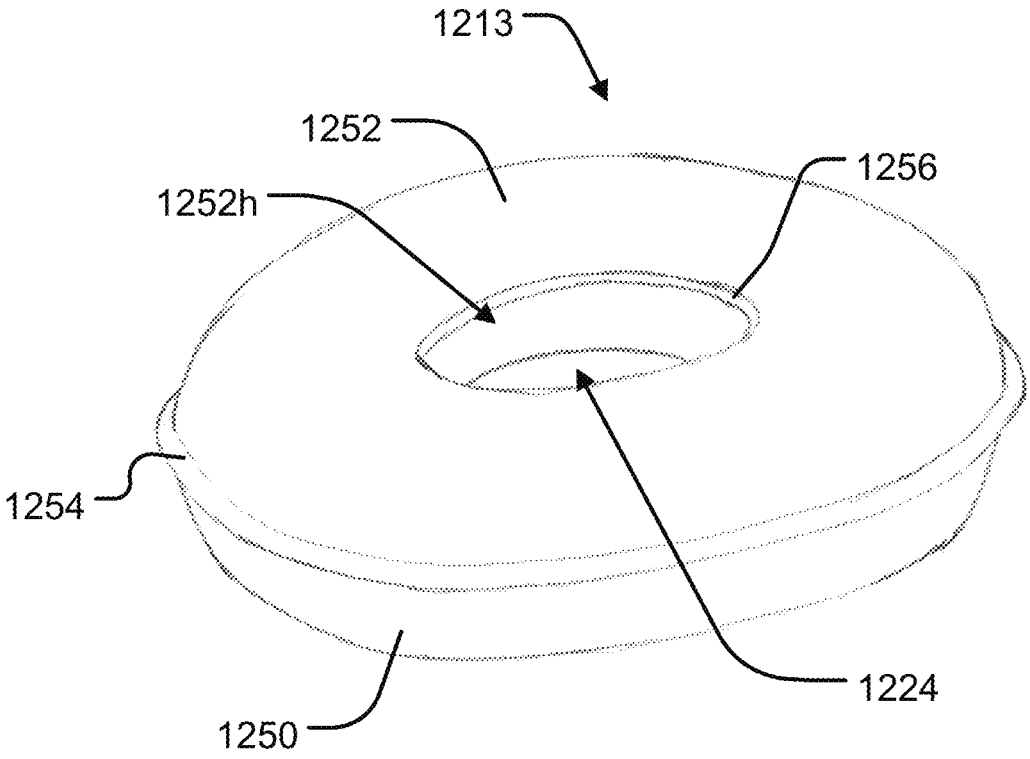
FIG. 66 is an isometric view of a second inflatable base of the storage device according to the thirteenth embodiment of the disclosure.

Now with reference to FIGS. 57, 60 and 65, the underside of storage device 1210 is shown. Storage device 1210 includes securing device 1224 adhered or fused to the bottom of base member 1214. As shown, for example only and without limitation, securing device 1224 may comprise a rope tie 1224*a* that is concentrically located within the fuse location for first inflatable member 1216. For example only and without limitation, rope tie 1224*a* is a typical rope tie often used on inflatable recreational inner tubes and inflatable boats and rafts. With reference to FIGS. 57, 60, and 60A, rope tie 1224*a* includes a triangular shaped body 1224*t* which is integrally formed with a circular base 1224*c*. The circular base 1224*c* is adhered or fused to the bottom of base member 1214. Near the apex of the triangular shaped body of rope tie 1224*a* is a hole 1224*h* which extends through the triangular shaped body 1224*t*. In some embodiments, for example only and without limitation, rope tie 1224*a* may optionally include a reinforcement collar 1224*r* inside hole 1224*h*, which can reduce or eliminate hole 1224*h* from breaking and opening. In various embodiments, for example, straps, hooks, suction cups or the like may engage with the hole in rope tie 1224*a* to retain storage device 1210 on a paddleboard, or other surface or object. While the body 1224*t* of rope tie 1224*a* is described as triangular shaped, it will be understood that any shape body may be used without departing from the scope of the disclosure.

Figure 63:
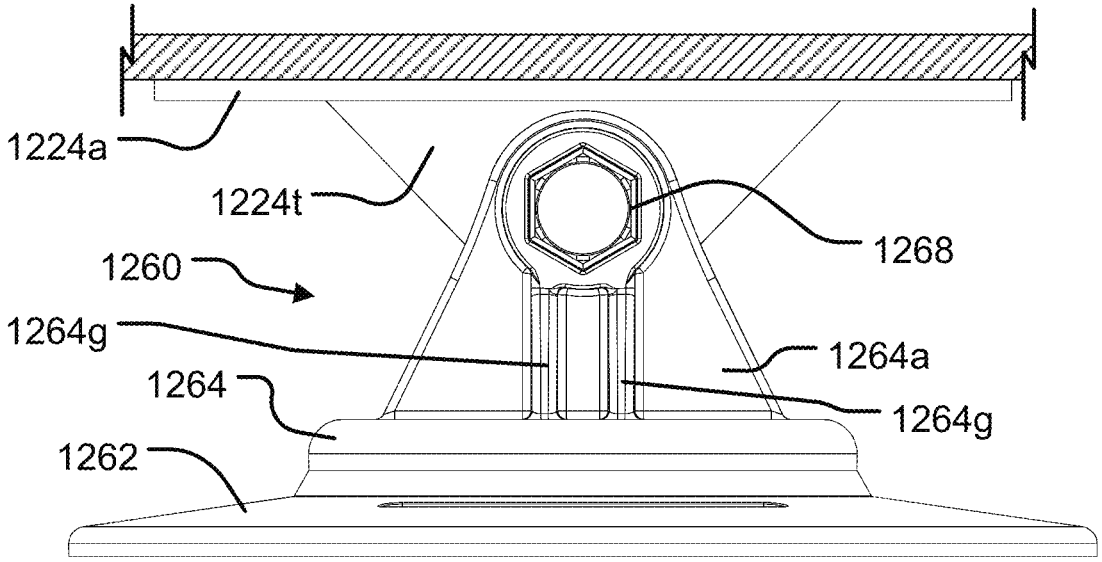
FIG. 63 is side view of a mounting assembly which may be used with various embodiments of the disclosure.
Figure 63A:
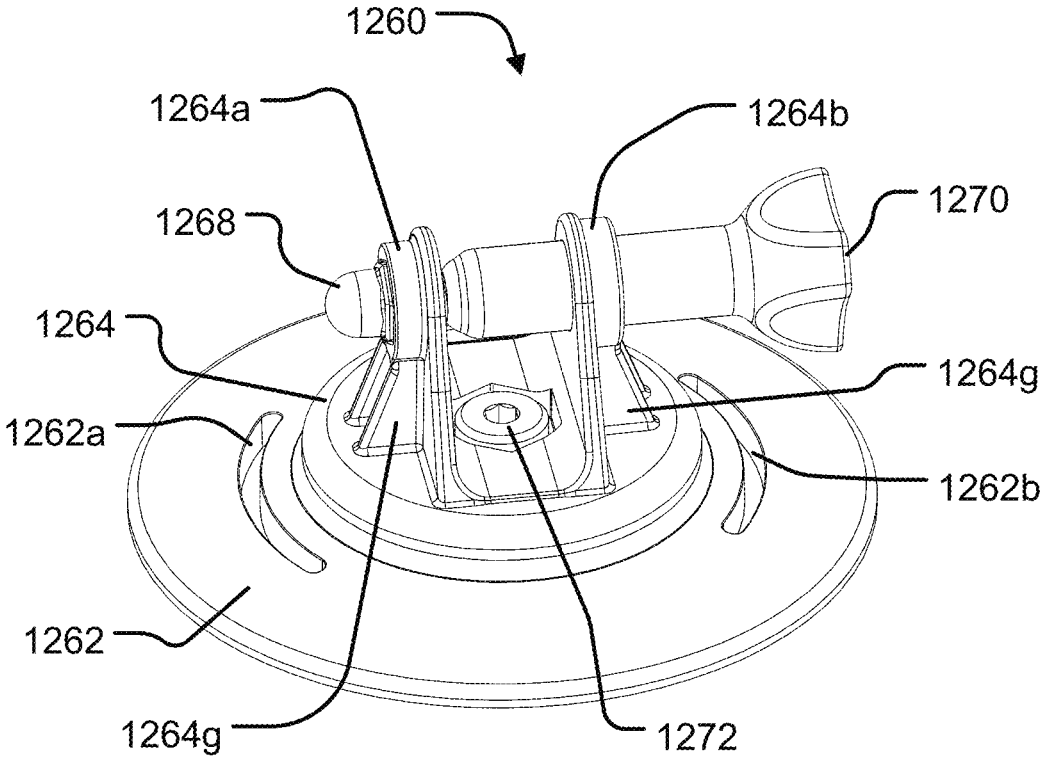
FIG. 63A is an isometric view of a mounting assembly which may be used with various embodiments of the disclosure.
Figure 64:
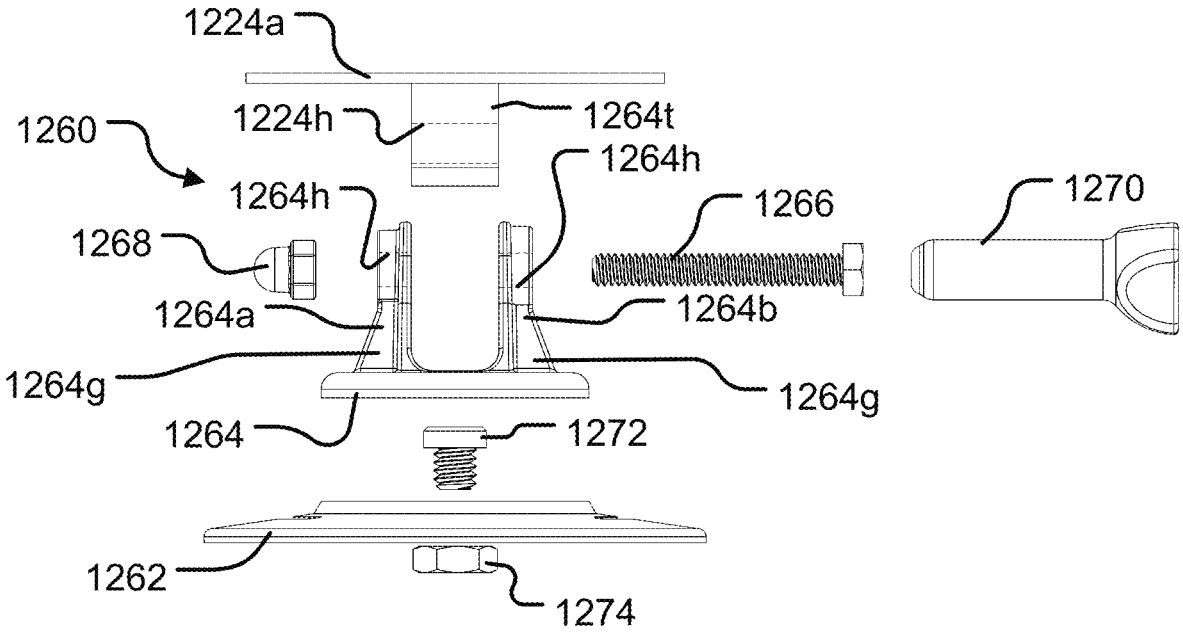
FIG. 64 is an exploded front view of a mounting assembly which may be used with various embodiments of the disclosure.

Now with reference to FIGS. 63, 63A and 64, a mounting assembly 1260 which may be used to mount storage device 1210 to a surface (e.g., paddleboard) is shown and described. Mounting assembly 1260 receives and secures to securing device 1224 on storage device 1210. In particular, mounting assembly 1260 receives and secures to rope tie 1224*a*. Mounting assembly 1260 comprises a base mount 1262 to which a u-shaped receiver 1264 is mounted thereto. U-shaped receiver 1264 comprises two flanges 1264*a*, 1264*b* which are integrally formed with and extend from receiver base 1264*b*. The two flanges 1264*a*, 1264*b* are spaced apart at a distance to receive the body 1224*t* of rope tie 1224*a*. Each of the two flanges 1264*a*, 1264*b* include a hole 1264*h* through which bolt 1266 may extend. When rope tie 1224*a* is inserted into u-shaped receiver 1264 and the hole 1224*h* of rope tie 1224*a* is aligned with holes 1264*h* of flanges 1264*a*, 1264*b*, bolt 1266 may be extended through holes 1264*h* and 1224*h* and is screwed into nut 1268 to secure rope tie 1224*a* to u-shaped receiver 1264. U-shaped receiver 1264 may further include a thumb screw 1270 which can ease or facilitate tightening of bolt 1266 by hand without requiring tools. Flanges 1264*a*, 1264*b* may be reinforced with one or more gussets or braces 1264*g* to strengthen u-shaped receiver 1264 and to reduce or eliminate movement or deflection of flanges 1264*a*, 1264*b*. Additionally, where nut 1268 includes a hex head, flange 1264*a* may include a corresponding hex-shaped recess to receive the hex head of nut 1268. This further facilitates tightening of bolt 1266 by hand without the need for tools.

U-shaped receiver 1264 is shown as being mounted to base mount 1262 via bolt 1272 and nut 1274; however, it will be understood that in other embodiments, for example only and without limitation, that u-shaped receiver 1264 may be mounted to base mount 1262 in a variety of ways as known in the art without departing from the scope of the disclosure. In yet other embodiments, for example only and without limitation, u-shaped receiver 1264 may be integrally formed with base mount 1262.

As shown in FIG. 63A, base mount 1262 may include a population of slots 1262*a*, 1262*b* which may facilitate securing mounting assembly 1260 to an object. Base mount 1262 is shown as having two elongated slots 1262*a*, 1262*b* which are curved; however, it will be understood that in other embodiments, for example only and without limitation, that any number or shape of slots may be included without departing from the scope of the disclosure. Slots 1262*a*, 1262*b* permit a strap (see, e.g., securing strap 26 in FIGS. 3, 5, 9, 9A, 42 or strap 1026 in FIG. 42 (with or without buckle 1026*b*)) to be extended there through for securing mounting assembly 1260 to an object (e.g., paddleboard 1). That is, for example only and without limitation, a securing strap may be threaded through slot 1262*a* from the top side of base mount 1262 to the bottom side of base mount 1262 (below u-shaped mount 1264) and then through slot 1262*b* from the bottom side of base mount 1262 to the top side of base mount 1262. Securing strap is then secured around a paddleboard to secure mounting assembly 1260 to the paddleboard. The curvature of slots 1262*a*, 1262*b* reduces or eliminates the ability of mounting assembly 1260 to slide along the securing strap and the paddleboard. That is, the curvature of slots 1262*a*, 1262*b* reduces or eliminates slippage of the mounting assembly on securing strap and paddleboard.

In other embodiments, mounting assembly 1260 may be secured to an object (e.g., paddleboard 1) via double sided tape, glue, a suction cup or other securing methods known in the art. In particular embodiments, for example only and without limitation, mounting assembly 1260 may be secured to an object (e.g., paddleboard 1) using double sided bonding tape sold by 3M which can adhere to fiberglass, polyvinyl chloride (PVC), and/or other plastics and rubbers and withstand exposure to fresh and salt water.

Mounting assembly 1260 provides a simple and secure way to attach storage device 1210 to an object. For example, it allows for tool free attachment of storage device 1210 to a paddleboard 1. Although, mounting assembly 1260 is shown and described in conjunction with storage device 1210, it will be understood that mounting assembly 1260 may be used with any embodiment of storage devices and inflatable devices described herein without departing from the scope of the disclosure.

As mentioned above, and as shown in FIG. 65, in various embodiments for example, storage device 1210 may further include a second inflatable base 1213 affixed to inflatable base 1212. Second inflatable base 1213 may be adhered or fused to the bottom of inflatable base 1212. Inflating second inflatable base 1213 may provide additional stability to storage device 1210 on a paddleboard by further increasing the tension force acting on base member 1214 and inflatable base 1212 at the securing device 1224. Inflating second inflatable base 1213, thus, in turn, forces inflatable base 1212 and the perimeter of bottom member 1214 further upward away from the paddleboard, or other surface or object to which storage device 1210 is attached.

As shown in FIG. 65, second inflatable base 1213 may include one or more slip-resistant or anti-slip panels 1230 adhered or fused to the bottom thereof which may reduce or eliminate the ability of storage device 1210 to slip, skid, slide or otherwise move on the structure or object to which it is mounted. For example only and with limitation, storage device 1210 is shown with three slip-resistant or anti-slip panels 1230; however, it will be understood that fewer or greater slip-resistant or anti-slip panels 1230 may be included without departing from the scope of the disclosure. For example, when storage device 1210 is mounted on a paddleboard 1, slip-resistant panels 1230 may reduce or prevent storage device from slipping on the paddleboard 1 even after the paddleboard is wet. For example only and without limitation, slip-resistant panels 1230 may be constructed of about 1.0 mil thickness PVC material. As shown, the slip-resistant panels 1230 may include a population of ribs 1232 which increase the slip-resistant or anti-slip properties of the panels 1230. It will be understood that other materials and or patterns with slip-resistant or anti-slip properties may be used without departing from the scope of the disclosure.

Referring now to FIGS. 57, 65-72, an embodiment of second inflatable base 1213 is described in greater detail. Second inflatable base 1213 may be an inflatable tube that is inner-tube or donut shaped and may be constructed of a bottom sheet 1250 which is adhered or fused to a top sheet 1252. Bottom sheet 1250 is shown as being donut or O-shaped, having a hole 1250*h* extending there through. Top sheet 1252 is shown as being donut or O-shaped, having a hole 1252*h* extending there through. The outer perimeters of bottom sheet 1250 and top sheet 1252 are adhered or fused together to create outer seam 1254. Outer seam 1254 may be a fin seam. The inner perimeters of hole 1250*h* of bottom sheet 1250 and hole 1252*h* of top sheet 1252 are adhered or fused together to create inner seam 1256. Inner seam 1256 may be a lap seam, a fin seam, or any other type of seam known in the art.

Figure 67:
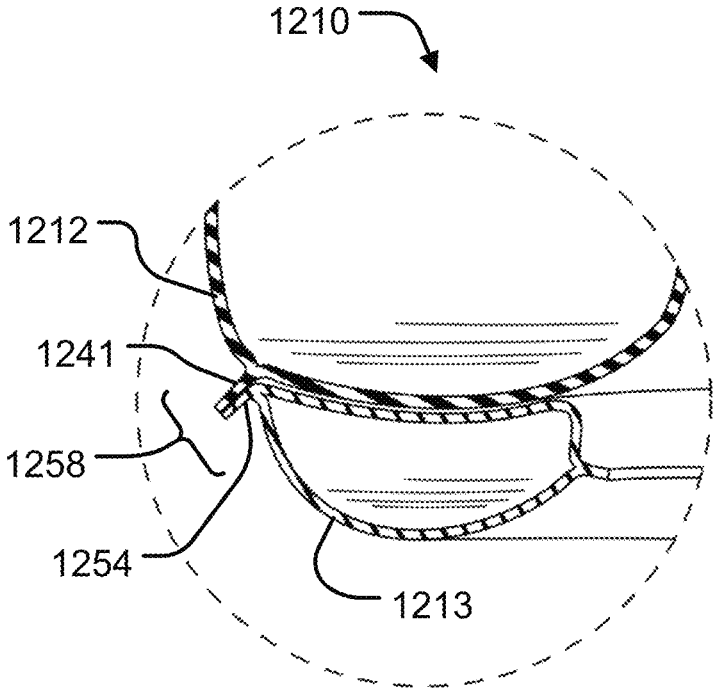
FIG. 67 is an enlarged, fragmentary view of the region in the dashed circle labeled "FIG. 67" in FIG. 57, depicting a cross-sectional view of the connection between the inflatable base and the second inflatable base of the storage device according to the thirteenth embodiment of the disclosure.
Figure 68:
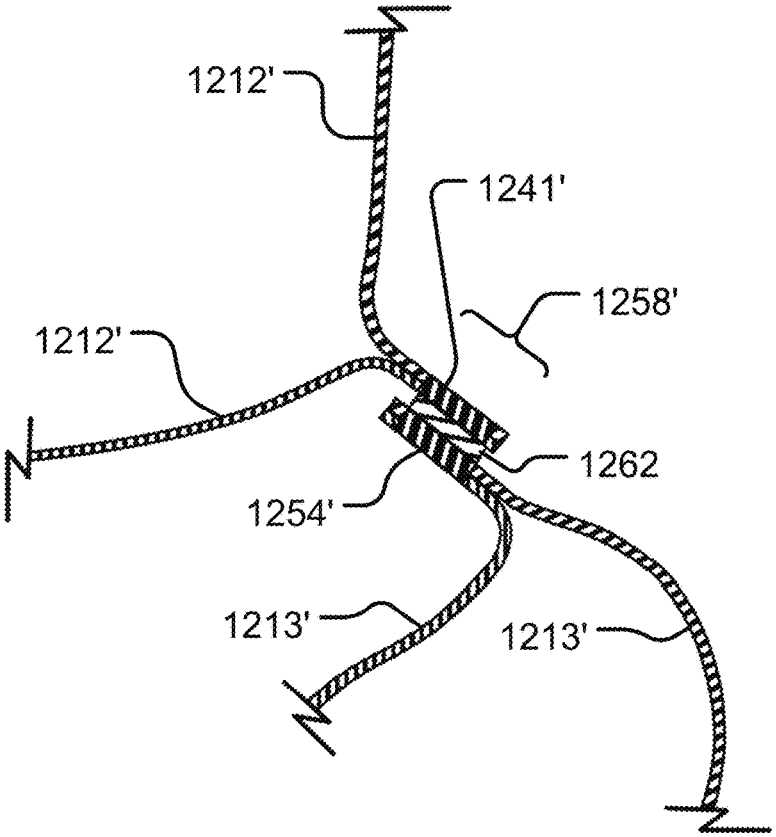
FIG. 68 is similar to FIG. 67, but is an enlarged, fragmentary cross-sectional view of the connection between the inflatable base and the second inflatable base of the storage device according to a variation of the thirteenth embodiment of the disclosure.
Figure 69:
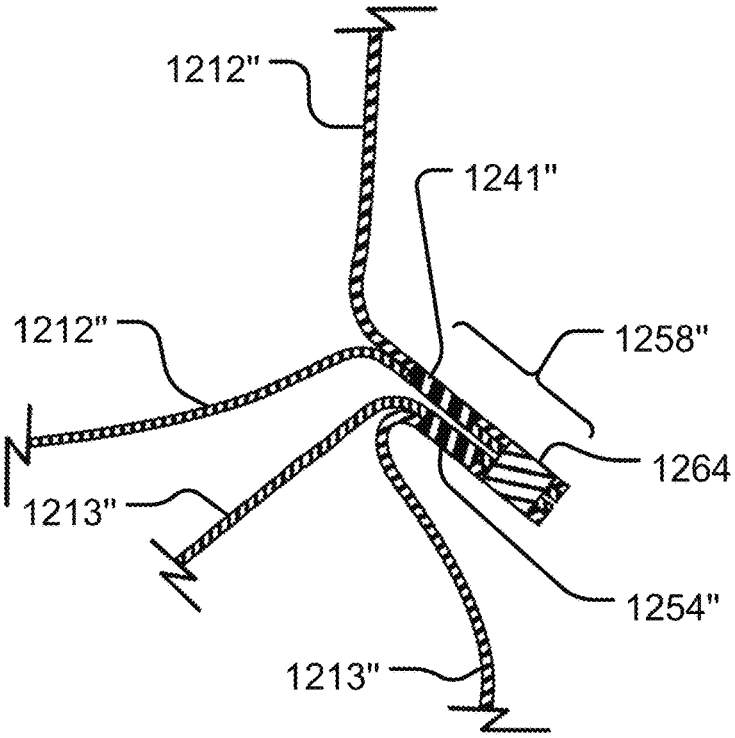
FIG. 69 is similar to FIG. 67, but is an enlarged, fragmentary cross-sectional view of the connection between the inflatable base and the second inflatable base of the storage device according to a variation of the thirteenth embodiment of the disclosure.
Figure 70:
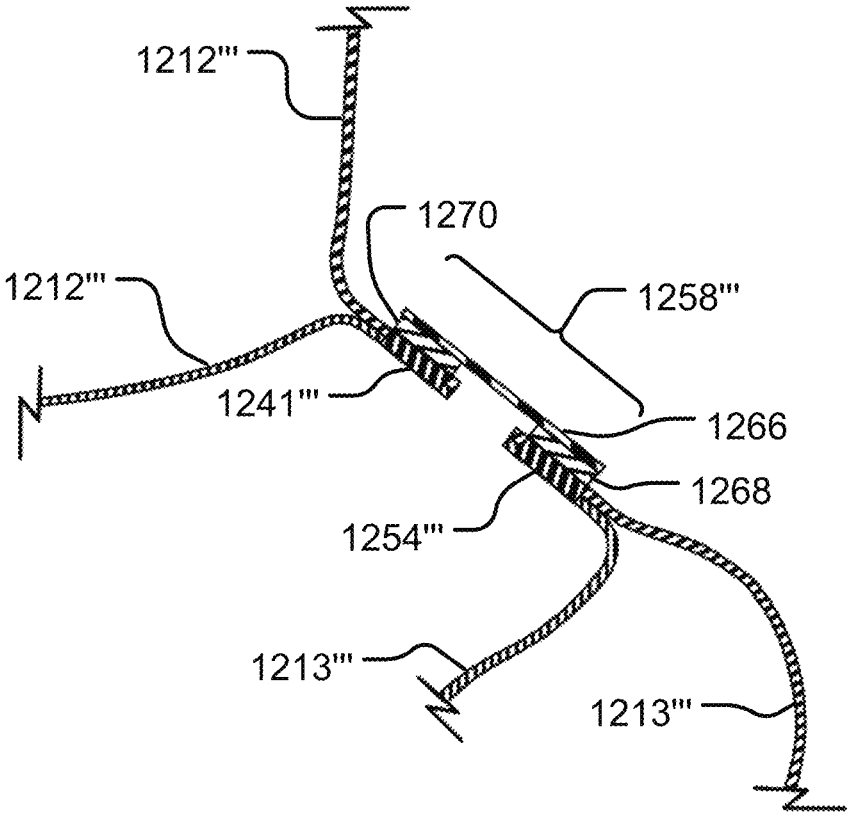
FIG. 70 is similar to FIG. 67, but is an enlarged, fragmentary cross-sectional view of the connection between the inflatable base and the second inflatable base of the storage device according to a variation of the thirteenth embodiment of the disclosure.

As shown in FIG. 67, second inflatable base 1213 is adhered or fused to inflatable base 1212 (for clarity, the four part structure of inflatable base 1212 is not shown in this figure). Specifically, in this embodiment, outer seam 1254 of second inflatable base 1213 is adhered to bottom outer seam 1241 of inflatable base 1212. That is, the fin seam of outer seam 1254 is adhered or fused to the fin seam of bottom outer seam 1241. Preferably, there is a neutral zone 1258 between inflatable base 1212 and second inflatable base 1213 proximate the seams 1254 and 1241. In various embodiments, this neutral zone 1258 may be about 0.5 cm to about 1.5 cm wide (e.g. about 0.5 cm, about 0.75 cm, about 1.0 cm, about 1.25 cm, about 1.5 cm). This neutral zone 1258 provides space for inflatable base 1212 and second inflatable base 1213 to expand when they are each inflated without tearing the seams apart. As shown in FIG. 68, in another embodiment, for example, outer seam 1254' of second inflatable base 1213' and bottom outer seam 1241' of inflatable base 1212' may be sufficiently wide such that when outer seam 1254' and bottom outer seam 1241' are adhered or fused together to form a lap seam 1262, the neutral zone 1258' is created. In another embodiment, for example, as shown in FIG. 69, the neutral zone 1258" may be created by leaving excess material beyond each of the outer seam 1254" of second inflatable base 1213" and bottom outer seam 1241" of inflatable base 1212" and then adhering or fusing this excess material together to form an additional fin seam 1264. As shown in FIG. 70, in yet another embodiment, for example, the neutral zone 1258''' may be created by fusing a band of material 1266 to each of outer seam 1254''' of second inflatable base 1213''' and bottom outer seam 1241''' of inflatable base 1212''' to form two lap seams 1268, 1270. It will be understood that other seam constructions may be used to achieve the desired neutral zone described herein without departing from the scope of the disclosure.

Figure 71:
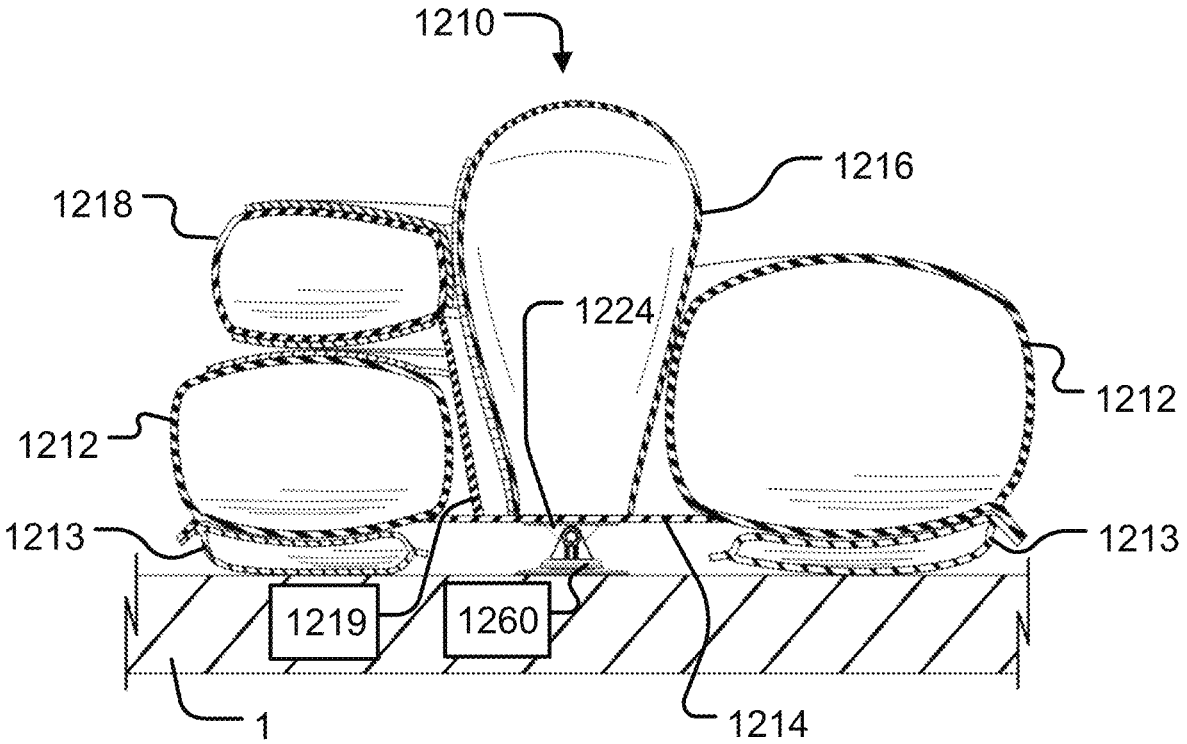
FIG. 71 is similar to FIG. 57, but is a cross-sectional view of the storage device according to the thirteenth embodiment of the disclosure wherein the second inflatable base is partially inflated.
Figure 72:
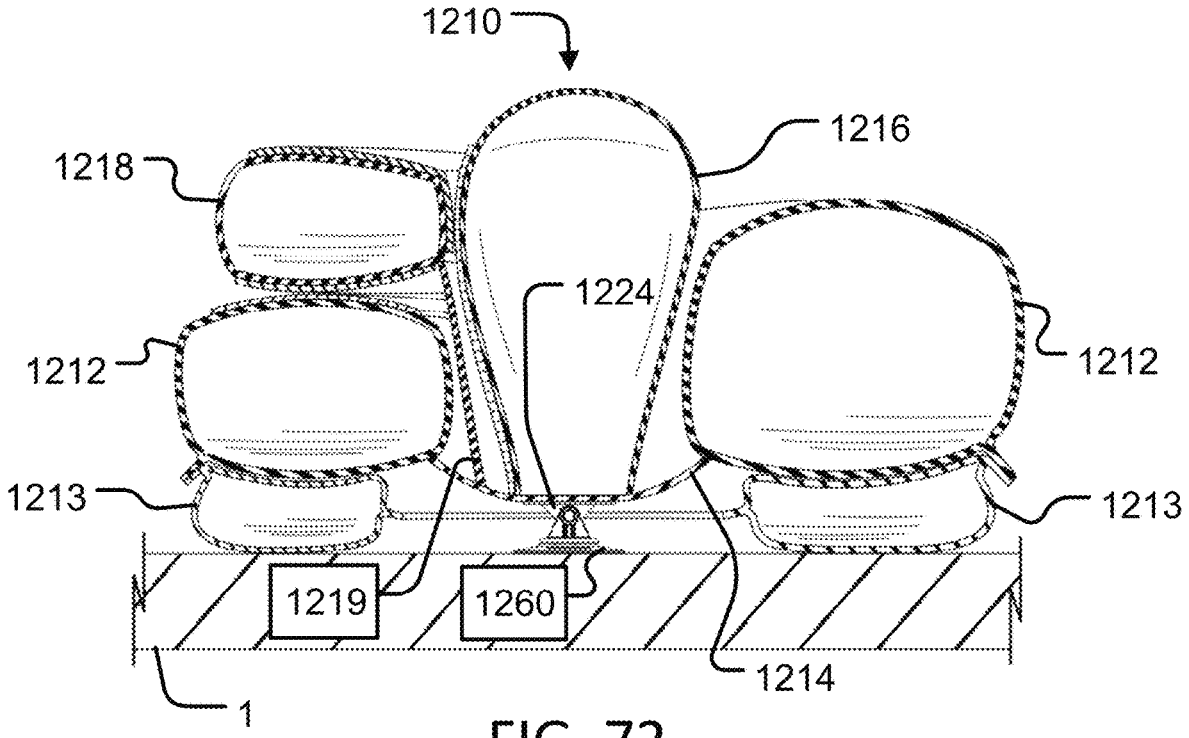
FIG. 72 is similar to FIG. 57, but is a cross-section view of the storage device according to the thirteenth embodiment of the disclosure wherein the second inflatable base is more fully inflated.

Second inflatable base 1213 provides enhanced stability for storage device 1210 and allows a user to inflate second inflatable base 1213 to a desired pressure to achieve a desired amount of tension on securing device 1224. Accordingly, second inflatable base 1213 allows for easy, secure and stable mounting of storage device 1210 to a variety of objects. The impact of the variable inflation amounts of second inflatable base 1213 is shown in FIGS. 71 and 72. As shown in FIG. 71, storage device 1210 is shown with securing device 1224 attaching storage device 1210 to a paddleboard 1 as described in greater detail elsewhere herein (e.g., via straps, modified GoPro mount, standard GoPro mount, quick release mount, suction cup, mounting assembly 1260, etc.). Second inflatable base 1213 is shown as minimally inflated such that base member 1214 is substantially horizontal and has little to no tension applied to it by second inflatable base 1213. In such a minimally inflatable base, storage device 1210 may be able to rock back-and-forth and/or side-to-side on paddleboard 1 to an undesirable degree. To more fully secure storage device 1210 onto paddleboard 1, the user may thus further inflate second inflatable base 1213 as shown in FIG. 72. This causes inflatable base 1212 to be lifted up from paddleboard 1 and also causes the outer perimeter of base member 1214 to be lifted up from paddleboard 1. This increases the tension on base member 1214 and securing device 1224. This also increases the stability of storage device 1210 on paddleboard 1 and inhibits storage device from rocking back-and-forth and/or side-to-side on paddleboard 1. Thus second inflatable base 1213 provides increased stability to storage device 1210. Second inflatable base 1213 provides a level of adjustability of the tension placed on securing device 1224 and base member 1214 by allowing for second inflatable base 1213 to be inflated to various air pressure. This allows a user to inflate second inflatable base 1213 to a desired pressure to achieve a desired tension and/or stability for the object to which storage device 1210 is mounted.

In addition to providing increased stability to storage device 1210, second inflatable base 1213 aids in raising items stored in storage device 1210 or in the rope ties and bungee cords (described in greater detail elsewhere herein) away from the water, therefore increasing overall usefulness of the dry storage.

Accordingly, for example, second inflatable base 1213 is not in fluid communication with inflatable base 1212. Because second inflatable base 1213 is separately inflatable from inflatable base 1212, second inflatable base 1213 may be inflated to a different pressure than inflatable base 1212. This may provide a user of storage device 1210 greater flexibility in mounting storage device 1210 to a surface. For example, if the surface to which a user desires to mount storage device 1210 is an irregular shape, the user may wish to inflate second inflatable member 1213 to a lower pressure so that it can better conform to the irregular shape of the surface. In such a situation, if second inflatable base 1213 was in fluid communication with one or more of inflatable base 1212, first inflatable member 1216, and second inflatable member 1218, the lower air pressure desired for second inflatable base 1213 may be too low for inflatable base 1212, first inflatable member 1216, and second inflatable member 1218 to inflate to a desired amount. This may reduce or prevent storage device 1210 from functioning as desired.

However, it will be understood that in various embodiments, for example only and without limitation, second inflatable base 1213 may be in fluid communication with inflatable base 1212. That is, air may travel freely between inflatable base 1212 and second inflatable base 1213. In certain embodiments, second inflatable base 1213 may be in fluid communication with one or more of inflatable base 1212, first inflatable member 1216, and second inflatable member 1218.

Although second inflatable base 1213 and first inflatable base 1212 are shown and described as inner tube shaped, first inflatable member 1216 is shown and described as light bulb shaped, and second inflatable member 1218 is shown and described as crescent shaped, it will be understood that such components of storage device 1210 may have other shapes without departing from the scope of this disclosure. For example only and without limitation, in various embodiments, the second inflatable base, first inflatable base, first inflatable member and/or second inflatable member may include but are not limited to shapes representing octopus tentacles, legs, fins, protrusions relating to that of turtles, fish, flower pedals, tree roots, other shapes found in nature, human designed shapes and/or structures, and shapes representing deities (e.g., Buddha). That is, any and all inflatable components described herein can be changed to represent various renderings of objects and or animals which further add aesthetic appeal and or increased function while not departing from the scope of the disclosure. Additionally, if the storage device includes non-inflatable portions (such as with storage device 510 for example), those non-inflatable components can also include but are not limited to shapes representing octopus tentacles, legs, fins, protrusions relating to that of turtles, fish, flower pedals, tree roots, other shapes found in nature, human designed shapes and/or structures, and shapes representing deities (e.g., Buddha). That is, any and all non-inflatable components described herein can additionally or alternatively be changed to represent various renderings of objects and or animals which further add aesthetic appeal and or increased function while not departing from the scope of the disclosure.

Figure 73:
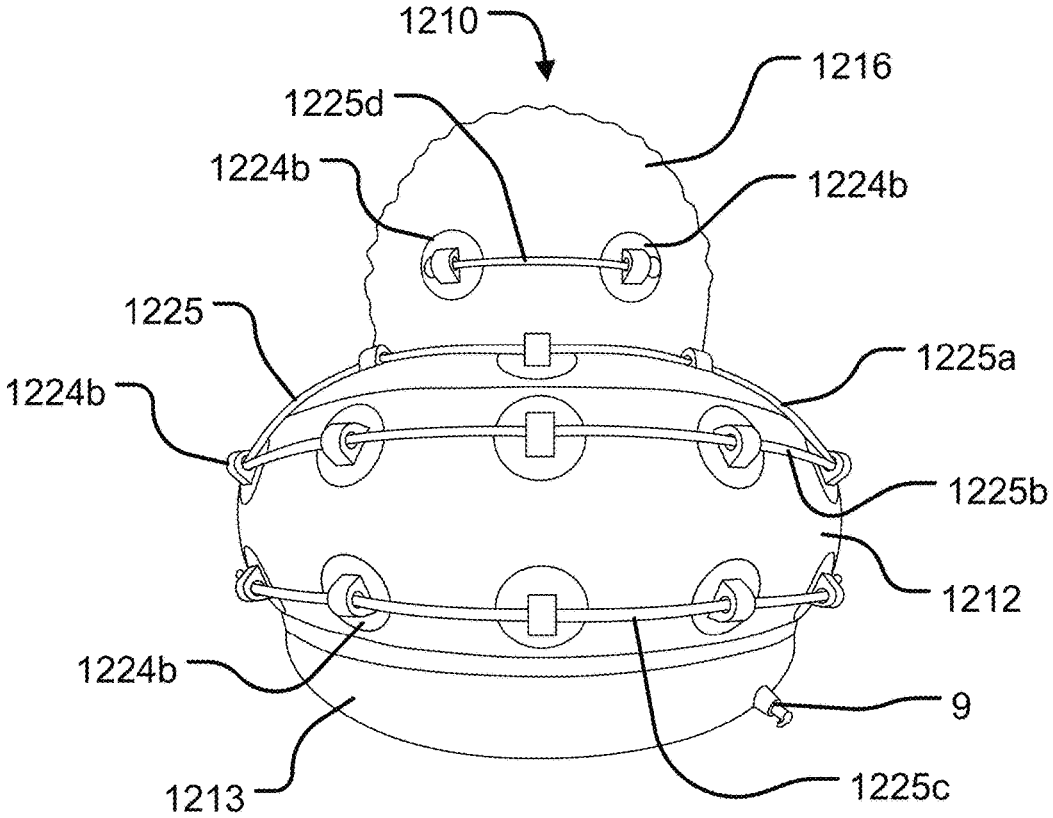
FIG. 73 is an image of the back of the storage device according to the thirteenth embodiment of the disclosure.
Figure 74:
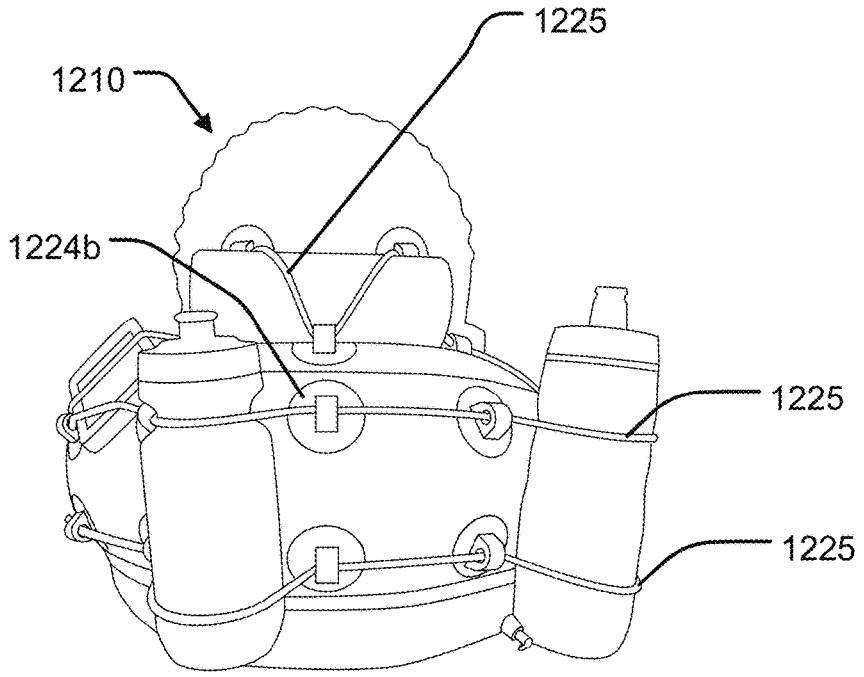
FIG. 74 is an image of the back of the storage device according to the thirteenth embodiment of the disclosure showing objects being stored in the storage device.

Referring specifically to FIGS. 73 and 74, storage device 1210 may further include a population of rope ties 1224*b* adhered or fused to storage device 1210, through which a population of ropes or bungee cords 1225 may be threaded. As shown, the rear side of inflatable base 1212 includes rows and columns of rope ties 1224*b* and rows of bungee cords 1225 extending there through. For example only and without limitation, inflatable base 1212 includes a top row of three rope ties 1224*b*, a middle row of five rope ties 1224*b*, and a bottom row of five rope ties 1224*b*. A first bungee cord 1225*a* is linked with the first rope tie 1224*b* of the middle row, the three rope ties 1224*b* in the top row, and the fifth rope tie 1224*b* of the middle row. A second bungee cord 1225*b* is linked with the five rope ties 1224*b* of the middle row. And a third bungee cord 1225*c* is linked with the five rope ties 1224*b* of the bottom row. This network of rope ties 1224*b* and bungee cords 1225 provides a place for a user to secure belongings to the storage device 1210. For example, as shown in FIG. 74, a user can slide a variety of objects including, but not limited to, a cellphone, water bottle, sandals, towel, wireless speakers, etc. under one or more of the bungee cords 1225. Although three rows of a total of thirteen rope ties 1224*b* and three bungee cords 1225 are shown, it will be understood that this number is only exemplary and that various embodiments may have fewer or greater rope ties 1224*b* and/or bungee cords 1225 without departing from the scope of the disclosure.

With reference again to FIG. 73, in addition to the network of rope ties 1224*b* and bungee cords 1225 on inflatable base 1212, a pair of rope ties 1224*b* and a bungee cord 1225*d* is located on first inflatable member 1216. Thus a population of rope ties 1224*b* and bungee cords 1225 may also be provided on first inflatable member 1216. In other embodiments, for example, a population of rope ties 1224*b* and bungee cords 1225 may also be provided on second inflatable member 1218.

Storage device 1210 having a second inflatable base 1213 is described above, however, in various embodiments, alternative constructions and attachments of second inflatable base 1213 to inflatable base 1212 may be utilized without departing from the scope of the disclosure. Thus second inflatable base 1213 may be constructed and adhered or fused to bottom of inflatable base 1212 in a variety of ways as shown in FIGS. 75-76.

Figure 75:
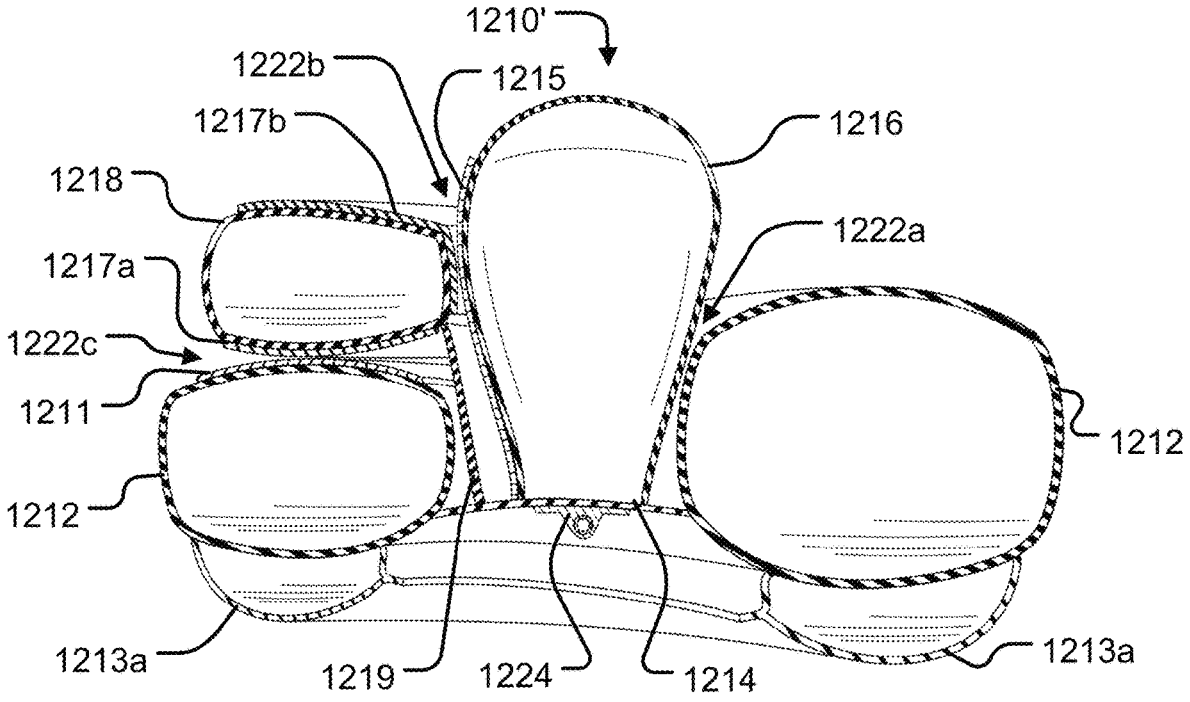
FIG. 75 is similar to FIG. 57, but is a cross-sectional view of the storage device according to a variation of the thirteenth embodiment of the disclosure.

Referring now to FIG. 75, in an embodiment of storage device 1210', for example, second inflatable base 1213*a* is an inflatable partial tube that is inner-tube or donut shaped which is adhered or fused to the bottom of inflatable base 1212 (the four part construction of inflatable base 1212 as described above, is not shown here for clarity purposes). Second inflatable base 1213*a* is a partial tube in that it is not a complete circle in its cross-section. Thus, second inflatable base 1213*a* is more generally C-shaped in cross-section wherein the free-ends of the C-shape are adhered or fused to inflatable base 1212. Because second inflatable base 1213*a* is not a complete circle in its cross-section, second inflatable base 1213*a* would not be able to contain air if it were not adhered or fused to inflatable base 1212. In various embodiments, for example, second inflatable base 1213*a* may be in fluid communication with inflatable base 1212, as described in greater detail elsewhere herein. In other embodiments, for example, second inflatable base 1213*a* is not in fluid communication with inflatable base 1212, as described in greater detail elsewhere herein.

Figure 76:
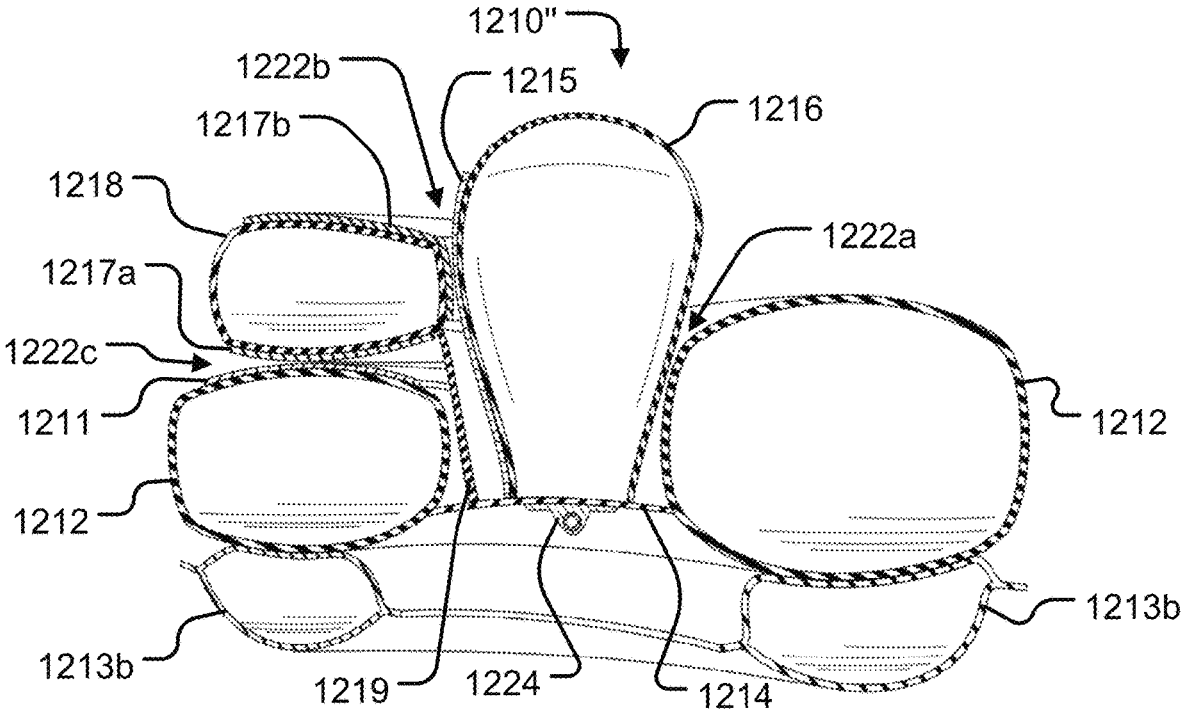
FIG. 76 is similar to FIG. 57, but is a cross-sectional view of the storage device according to a variation of the thirteenth embodiment of the disclosure.

Referring now to FIG. 76, in another embodiment of storage device 1210", for example, second inflatable base 1213*b* is an inflatable tube that is inner-tube or donut shaped which is adhered or fused to the bottom of inflatable base 1212 (the four part construction of inflatable base 1212 as described above, is not shown here for clarity purposes). That is, the wall of second inflatable base 1213*b* is adhered or fused to the wall of the bottom of inflatable base 1212, such as bottom sheet 1240 (see, e.g., FIG. 59). Unlike second inflatable base 1213*a* described above, second inflatable base 1213*b* would be able to contain air if it were not adhered or fused to inflatable base 1212. In various embodiments, for example, second inflatable base 1213*b* may be in fluid communication with inflatable base 1212, as described in greater detail elsewhere herein. In other embodiments, for example, second inflatable base 1213*b* is not in fluid communication with inflatable base 1212, as described in greater detail elsewhere herein.

Additionally, while each of the second inflatable bases are shown as a single "donut," it will be understood that in various embodiments, the second inflatable bases may comprise a population of individual inflatable members which are adhered or fused onto the bottom of inflatable base 1212. These individual inflatable members may be multiple inflatable disks, spheres, squares or other shapes adhered or fused to the bottom of inflatable base 1212 to aid in lifting inflatable base 1212 to aid in securing storage device 1210 to a surface. These individual inflatable members may or may not be in fluid communication with inflatable base 1212 depending on the configuration.

Figure 77:
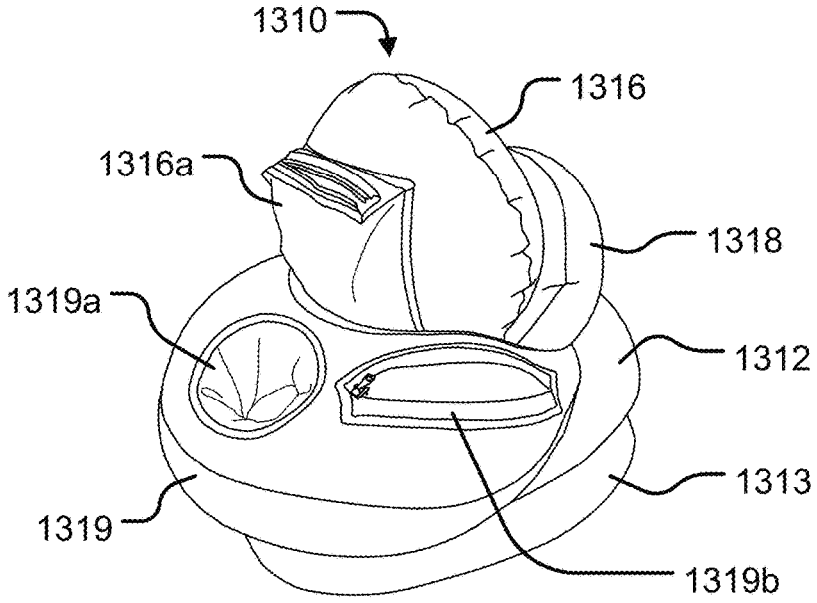
FIG. 77 is an isometric view of a storage device according to a fourteenth embodiment of the disclosure.

Another embodiment of a storage device 1310 of the disclosure is illustrated in FIG. 77 and is described below. Some features of one or more of storage device 1310, 1210, 1110, 1010, 910, 710, 610, 510, 410, 310, 210, 110, and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Storage device 1310 includes an inflatable base 1312, a base member 1314, a first inflatable member 1316, and a second inflatable member 1318 which cooperate, when inflated, to form a population of storage areas. In various embodiments, for example only and without limitation, storage device 1310 may further include a second inflatable base 1313 affixed to inflatable base 1312. Second inflatable base 1313 may be identical or substantially similar to second inflatable base 1213 as described above in connection with storage device 1210.

Inflatable base 1312, base member (not shown), first inflatable member 1316, second inflatable member 1318, and second inflatable base 1313 of storage device 1210 may be substantially similar or identical with inflatable base

1212, base member 1214, first inflatable member 1216, second inflatable member 1218, and second inflatable base 1213 of storage device 1210, as described above.

Storage device 1310 further includes third inflatable member 1319 which is adhered or fused to the top of inflatable base 1312. Third inflatable member 1319 may be generally crescent moon shaped and is located on the top of inflatable base 1312 on the opposite side of first inflatable member 1316 from second inflatable member 1218.

Third inflatable member may include a variety of storage areas such as cup holder 1319*a* and zippered pockets 1319*b*. Although a single cup holder and two zippered pockets are shown, it will be understood that any number and combination of cup holder and/or zippered pockets may be included without departing from the scope of the disclosure. Zippered pockets may be water-proof. For example only and without limitation, in certain embodiments, third inflatable member 1319 may include two cup holders and no pockets. Yet in other embodiments, for example only and without limitation, third inflatable member 1319 may include one pocket and no cup holders. In other embodiments, first inflatable member 1316 may also include a zippered pocket 1316*a*, which in some embodiments, for example, may be water-proof.

In various embodiments inflatable base 1312 and third inflatable member 1319 may be in fluid communication with one another. That is, air may travel freely between inflatable base 1312 and third inflatable member 1319. However, in other embodiments, for example, inflatable base 1312 is not in fluid communication with third inflatable member 1319, such that third inflatable member 1319 is separately inflatable from inflatable base 1312.

Figure 78:
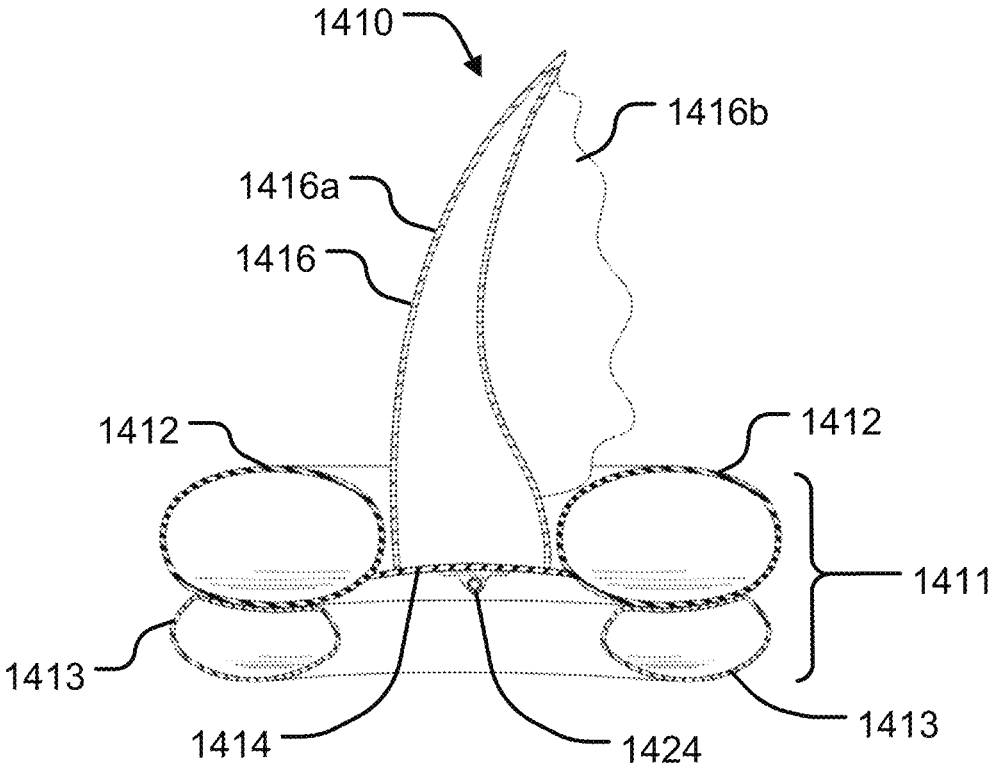
FIG. 78 is similar to FIG. 57, but is a cross-sectional view of an inflatable device according to a fifteenth embodiment of the disclosure.
Figure 79:
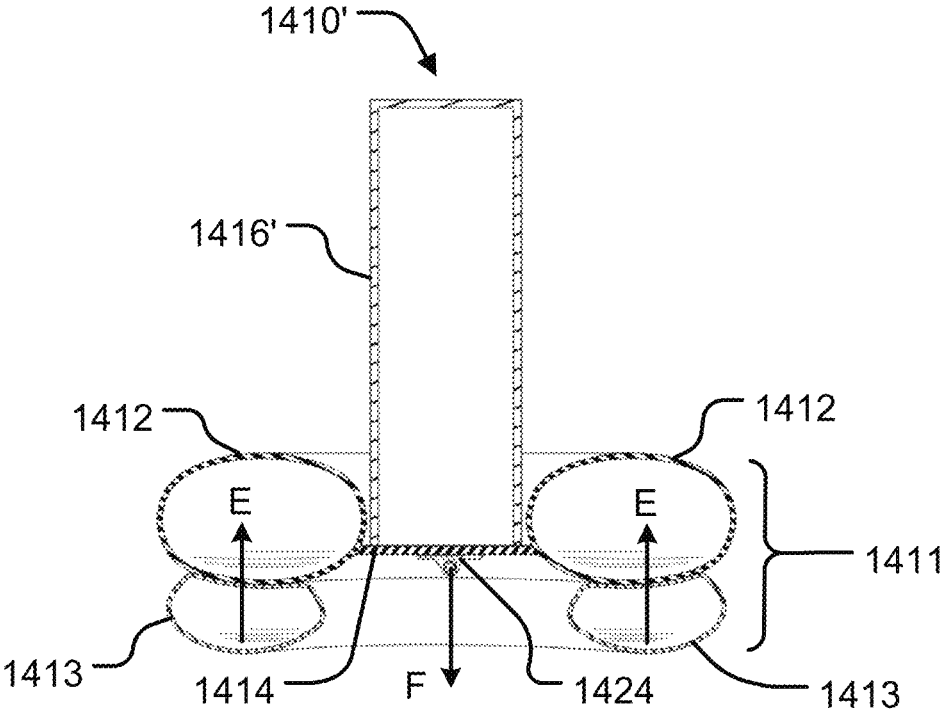
FIG. 79 is similar to FIG. 57, but is a cross-sectional view of an inflatable device according to a variation of the fifteenth embodiment of the disclosure.

Another embodiment of an inflatable device 1410 of the disclosure is illustrated in FIGS. 78-79 and is described below. Some features of one or more of storage device 1410, 1310, 1210, 1110, 1010, 910, 710, 610, 510, 410, 310, 210, 110, and 10 are common to one another and, accordingly, descriptions of such features in one embodiment should be understood to apply to other embodiments. Furthermore, particular characteristics and aspects of one embodiment may be used in combination with, or instead of, particular characteristics and aspects of another embodiment.

Inflatable device 1410 includes a base element 1411 and a promotional member 1416. Base element 1411 comprises an inflatable base 1412, a second inflatable base 1413, a base member 1414, and securing device 1424.

Inflatable base 1412, second inflatable base 1413, and base member 1414 of base element 1411, may be substantially similar or identical to inflatable base 1212, second inflatable base 1213, and base member 1214 of storage device 1210, as described above.

Additionally, securing device 1424 may be substantially similar or identical to the securing devices described elsewhere herein. In various embodiments, inflatable device 1410 may be secured to the ground via a stake (e.g., tent stake) or a corkscrew securing device, such as is used with outdoor dog leads.

Inflatable device 1410 includes promotional member 1416 which is shown as a curving spine-like inflatable member 1416*a* to which a banner 1416*b* is adhered or fused. In various embodiments, promotional member 1416 may be adhered or fused to base member 1414 as described in greater detail elsewhere herein. In other embodiments, for example, promotional member 1416 may be releasably affixed to base member 1414 in a variety of ways, including but not limited to, buckles, straps, hook-and-loop style fasteners (e.g., Velcro®), any combination thereof, or in any manner known in the art. One or both of the inflatable member 1416*a* and banner 1416*b* may include advertising material adhered, affixed and/or printed thereon for use as a promotional or eye-catching device. For example, inflatable device 1410 may be used on a beach to promote a food and/or drink vendor, or it may be used to identify a lifeguard location. Where, promotional member 1416 is releasably affixed to base member 1414, different promotional members 1416 may be created for different advertising purposes or events and swapped out with base element 1411.

While inflatable device 1410 is shown with promotional element 1416 having a curving spine-like inflatable member 1416*a*, it will be understood that in another embodiment of inflatable device 1410', as shown in FIG. 79, promotional element 1416' may include a cylindrical inflatable member 1416*a*'. In yet other embodiments, promotional element may be an arch shape and may be adhered, fused or otherwise permanently or releasably affixed to a pair of base elements 1411, with one base element 1411 at the base of each arch leg. It will be understood that any shape or structure of promotional element 1416 may be used without departing from the scope of the disclosure.

Additionally, second inflatable base 1413 functions identically to second inflatable base 1213 and provides the same benefits described above. Thus, second inflatable base 1213 provides increased stability to inflatable device 1410. With reference to FIG. 79, as second inflatable base 1413 is inflated, it causes inflatable base 1412 to raise as shown by arrows E and securing device 1424 and base member 1414 to be pulled downward as shown by arrow F. This increases the tension in securing device 1424 and base member 1414 and provides increased stability to inflatable device 1410. That is, when the inflatable device 1410 is affixed to an object via securing device 1424, second inflatable base 1213 may be inflated to a desired inflation pressure, wherein the inflation pressure causes first inflatable base 1212 to rise away from the object, exerting an upward inflation force which is counteracted by a downward pulling force from securing device 1424 which causes base member 1414 to be pulled downward.

Figure 80:
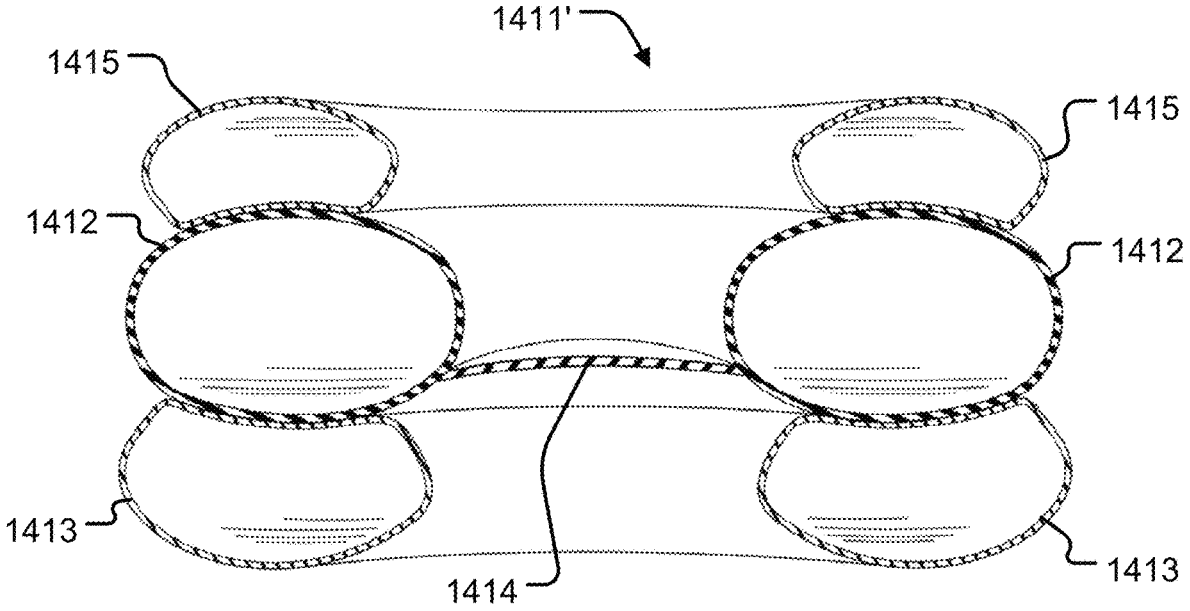
FIG. 80 is similar to FIG. 57, but is a cross-sectional view of a base element of an inflatable device according to a variation of the fifteenth embodiment of the disclosure.

An additional embodiment of base element 1411' is shown in FIG. 80. In this embodiment, base element 1411' comprises three bases: first inflatable base 1412, second inflatable base 1413 below first inflatable base 1412, and third inflatable base 1415 adhered or fused to the top of first inflatable base 1412. Third inflatable base 1415 may be adhered or fused to first inflatable base 1412 in the same manner as second inflatable base 1413 as described in greater detail elsewhere herein. In various embodiments, for example, first, second and third inflatable bases 1412, 1413 and 1415 may all be the same size. In other embodiments, for example, first, second and third inflatable bases 1412, 1413 and 1415 may be different sizes. For example, first, second and third inflatable bases 1412, 1413 and 1415 may be sized such that base element 1411' is conical shaped. That is, second inflatable base 1413 may be a first diameter, first inflatable base 1412 may be a second diameter, wherein the second diameter is less than the first diameter of the second inflatable base 1413, and third inflatable base 1415 may be a third diameter, wherein the third diameter is less than the second diameter of the first inflatable member 1412. Although three inflatable bases are shown, it will be understood that base element 1411' may have more than three inflatable bases. Additionally, it will be understood that in various embodiments, for example, one or more of the bases may be a non-inflatable base. That is, one or more of the bases may be generally solid or semi-solid and may be constructed from a variety of materials, including but not limited to foam, gel, plastic, rubber or other materials, combinations, hybrids or variations thereof.

Additionally as shown in FIG. 80, base member 1414 may be fused or adhered to base element 1411' between the first inflatable base 1412 and second inflatable base 1413. Alternatively, in some embodiments for example, base member 1414 may be fused or adhered to base element 1411' between the first inflatable base 1412 and third inflatable base 1415.

It will be understood by one skilled in the art that the storage devices described herein may also include three or more inflatable bases as described in connection with base element 1411' without departing from the scope of the disclosure.

Figure 81:
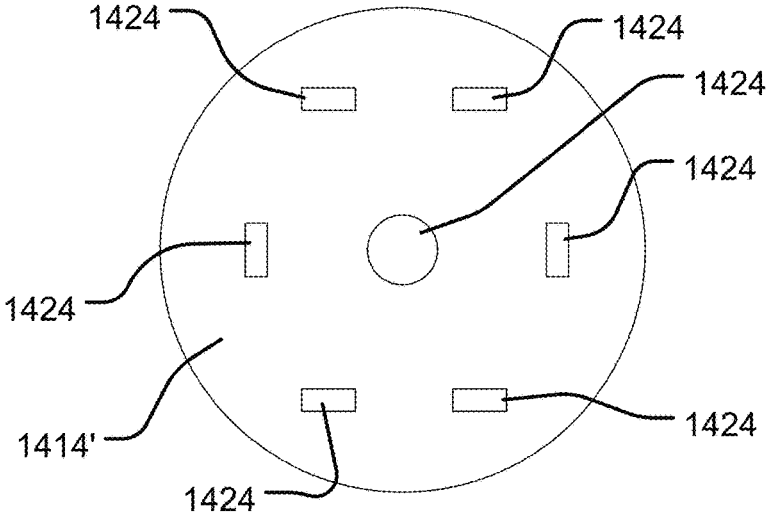
FIG. 81 is a bottom view of a base member of an inflatable device according to a variation of the fifteenth embodiment of the disclosure.

Although a single securing device 1424 is shown and described, it will be understood that more than one securing device 1424 may be affixed or attached to base member 1414' of inflatable device 1410 without departing from the scope of the disclosure. As shown in FIG. 81, base member 1414' includes six securing devices 1424. If multiple securing devices 1424 are provided on inflatable device 1410, some or all of the securing devices 1424 may be used at a time to secure inflatable device 1410 as desired. Thus, the securing devices 1424 may be simultaneously used or individually used given the size of the inflatable device 1410 being secured and/or the terrain or object to which the inflatable device 1410 is being secured. The inclusion of multiple securing devices 1424 may be most applicable to inflatable device 1410 given the potential large size of inflatable device 1410 and the variety of surfaces to which inflatable device 1410 may be secured; however, it will be understood that multiple securing devices may be utilized on any embodiments of storage devices and inflatable devices described herein without departing from the scope of the disclosure. Any securing devices described herein may be used without departing from the scope of the disclosure.

Unlike typical inflatable advertising or promotional devices, inflatable device 1410, 1410' do not require constant inflation via a fan or other air source. Because inflatable device 1410, 1410' can be inflated and will remain inflated, it can be used or secured in locations that do not have access to power. For example, inflatable device 1410, 1410' may be used on a beach, in a park, a forest, etc. for promotional events at such locations where power may not be readily available.

While inflatable device 1410 is described as having a promotional member 1416, it will be understood that in other embodiments promotional member 1416 may be replaced with a fitness or sports member. For example, instead of promotional member 1416, an inflatable device may include an inflatable or non-inflatable punching bag, and/or a tower for other recreational activities or games. Thus, base element 1411 described herein may have attached to or extending therefrom a variety of fitness or sporting equipment, including but not limited to, an inflatable or non-inflatable punching bag, basketball hoop, volleyball net, tennis net, badminton net, etc.

Figure 82:
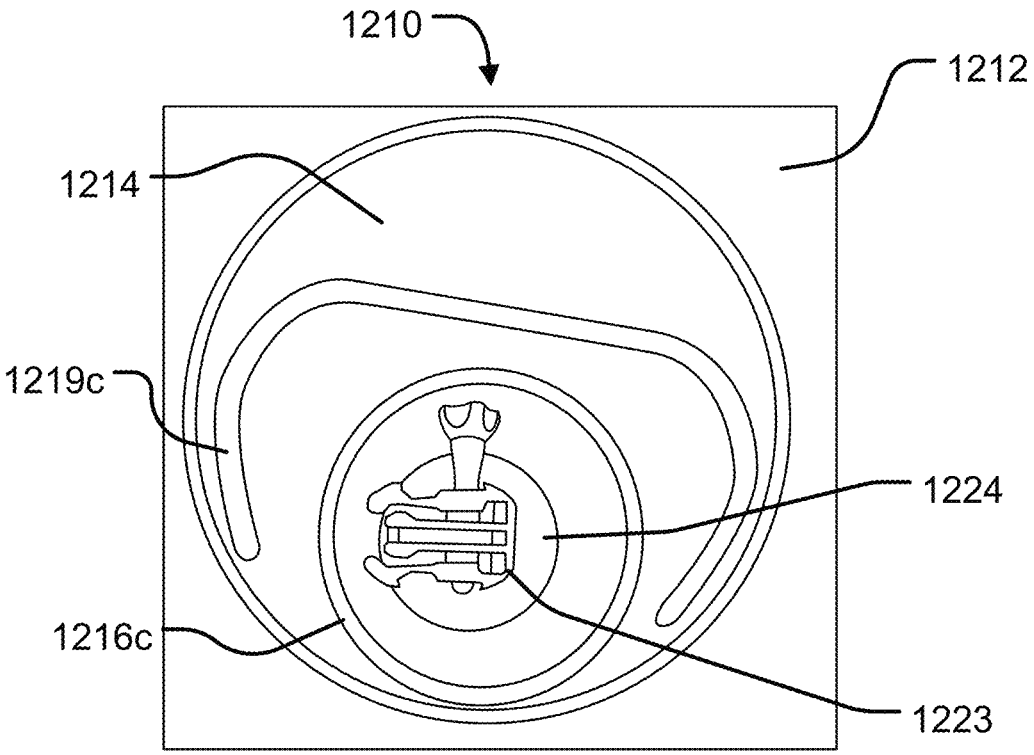
FIG. 82 is an image of a securing device which may be used with the embodiments of the disclosure.
Figure 83:
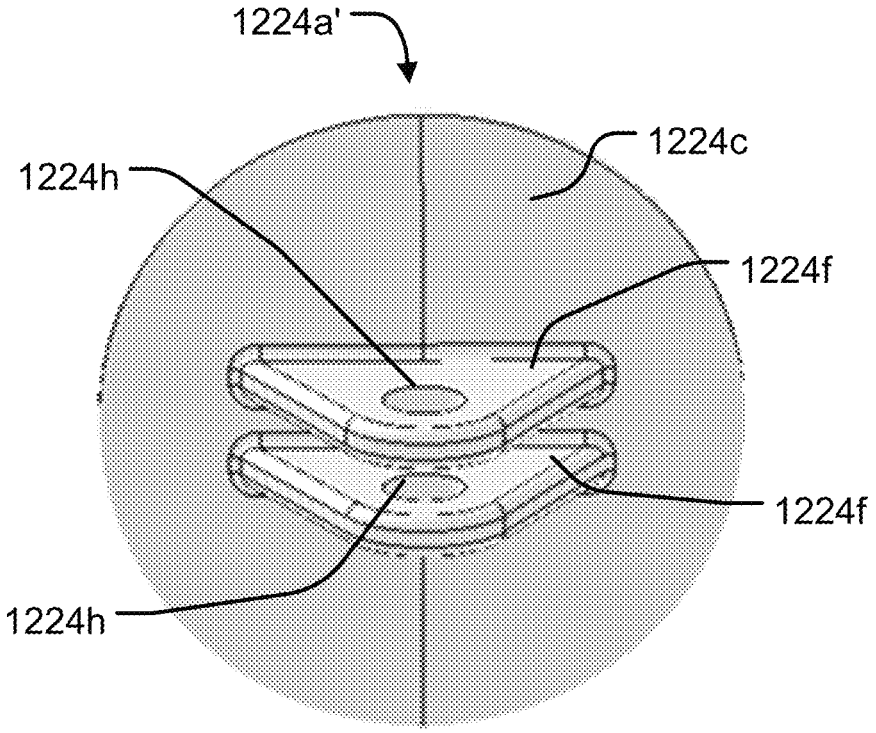
FIG. 83 is an isometric view of a securing device which may be used be used with various embodiments of the disclosure.
Figure 84:
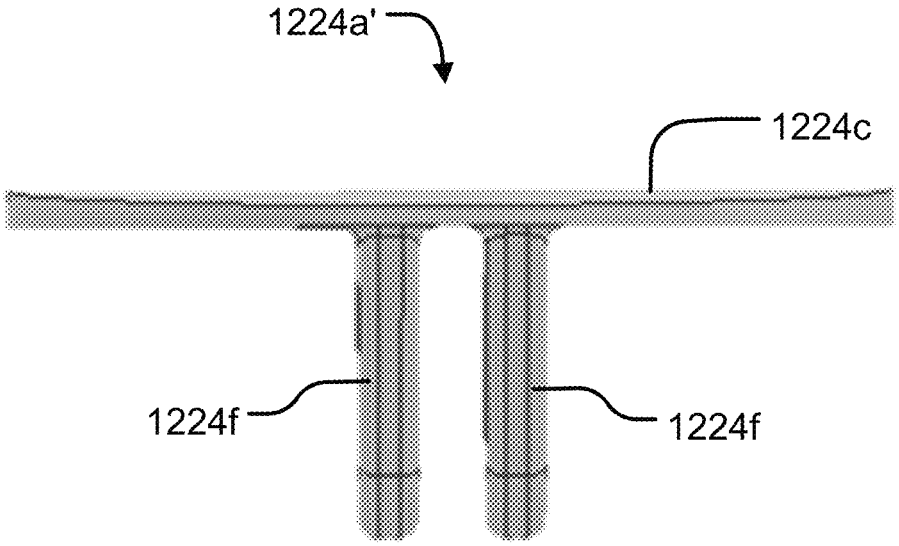
FIG. 84 is a side view of the securing device of FIG. 60A which may be used with various embodiments of the disclosure.

Now with reference to FIGS. 82, 83 and 84, another embodiment of a securing device is shown and described which may be used with any of the storage devices or inflatable devices described herein. This securing device is shown for example only as being used with storage device 1210 described above.

As shown in FIG. 82, however, a quick release mount 1223 (e.g., a modified GoPro mount) is screwed onto rope tie 1224*a*. The quick release mount 1223 includes a buckle which is adapted and designed to interface and engage with a mating buckle receiver or base mount that a user can adhere or affix to their paddleboard. By using the quick release mount 1223, a user can quickly attach and release storage device 1210 from their paddleboard. In various embodiments, the quick release mount 1223 may be a mount sold by GoPro, Inc. of 3000 Clearview Way, San Mateo, Calif. 94402. Typical GoPro mounts include three fingers through which a securing screw is threaded. In various embodiments, the middle finger of the GoPro mount may be removed in order to allow the two outer fingers of the GoPro mount to interface with the triangular body of the rope tie 1224*a*. However, in other embodiments for example only and without limitations, rope tie 1224*a* may be able to interface with a typical or standard three-fingered GoPro mount, such that a modified GoPro mount is not necessary. In such embodiments, as shown in FIGS. 83 and 84, an alternative embodiment of rope tie 1224*a'* may be used with storage device 1210 which includes two triangular shaped fingers 1224*f* which are integrally formed with and extend from a circular base 1224*c*. Near the apex of each of triangular shaped finger 1224*f* of rope tie 1224*a'* is a hole 1224*h* which extends through each triangular shaped finger 1224*f*. Therefore, the three fingers of a typical GoPro mount or similar three-fingered mount can interface with the two fingers 1224*f* of rope tie 1224*a'*, such that the outer two fingers will be located on the outside of the two fingers 1224*f* and the central finger of the mount will be between the two fingers 1224*f* when the mount is attached to rope tie 1224*a'*. While the fingers 1224*f* of rope tie 1224*a'* are described as triangular shaped, it will be understood that any shape finger may be used without departing from the scope of the disclosure.

While various securing devices have been described with respect to certain embodiments, it will be understood that any securing device described herein may be used with any embodiment of storage device or inflatable device without departing from the scope of the disclosure. Thus, for example only and without limitation, rope tie 1224*a* and/or mounting assembly 1260 described in conjunction with storage device 1210 may be used with storage devices 1310, 1210', 1210", 1110, 1010, 910, 710, 610, 510, 410, 310, 210, 110, and 10 as well as inflatable devices 1410, 1410'.

In addition or alternative to the securing devices described herein, the storage devices described herein may be attached to an object, such as a paddleboard, using a strap placed over the storage device. For example, storage device 1210 may be secured to a paddleboard 1 by strapping a securing strap (e.g., 26, 1026, 1126) over storage device 1210, between inflatable base 1212 and first inflatable member 1216, and under the paddleboard. In embodiments where inflatable base 1212 has a smaller dimension (e.g., diameter) in the front of storage device 1210 and a larger dimension (e.g. diameter) at the back of storage device 1210, this increased diameter of inflatable base 1212 at the back of storage device acts to wedge the securing strap between inflatable base 1212 and first inflatable member 1216. The increased diameter of inflatable base 1212 located at back of storage device 1210 thus provides a more stable and or secure strap over mounting option than would otherwise be attained if inflatable base 1212 was a single diameter throughout.

While various embodiments of a storage device have been shown and described as having a generally circular shape when viewed from above, it will be understood that in other embodiments the storage device of the disclosure may be in any shape without departing from the scope of the disclosure, including but not limited to, ovular, rectangular, pentagonal, hexagonal, pyramid shaped, etc. Additionally, in other embodiments, the storage devices described herein may be animal shaped such as, for example and without limitation, octopus shaped, whale shaped, dolphin shaped, shark shaped, etc. Such animal shapes may be desired by children. Moreover, although in various embodiments the first inflatable member is described as being egg or light-bulb shaped, it will be understood that first inflatable member may be any shape without departing from the scope of the disclosure, including but not limited to, ovular, rectangular, cylindrical, pentagonal, hexagonal, pyramid shaped, conical, frusto-conical, etc. Additionally, although in various embodiments the second inflatable member is described as being crescent shaped, it will be understood that second inflatable member may be any shape without departing from the scope of the disclosure, including but not limited to, ovular, rectangular, cylindrical, etc. For further example only and without limitation, in various embodiments, the second inflatable base, first inflatable base, first inflatable member and/or second inflatable member may include but are not limited to shapes representing octopus tentacles, legs, fins, protrusions relating to that of turtles, fish, flower pedals, tree roots, other shapes found in nature, human designed shapes and/or structures, and shapes representing deities (e.g., Buddha). That is, any and all inflatable components described herein can be changed to represent various renderings of objects and or animals which further add aesthetic appeal and or increased function while not departing from the scope of the disclosure. Additionally, if the storage device includes non-inflatable portions (such as with storage device 510 for example), those non-inflatable components can also include but are not limited to shapes representing octopus tentacles, legs, fins, protrusions relating to that of turtles, fish, flower pedals, tree roots, other shapes found in nature, human designed shapes and/or structures, and shapes representing deities (e.g., Buddha). That is, any and all non-inflatable components described herein can additionally or alternatively be changed to represent various renderings of objects and or animals which further add aesthetic appeal and or increased function while not departing from the scope of the disclosure.

Additionally, it will be understood that the storage devices and inflatable devices may have additional inflatable devices than those described herein without departing from the scope of the invention.

Additionally, the storage devices and inflatable devices described herein are generally buoyant, either by being inflated with air or constructed with buoyant materials, it will be understood that in other embodiments, the storage devices described herein may not be buoyant without departing from the scope of the disclosure. That is, the storage devices described herein may be made from materials, such as for example, rubber which is not inherently buoyant.

Additionally, in various embodiments of the storage and/or inflatable devices described herein, lights may be included on, within or under the storage and/or inflatable devices. Such lights may illuminate the storage and/or inflatable devices. For example, if the storage and/or inflatable device is made of translucent or clear material, then a light placed inside or under the storage and/or inflatable device would cause the storage and/or inflatable device to light up or glow. In another example, where the storage device is used on a standup paddleboard or other watercraft, the storage device may be equipped with safety or navigational lighting. For example only and without limitation, such lights may be navigation or running lights required by the United States Coast Guard for certain watercraft (e.g., red and green lights, tri-color lights, white light, etc.). In yet another example, a light may be placed on storage and/or inflatable devices to illuminate the area around, nearby or ahead of the storage and/or inflatable devices. In yet another example, a light may be placed in or on one or more of the storage areas described herein (e.g., first storage area 22*a*, second storage area 22*b*, third storage area 22*c*, and/or fourth storage area 22*d*) without departing from the scope of the disclosure.

The following enumerated embodiments are presented to illustrate certain aspects of the disclosure, and are not intended to limit its scope:

Embodiment 1

A storage device, comprising:

an inflatable base;

a base member affixed to the inflatable base;

a first inflatable member affixed to the base member, wherein when the inflatable base and the first inflatable member are inflated, the inflatable base and the first inflatable member cooperate with one another to form a first storage area; and a second inflatable member affixed to the first inflatable member, wherein when the first inflatable member and the second inflatable member are inflated, the first inflatable member and the second inflatable member cooperate with one another to form a second storage area, and wherein when the inflatable base and the second inflatable member are inflated, the inflatable base and the second inflatable member cooperate with one another to form a third storage area.

Embodiment 2

The storage device of Enumerated Embodiment 1, further comprising a securing device affixed to the base member opposite the first inflatable member, the securing device adapted to secure the storage device to a structure.

Embodiment 3

The storage device as in any previous Enumerated Embodiment, wherein the inflatable base has a bottom and wherein the base member is affixed to the inflatable base such that when the inflatable base is inflated, the base member is above the bottom of inflatable base.

Embodiment 4

The storage device as in any previous Enumerated Embodiment, wherein the first inflatable member is removably affixed to the base member.

Embodiment 5

The storage device as in any previous Enumerated Embodiment, wherein the second inflatable member is removably affixed to the first inflatable member.

Embodiment 6

The storage device as in any previous Enumerated Embodiment, wherein the storage device is adapted to hold the blade of a paddle in the first and second storage areas.

Embodiment 7

The storage device as in any previous Enumerated Embodiment, wherein the storage device is adapted to hold the blade of a paddle in the second storage area.

Embodiment 8

A storage device, comprising:

an inflatable base;

a base member affixed to the inflatable base;

a first inflatable member affixed to the base member, wherein when the inflatable base and the first inflatable member are inflated, the inflatable base and the first inflatable member cooperate with one another to form a first storage area; and a second inflatable member affixed to the base member, wherein when the first inflatable member and the second inflatable member are inflated, the first inflatable member and the second inflatable member cooperate with one another to form a second storage area, and wherein when the inflatable base and the second inflatable member are inflated, the inflatable base and the second inflatable member cooperate with one another to form a third storage area.

Embodiment 9

The storage device as in Enumerated Embodiment 8, further comprising a securing device affixed to the base member opposite the first inflatable member, the securing device adapted to secure the storage device to a structure.

Embodiment 10

The storage device as in any of Enumerated Embodiments 8-9, wherein the first inflatable member is removably affixed to the base member.

Embodiment 11

The storage device as in any of Enumerated Embodiments 8-10, wherein the second inflatable member is removably affixed to the base member.

Embodiment 12

The storage device as in any of Enumerated Embodiments 8-11, wherein the storage device is adapted to hold the blade of a paddle in the second storage area.

Embodiment 13

A storage device, comprising:

a body having a concave base; and a population of storage areas in the body.

Embodiment 14

The storage device as in Enumerated Embodiment 13, wherein the body is formed of a buoyant material.

Embodiment 15

The storage device as in any of Enumerated Embodiments 13-14, further comprising a securing device affixed to the concave base, the securing device adapted to secure the storage device to a structure.

Embodiment 16

The storage device as in any of Enumerated Embodiments 13-15, wherein the population of storage areas comprise one or more of a waterproof storage slot, a cup holder, a paddle slot, a tunnel, and a storage receptacle.

Embodiment 17

A storage device, comprising:

an inflatable base;

a base member affixed to the inflatable base; and a non-inflatable body affixed to the inflatable base and extending upward from the base member; wherein the non-inflatable body comprises a population of storage areas.

Embodiment 18

The storage device as in Enumerated Embodiment 17, further comprising a securing device affixed to the base member opposite the non-inflatable body, the securing device adapted to secure the storage device to a structure.

Embodiment 19

The storage device as in any of Enumerated Embodiments 17-18, wherein the population of storage areas comprise one or more of a waterproof storage slot, a cup holder, a paddle slot, a tunnel, and a storage receptacle.

Embodiment 20

A storage device adapted to be used as a wearable personal flotation device, comprising:

an inflatable base adapted to be secured to a user's torso;

a base member affixed to the inflatable base; and a second inflatable member connected to the base member by a pair of tethers, wherein the second inflatable member is adapted to be switched from a first position proximate the inflatable base and a second position extended away from the inflatable base and placed behind the user's head.

Embodiment 21

A storage device, comprising:

a first inflatable base;

a base member affixed to the first inflatable base;

a first inflatable member affixed to and extending upward from the base member, wherein the first inflatable member extends above the first inflatable base;

a second inflatable member above the first inflatable base;

a curtain having a top end and a bottom end, wherein the top end is affixed to the second inflatable member and the bottom end is affixed to the base member; and a second inflatable base below the first inflatable base, wherein the second inflatable base is connected to the first inflatable base.

Embodiment 22

The storage device as in Enumerated Embodiment 21, further comprising a securing device affixed to the base member opposite the first inflatable member.

Embodiment 23

The storage device as in any of Enumerated Embodiments 21-22, wherein when the storage device is affixed to an object, the second inflatable base may be inflated to a desired pressure to achieve a desired stability of the storage device on the object.

Embodiment 24

The storage device as in any of Enumerated Embodiments 21-23, wherein between the second inflatable member and the first inflatable member is an additional strip of material on the second inflatable member.

Embodiment 25

The storage device as in any of Enumerated Embodiments 21-24, further comprising a population of bungee cords affixed to one or more of the first inflatable member and the first inflatable base, wherein the population of bungee cords is adapted to secure one or more objects to the storage device.

Embodiment 26

The storage device as in any of Enumerated Embodiments 21-25, wherein the second inflatable base is independently inflatable from the first inflatable base.

Embodiment 27

An inflatable device comprising:

a base element, comprising:

a first inflatable base;

a base member affixed to the first inflatable base; and a second inflatable base below the first inflatable base, wherein the second inflatable base is connected to the first inflatable base; and a promotional member affixed to and extending upward from the base member, wherein the first inflatable member extends above the first inflatable base.

Embodiment 28

The inflatable device as in Enumerated Embodiment 27, further comprising one or more securing devices affixed to the base member opposite the first inflatable member.

Embodiment 29

The inflatable device as in any of Enumerated Embodiments 27-28, wherein when the inflatable device is affixed to an object, the second inflatable base may be inflated to a desired pressure to achieve a desired stability of the storage device on the object.

Embodiment 30

The inflatable device as in any of Enumerated Embodiments 27-29, wherein the promotional member comprises:

a curving spine-like inflatable member; and and a banner affixed to the curving spine-like inflatable member.

Embodiment 31

A storage device, comprising:

an inflatable base;

a base member affixed to the inflatable base; and a first inflatable member affixed to the base member, wherein when the inflatable base and the first inflatable member are inflated, the inflatable base and the first inflatable member cooperate with one another to form a first storage area.

Embodiment 32

The storage device as in Enumerated Embodiment 31, further comprising:

a second inflatable member affixed to the first inflatable member, wherein when the first inflatable member and the second inflatable member are inflated, the first inflatable member and the second inflatable member cooperate with one another to form a second storage area, and wherein when the inflatable base and the second inflatable member are inflated, the inflatable base and the second inflatable member cooperate with one another to form a third storage area.

Embodiment 33

The storage device as in Enumerated Embodiment 31, further comprising:

a second inflatable member affixed to the base member, wherein when the first inflatable member and the second inflatable member are inflated, the first inflatable member and the second inflatable member cooperate with one another to form a second storage area, and wherein when the inflatable base and the second inflatable member are inflated, the inflatable base and the second inflatable member cooperate with one another to form a third storage area.

Embodiment 34

The storage device as in any of Enumerated Embodiments 31-33, wherein the first inflatable member is light-bulb shaped having a narrow bottom end affixed to the base member and a wider top end extending upward an above inflatable base.

Embodiment 35

The storage device as in any of Enumerated Embodiments 32-34, wherein the second inflatable member is crescent moon shaped.

Embodiment 36

A storage device, comprising:

a first inflatable base;

a base member affixed to the first inflatable base;

a first inflatable member affixed to the base member, wherein when the first inflatable base and the first inflatable member are inflated, the inflatable base and the first inflatable member cooperate with one another to form a first storage area; and a second inflatable member above the first inflatable base, wherein when the first inflatable member and the second inflatable member are inflated, the first inflatable member and the second inflatable member cooperate with one another to form a second storage area, and wherein when the first inflatable base and the second inflatable member are inflated, the first inflatable base and the second inflatable member cooperate with one another to form a third storage area.

Embodiment 37

The storage device as in Enumerated Embodiment 36, wherein the second inflatable member is affixed to the first inflatable member.

Embodiment 38

The storage device as in any of Enumerated Embodiments 36-37, further comprising a curtain having a top end and a bottom end, wherein the top end is affixed to the second inflatable member and the bottom end is affixed to the base member.

Embodiment 39

The storage device as in any of Enumerated Embodiments 36-38, further comprising a securing device affixed to the base member opposite the first inflatable member.

Embodiment 40

The storage device as in any of Enumerated Embodiments 36-39, further comprising a second inflatable base below the first inflatable base, wherein the second inflatable base is connected to the first inflatable base.

Embodiment 41

The storage device as in Enumerated Embodiment 40, wherein when the storage device is affixed to an object, the second inflatable base may be inflated to a desired pressure to achieve a desired stability of the storage device on the object.

Embodiment 42

The storage device as in any of Enumerated Embodiments 36-41, wherein the first inflatable base and the second inflatable member each further comprise a protective layer proximate the third storage area.

Embodiment 43

The storage device as in any of Enumerated Embodiments 36-42, wherein the first inflatable member and the second inflatable member each further comprise a protective layer proximate the second storage area.

Embodiment 44

The storage device as in any of Enumerated Embodiments 36-43, further comprising a population of bungee cords affixed to one or more of the first inflatable member and the first inflatable base, wherein the population of bungee cords is adapted to secure one or more objects to the storage device.

Embodiment 45

A storage device, comprising:

a first inflatable base;

a base member affixed to the first inflatable base;

a first inflatable member affixed to and extending upward from the base member, wherein the first inflatable member extends above the first inflatable base;

a second inflatable member above the first inflatable base;

a curtain having a top end and a bottom end, wherein the top end is affixed to the second inflatable member and the bottom end is affixed to the base member; and a second inflatable base below the first inflatable base, wherein the second inflatable base is connected to the first inflatable base.

Embodiment 46

The storage device as in Enumerated Embodiment 45, further comprising a securing device affixed to the base member opposite the first inflatable member.

Embodiment 47

The storage device as in any of Enumerated Embodiments 45-46, wherein when the storage device is affixed to an object, the second inflatable base may be inflated to a desired pressure to achieve a desired stability of the storage device on the object.

Embodiment 48

The storage device as in any of Enumerated Embodiments 45-47, wherein the first inflatable base and the second inflatable member each further comprise a protective layer, wherein the protective layers face one another.

Embodiment 49

The storage device as in any of Enumerated Embodiments 45-48, wherein the first inflatable member and the second inflatable member each further comprise a protective layer, wherein the protective layers face one another.

Embodiment 50

The storage device as in any of Enumerated Embodiments 45-49, further comprising a population of bungee cords affixed to one or more of the first inflatable member and the first inflatable base, wherein the population of bungee cords is adapted to secure one or more objects to the storage device.

Embodiment 51

The storage device as in any of Enumerated Embodiments 45-50, wherein the second inflatable base is independently inflatable from the first inflatable base.

Embodiment 52

An inflatable device comprising:

a base element, comprising:

a first inflatable base;

a base member affixed to the first inflatable base; and a second inflatable base below the first inflatable base, wherein the second inflatable base is connected to the first inflatable base.

Embodiment 53

The inflatable device as in Enumerated Embodiment 52, further comprising one or more securing devices affixed to the base member opposite the first inflatable member.

Embodiment 54

The inflatable device as in any of Enumerated Embodiments 52-53, wherein when the inflatable device is affixed to an object, the second inflatable base may be inflated to a desired pressure to achieve a desired stability of the storage device on the object.

Embodiment 55

The inflatable device as in any of Enumerated Embodiments 52-54, wherein when the inflatable device is affixed to an object via the securing device, the second inflatable base may be inflated to a desired inflation pressure, wherein the inflation pressure causes the first inflatable base to rise away from the object, exerting an upward inflation force which is counteracted by a downward pulling force from the securing device which causes the base member to be pulled downward.

In closing, it should be noted that the disclosure is not limited to the above mentioned embodiments and exemplary working examples. Further developments, modifications and combinations are also within the scope of the patent claims and are placed in the possession of the person skilled in the art from the above disclosure. Accordingly, the techniques and structures described and illustrated herein should be understood to be illustrative and exemplary, and not limiting upon the scope of the present disclosure. The scope of the present disclosure is defined by the appended claims, including known equivalents and unforeseeable equivalents at the time of filing of this application.

What is claimed is:

1. An inflatable device, comprising:

a first inflatable base, the first inflatable base having a ring shape around a central hole;

a base member affixed to the first inflatable base, the base member closing off the central hole;

a first inflatable member affixed to the base member, the first inflatable member configured to extend above the first inflatable base when inflated;

a second inflatable member affixed to the first inflatable member, the second inflatable member having a crescent shape.

2. The inflatable device of claim 1, wherein the second inflatable member has a first end and a second end wider than the first end, the first end affixed to the base member.

3. The inflatable device of claim 1, further comprising a securing device affixed to the base member opposite the first inflatable member.

4. The inflatable device of claim 1, further comprising a curtain having a first end and a second end, wherein the first end is affixed to the second inflatable member and the second end is affixed to the base member.

5. The inflatable device of claim 1, wherein when the first inflatable member and the second inflatable member are configured to retain a paddle in a generally vertical orientation when the first inflatable member and the second inflatable member are inflated.

6. The inflatable device of claim 1, further comprising a second inflatable base below the first inflatable base, wherein the second inflatable base is connected to the first inflatable base.

7. The inflatable device of claim 6, wherein the second inflatable base is independently inflatable from the first inflatable base.

8. The inflatable device of claim 6, wherein when the inflatable device is affixed to an object, the second inflatable base may be inflated to a desired pressure to achieve a desired stability of the inflatable device on the object.

9. The inflatable device of claim 1, further comprising a population of bungee cords affixed to one or more of the first inflatable member and the first inflatable base, wherein the population of bungee cords is adapted to secure one or more objects to the inflatable device.

10. The inflatable device of claim 1, wherein the first inflatable base and the second inflatable member each further comprise a protective layer, wherein the protective layers face one another.

11. The inflatable device of claim 1, wherein the first inflatable member and the second inflatable member each further comprise a protective layer, wherein the protective layers face one another.

12. The inflatable device of claim 1, wherein the inflatable device is configured to be attached to a paddleboard.

* * * * *